US009265400B2

(12) United States Patent
Bigott

(10) Patent No.: US 9,265,400 B2
(45) Date of Patent: Feb. 23, 2016

(54) COMMERCIAL KITCHENWARE WASHERS AND RELATED METHODS

(75) Inventor: James W. Bigott, Fenton, MO (US)

(73) Assignee: DUKE MANUFACTURING CO., St. Louis, MO (US)

( * ) Notice: Subject to any disclaimer, the term of this patent is extended or adjusted under 35 U.S.C. 154(b) by 599 days.

(21) Appl. No.: 13/455,920

(22) Filed: Apr. 25, 2012

(65) Prior Publication Data

US 2012/0211028 A1 Aug. 23, 2012

Related U.S. Application Data

(63) Continuation-in-part of application No. 12/842,554, filed on Jul. 23, 2010, now abandoned, which is a continuation of application No. 11/113,403, filed on Apr. 22, 2005, now Pat. No. 7,763,119.

(51) Int. Cl.

| | |
|---|---|
| ***B08B 3/00*** | (2006.01) |
| ***B08B 3/02*** | (2006.01) |
| ***B08B 7/04*** | (2006.01) |
| ***B08B 9/20*** | (2006.01) |
| ***B08B 13/00*** | (2006.01) |
| ***A47L 15/08*** | (2006.01) |
| ***A47L 15/00*** | (2006.01) |

(52) U.S. Cl.

CPC ..... *A47L 15/08* (2013.01); *A47L 15/0031* (2013.01); *B08B 3/00* (2013.01); *B08B 3/02* (2013.01); *B08B 7/04* (2013.01); *B08B 9/20* (2013.01); *B08B 13/00* (2013.01); *A47L 2301/08* (2013.01); *A47L 2401/06* (2013.01); *A47L 2401/22* (2013.01); *A47L 2501/02* (2013.01); *A47L 2501/05* (2013.01); *A47L 2501/26* (2013.01)

(58) Field of Classification Search

CPC ..... B08B 7/04; B08B 3/00; B08B 3/02; B08B 9/20; B08B 13/00

USPC ..... 134/10, 18, 25.2, 42, 56 D, 57 D, 56 R, 134/113

See application file for complete search history.

(56) References Cited

U.S. PATENT DOCUMENTS

| | | | |
|---|---|---|---|
| 392,517 | A | 11/1888 | King |
| 560,673 | A | 5/1896 | Atkinson |
| 982,578 | A | 1/1911 | Dilg |

(Continued)

FOREIGN PATENT DOCUMENTS

| | | |
|---|---|---|
| AU | 673132 | 10/1996 |
| AU | 2002335694 | 3/2003 |

(Continued)

OTHER PUBLICATIONS

Brown-Campbell Company, 2003, Types & Constructions of Bar Grating, may be seen at http://brown-campbell.com/bartype.htm (1 page).

(Continued)

*Primary Examiner* — Saeed T Chaudhry

(74) *Attorney, Agent, or Firm* — Harness, Dickey & Pierce, P.L.C.

(57) ABSTRACT

A method for monitoring tank water replacement of a kitchenware washing assembly generally includes automatically determining whether a counted number of wash cycles is equal to or exceeds a preset value. The method also includes automatically controlling one or more operations of the kitchenware washer assembly where the counted number of wash cycles is equal to or exceeds the preset value.

23 Claims, 49 Drawing Sheets

(56) References Cited

U.S. PATENT DOCUMENTS 1,104,139 A 7/1914 Rodda
1,200,289 A 10/1916 Wittemann
1,414,634 A 5/1922 Fassio
1,420,759 A 6/1922 Sawicki
1,508,828 A 9/1924 Wholey
1,533,159 A 4/1925 Blakeslee
1,545,081 A 7/1925 Cowles
1,566,312 A 12/1925 Coates
1,570,296 A 1/1926 Cave
1,605,961 A 11/1926 Loew
1,658,413 A 2/1928 Patelski
1,714,888 A 5/1929 Perkins
1,790,902 A 2/1931 Cowles
1,793,431 A 2/1931 Charles
1,853,529 A 4/1932 Zademach
1,878,685 A 9/1932 Elkington
1,917,829 A 7/1933 Cole
1,934,539 A 7/1933 Henderson
1,961,548 A 6/1934 Caise
1,966,572 A 7/1934 Webb
2,036,713 A 4/1936 McBath, Jr.
2,091,838 A 8/1937 Staak
2,115,577 A 4/1938 Goldman
2,205,113 A 6/1940 Adams
2,208,397 A 7/1940 Shawber
2,217,531 A 10/1940 Werneth
2,254,824 A 9/1941 Large
2,278,994 A 4/1942 Kempton
2,287,591 A 6/1942 Adams
2,289,890 A 7/1942 Walter
2,299,053 A 10/1942 Ferris
2,307,363 A 1/1943 Dunham
2,360,145 A 10/1944 Lansing
2,372,538 A 3/1945 White
2,444,355 A 6/1948 Kniznick
2,473,007 A 6/1949 Carson
2,501,887 A 3/1950 Cress
2,530,028 A 11/1950 Henning
2,563,109 A 8/1951 Franklin
2,564,186 A 8/1951 Benck
2,589,247 A 3/1952 Guzzetti et al.
2,596,653 A 5/1952 Clague et al.
2,619,100 A 11/1952 Palotsee
2,630,813 A 3/1953 Murdoch
2,632,452 A 3/1953 Spitzer
2,645,235 A 7/1953 Wheeler
2,649,756 A 8/1953 Anderson
2,651,311 A 9/1953 Rule
2,659,804 A 11/1953 Dunn
2,667,975 A 2/1954 Seaholm
2,669,240 A 2/1954 Thorson
2,701,574 A 2/1955 Hollerith
2,721,928 A 10/1955 Boydstun
2,786,123 A 3/1957 Arthur
2,796,993 A 6/1957 Imershein
2,797,567 A 7/1957 Heien
2,842,144 A 7/1958 Lyman
2,896,642 A 7/1959 Lilly
2,900,992 A 8/1959 Johnson
2,912,988 A 11/1959 Kochendorffer
2,918,925 A 12/1959 Dopler
2,970,819 A 2/1961 Kleebauer
2,975,626 A 3/1961 Frey
2,987,260 A 6/1961 Sasnett
3,036,996 A 5/1962 Kogon
3,055,378 A 9/1962 Alford
3,063,459 A 11/1962 Jacobs
3,072,527 A 1/1963 Cohen
3,072,935 A 1/1963 Ruby
3,076,886 A 2/1963 Altman et al.
3,082,779 A 3/1963 Jacobs
3,086,538 A 4/1963 Voltz
3,087,504 A 4/1963 Geschka
3,108,607 A 10/1963 Blakeslee
3,117,583 A 1/1964 Hearn et al.
3,129,711 A 4/1964 Schmitt-Matzen
3,136,903 A 6/1964 Trott
3,217,721 A 11/1965 Hertel
3,230,961 A 1/1966 Benkert et al.
3,277,906 A 10/1966 Goldman
3,279,481 A 10/1966 Sones et al.
3,378,858 A 4/1968 Jacuzzi
3,420,226 A 1/1969 Berry, Sr.
3,444,355 A 5/1969 Tyler
3,453,417 A 7/1969 Hummel
3,533,841 A 10/1970 Radach
3,568,935 A 3/1971 Hoffman
3,586,011 A 6/1971 Mazza
3,592,205 A 7/1971 Sheppard
3,621,856 A 11/1971 Guth
3,625,233 A 12/1971 Southard
3,673,042 A 6/1972 Mayers
3,680,567 A 8/1972 Hansen
3,747,772 A 7/1973 Brown
3,841,116 A 10/1974 Klein et al.
3,846,615 A * 11/1974 Athey et al. ..... 392/441
3,858,595 A 1/1975 Schultz et al.
3,863,657 A 2/1975 Irving
3,997,760 A 12/1976 Salinger
4,004,600 A 1/1977 Corn et al.
4,197,016 A 4/1980 Winterhalter et al.
4,227,546 A 10/1980 Bergeson
4,357,176 A 11/1982 Anthony
4,403,735 A 9/1983 Weaver
4,439,242 A 3/1984 Hadden
4,460,005 A 7/1984 Rodger
4,509,543 A * 4/1985 Livingston et al. ..... 134/57 D
4,615,744 A 10/1986 Murtha
4,641,671 A 2/1987 Nogi et al.
4,655,197 A 4/1987 Atkinson
4,673,441 A 6/1987 Mayers
4,753,258 A 6/1988 Seiichiro
4,773,436 A 9/1988 Cantrell et al.
4,776,359 A 10/1988 Federighi et al.
4,784,167 A 11/1988 Thomas et al.
4,794,228 A 12/1988 Braun, Jr.
4,805,649 A 2/1989 Nezworski
4,818,970 A 4/1989 Natale et al.
4,922,407 A 5/1990 Birk et al.
4,937,732 A 6/1990 Brundisini
5,000,206 A 3/1991 Kramer et al.
5,017,852 A 5/1991 Nagata et al.
5,056,542 A 10/1991 Reinhard
5,131,419 A 7/1992 Roberts
5,136,143 A 8/1992 Kutner et al.
5,140,493 A 8/1992 Janicek
5,143,101 A 9/1992 Mor
5,197,499 A 3/1993 Bodenmiller et al.
5,241,975 A 9/1993 Yanagihara
5,250,160 A 10/1993 Oksman et al.
5,264,043 A 11/1993 Milocco
5,322,078 A 6/1994 Tuttle
5,333,631 A 8/1994 Kirkland et al.
5,398,711 A 3/1995 Ardrey, Jr. et al.
5,459,812 A 10/1995 Taylor
5,470,142 A 11/1995 Sargeant et al.
5,482,064 A 1/1996 Goddard
5,525,161 A 6/1996 Milocco et al.
5,556,478 A 9/1996 Brady et al.
5,560,060 A 10/1996 Dausch
5,601,100 A 2/1997 Kawakami et al.
5,602,728 A 2/1997 Madden et al.
5,603,233 A 2/1997 Erickson et al.
5,608,927 A 3/1997 Lowry et al.
5,620,014 A 4/1997 Milocco et al.
5,622,196 A 4/1997 Luongo
5,725,002 A 3/1998 Payzant
5,775,347 A 7/1998 Hoover et al.
5,810,036 A 9/1998 Hoover et al.
5,819,770 A 10/1998 Randall et al.
5,839,097 A 11/1998 Klausner
5,839,454 A 11/1998 Matz
5,860,361 A 1/1999 Nanjyo et al.
5,890,503 A 4/1999 Bowen

(56) References Cited

U.S. PATENT DOCUMENTS

| | | | | |
|---|---|---|---|---|
| 5,905,648 | A | 5/1999 | Badami | |
| 5,924,433 | A | 7/1999 | Thies et al. | |
| 5,927,309 | A | 7/1999 | Hoover et al. | |
| 5,934,298 | A | 8/1999 | Singh | |
| 5,941,259 | A | 8/1999 | Cleveland | |
| 5,946,448 | A | 8/1999 | Taylor | |
| 5,961,937 | A | 10/1999 | Gobbato | |
| 5,983,908 | A | 11/1999 | Bradley | |
| 6,019,110 | A | 2/2000 | McClure et al. | |
| 6,029,183 | A | 2/2000 | Jenkins et al. | |
| 6,044,854 | A | 4/2000 | Marks | |
| 6,058,247 | A | 5/2000 | Lahey et al. | |
| 6,092,541 | A | 7/2000 | Crane et al. | |
| 6,095,163 | A | 8/2000 | McClure et al. | |
| 6,102,056 | A | 8/2000 | Kotsopey | |
| 6,132,523 | A | 10/2000 | Okuda et al. | |
| 6,169,964 | B1 | 1/2001 | Aisa et al. | |
| 6,189,551 | B1 | 2/2001 | Sargeant et al. | |
| 6,206,036 | B1 | 3/2001 | Loyd et al. | |
| 6,228,180 | B1 | 5/2001 | Caroli | |
| 6,260,565 | B1 | 7/2001 | Welch et al. | |
| 6,289,530 | B1 | 9/2001 | Miller et al. | |
| 6,289,908 | B1 | 9/2001 | Kelsey | |
| 6,327,730 | B1 | 12/2001 | Corbett | |
| 6,363,950 | B2 | 4/2002 | Nishibe et al. | |
| 6,390,104 | B1 | 5/2002 | Gagnon | |
| 6,456,495 | B1 | 9/2002 | Wieloch et al. | |
| 6,484,738 | B1 | 11/2002 | Andrews et al. | |
| 6,521,180 | B2 | 2/2003 | Sergio et al. | |
| 6,550,488 | B2 | 4/2003 | McKee | |
| 6,551,414 | B2 * | 4/2003 | Reichold | 134/18 |
| 6,565,167 | B1 | 5/2003 | Miller et al. | |
| 6,609,259 | B2 | 8/2003 | Cantrell | |
| 6,622,754 | B1 | 9/2003 | Roth et al. | |
| 6,659,114 | B2 | 12/2003 | Bigott | |
| 6,666,218 | B2 | 12/2003 | Lavole et al. | |
| 6,739,348 | B2 | 5/2004 | Inch et al. | |
| 6,791,288 | B2 | 9/2004 | Peterson et al. | |
| 6,799,943 | B2 | 10/2004 | Racer et al. | |
| 6,976,496 | B2 | 12/2005 | Cantrell et al. | |
| 7,021,321 | B2 | 4/2006 | Bigott | |
| 7,049,714 | B2 | 5/2006 | Tran | |
| 7,051,765 | B1 | 5/2006 | Kelley et al. | |
| 7,162,788 | B2 | 1/2007 | Inch et al. | |
| 7,246,624 | B2 | 7/2007 | Cantrell et al. | |
| 7,346,938 | B2 | 3/2008 | Mattson, Jr. et al. | |
| 7,475,698 | B2 | 1/2009 | Bigott | |
| 7,523,757 | B2 | 4/2009 | Cantrell et al. | |
| 7,527,062 | B2 | 5/2009 | Bigott | |
| 7,578,305 | B2 | 8/2009 | Bigott | |
| 7,763,119 | B2 | 7/2010 | Bigott | |
| 2001/0045226 | A1 | 11/2001 | Todd | |
| 2002/0100773 | A1 | 8/2002 | Rodd et al. | |
| 2002/0108969 | A1 | 8/2002 | Rodd et al. | |
| 2003/0127110 | A1 | 7/2003 | Reichold et al. | |
| 2004/0007256 | A1 | 1/2004 | Durazzani et al. | |
| 2004/0055082 | A1 | 3/2004 | Loyd et al. | |
| 2004/0118433 | A1 | 6/2004 | Bigott | |
| 2006/0254619 | A1 | 11/2006 | Bigott | |
| 2007/0034236 | A1 * | 2/2007 | Reichold | 134/18 |
| 2009/0183753 | A1 | 7/2009 | Maennie et al. | |
| 2010/0282281 | A1 | 11/2010 | Bigott | |
| 2011/0017241 | A1 | 1/2011 | Cantrell et al. | |
| 2011/0120503 | A1 | 5/2011 | Cantrell et al. | |
| 2011/0240061 | A1 | 10/2011 | Cantrell et al. | |
| 2011/0240062 | A1 | 10/2011 | Cantrell et al. | |
| 2012/0318299 | A1 | 12/2012 | Bigott | |

FOREIGN PATENT DOCUMENTS

| | | | |
|---|---|---|---|
| CA | 2605638 | | 7/2015 |
| DE | 2304035 | | 8/1974 |
| DE | 2337027 | | 2/1975 |
| DE | 2809112 | | 9/1978 |
| DE | 3527047 | | 2/1987 |
| DE | 3911305 | | 10/1989 |
| DE | 3832144 | | 3/1990 |
| DE | 3914760 | | 11/1990 |
| DE | 4108539 | | 9/1992 |
| DE | 4112230 | | 10/1992 |
| DE | 4418721 | | 11/1995 |
| DE | 29613432 | | 10/1996 |
| DE | 10049751 | | 4/2002 |
| DE | 10065796 | | 5/2002 |
| EP | 0 068 266 | | 1/1983 |
| EP | 0 310 385 | | 4/1989 |
| EP | 0 343 153 | | 5/1989 |
| EP | 0 677 800 | | 10/1995 |
| EP | 0 799 651 | | 10/1997 |
| EP | 0799651 | * | 1/2001 |
| FR | 2 589 608 | | 11/1985 |
| FR | 2 572 238 | | 4/1986 |
| FR | 2 596 429 | | 10/1987 |
| FR | 2 804 005 | | 7/2001 |
| GB | 361049 | | 11/1931 |
| GB | 1469339 | | 4/1977 |
| GB | 2 015 870 | | 9/1979 |
| GB | 2 284 540 | | 6/1995 |
| GB | 2 348 117 | | 9/2000 |
| JP | 61-131798 | | 6/1986 |
| JP | 1-126940 | | 5/1989 |
| JP | 1-293821 | | 11/1989 |
| JP | 2-45094 | | 2/1990 |
| JP | 3-237962 | | 10/1991 |
| JP | 04-341296 | | 11/1992 |
| JP | 6-296574 | | 10/1994 |
| JP | 8-317892 | | 12/1996 |
| JP | 9-28651 | | 2/1997 |
| JP | 9-108158 | | 4/1997 |
| JP | 09-215650 | | 8/1997 |
| JP | 10-258014 | | 9/1998 |
| JP | 11-30440 | | 2/1999 |
| JP | 11-128150 | | 5/1999 |
| JP | 2002-58626 | | 2/2002 |
| JP | 2004-222976 | | 8/2004 |
| KR | 10-0147089 | B1 | 8/1998 |
| KR | 2002049323 | | 6/2002 |
| SE | 9200856 | | 9/1993 |
| WO | WO 93/01640 | | 1/1993 |
| WO | WO 93/21978 | | 11/1993 |
| WO | WO 2006/115929 | | 11/2006 |

OTHER PUBLICATIONS

Third-Party Correspondence submitted in U.S. Appl. No. 11/113,403, including third-party letter dated May 11, 2010 and attachments, 86 pages.

Third-Party Correspondence submitted in U.S. Appl. No. 11/113,403, including third-party letter dated May 27, 2010 and attachments, 68 pages.

Power Soak, Power Soak Systems, Inc., Produce Soak Specifications, 2 pages, (33542—Apr. 23, 2010).

Produce Soak flyer pages, From Potatoes to Tomatoes . . . An Easier Way to Wash & Sanitize Produce, Introducing the Innovative Produce Soak, 2 pages, (received May 3, 2010).

Informational packet and letter discussing the informational packet (as it may pertain to U.S. Appl. No. 12/842,554) sent to Applicant's representative by a third party communication dated Dec. 23, 2010 (79 pages).

Third-Party Submission Under 37 C.F.R. § 1.99 filed in U.S. Appl. No. 12/842,554 (dated Jan. 11, 2011) (64 pages).

Third-Party Submission Under 37 C.F.R. § 1.99 filed in U.S. Appl. No. 13/525,248 (dated Jun. 19, 2013) (42 pages).

Metcraft, Inc., Power Soak SI-100 Owner's Manual, Published at least as early as Apr. 24, 2004.

* cited by examiner

COMMERCIAL KITCHENWARE WASHERS AND RELATED METHODS

CROSS-REFERENCE TO RELATED APPLICATIONS

This application is a continuation-in-part of U.S. patent application Ser. No. 12/842,554 filed Jul. 23, 2010 (published as US 2010/0282281 on Nov. 11, 2010), which, in turn, is a continuation of U.S. patent application Ser. No. 11/113,403 filed Apr. 22, 2005 (now U.S. Pat. No. 7,763,119 issued Jul. 27, 2010). The entire disclosure of the above applications are incorporated herein by reference.

FIELD

The present disclosure relates to commercial kitchenware washers for washing large quantities of commercial kitchenware.

BACKGROUND

This section provides background information related to the present disclosure which is not necessarily prior art.

Commercial washers have been in the marketplace for decades. Many of the commercial washers that are currently on the market include multiple tanks for various cleaning stages (e.g., a scraping tank, washing tank, rinsing tank, and sanitizing tank). The washing tank, at a basic level, typically includes features such as a rectangular tank with a drain, a valve for closing the tank's drain, nozzles attached to walls of the tank for directing water down into the tank, and a pump to circulate water from within the tank into a manifold that feeds the water through the nozzles.

SUMMARY

This section provides a general summary of the disclosure, and is not a comprehensive disclosure of its full scope or all of its features.

According to various aspects of the present disclosure, exemplary embodiments include kitchenware washing assembly assemblies and methods relating to kitchenware washing assemblies.

An exemplary embodiment includes a method for monitoring tank water replacement of a kitchenware washing assembly. In this example, the method generally includes automatically determining whether a counted number of wash cycles is equal to or exceeds a preset value. The method also includes automatically controlling one or more operations of the kitchenware washer assembly where the counted number of wash cycles is equal to or exceeds the preset value.

In an exemplary embodiment, a kitchenware washing assembly generally includes a tank having an inside for holding fluid for washing kitchenware and a control system. The control system is configured to maintain a count of the number of wash cycles performed since the most recent tank water replacement. The control system is also configured to determine whether the count of the number of wash cycles is equal to or exceeds a preset value, and to deactivate one or more operations of the kitchenware washer assembly where the count of the number of wash cycles is equal to or exceeds the preset value.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Example embodiments will now be described more fully with reference to the accompanying drawings.

Figure 15A:
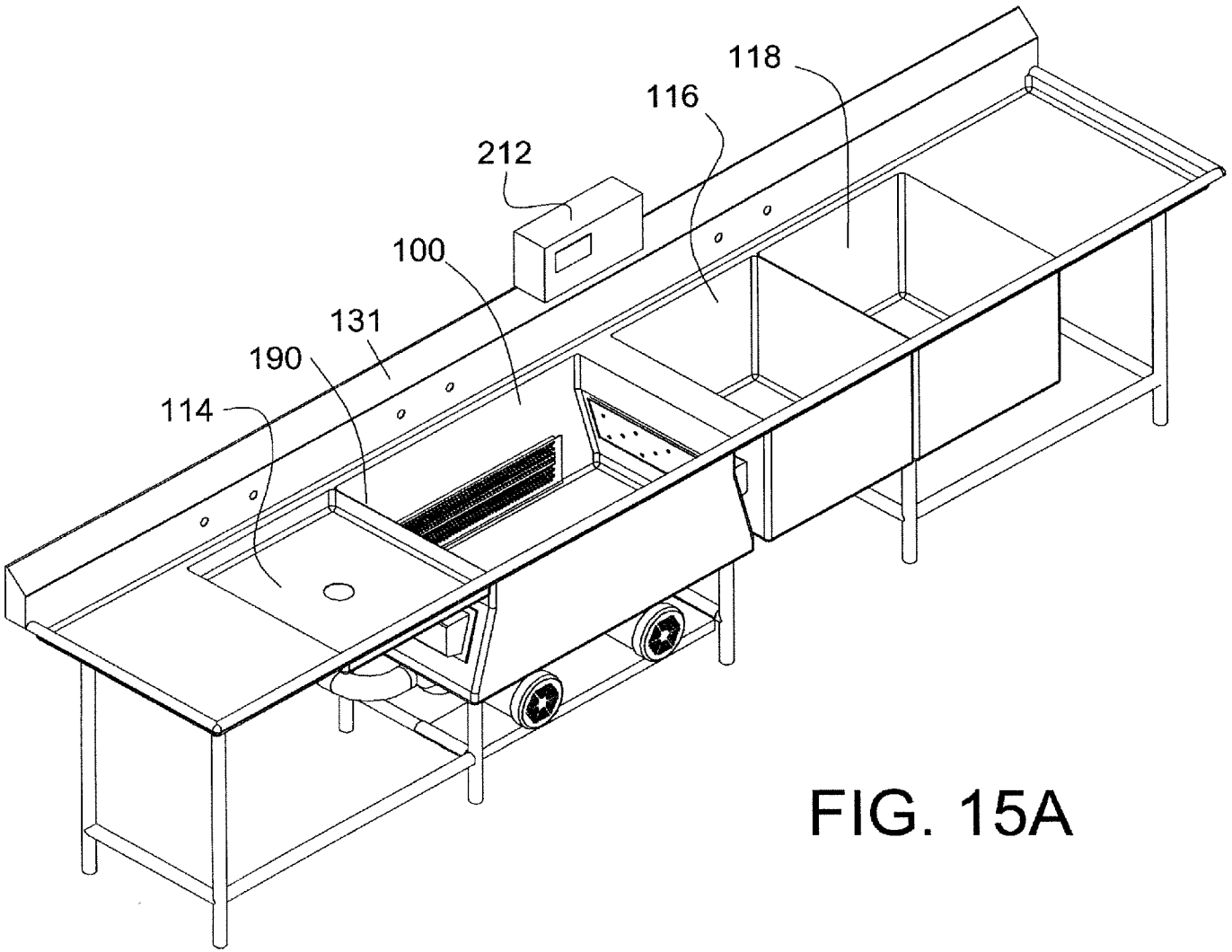
FIGS. 15A and 15B are perspective views of the kitchenware washing assembly shown in FIG. 1 and a control system that can be used for controlling one or more operations of the kitchenware washing assembly, and also illustrating the kitchenware washing assembly incorporated into a compete commercial kitchenware washing system according to one embodiment of the present disclosure.
Figure 15B:
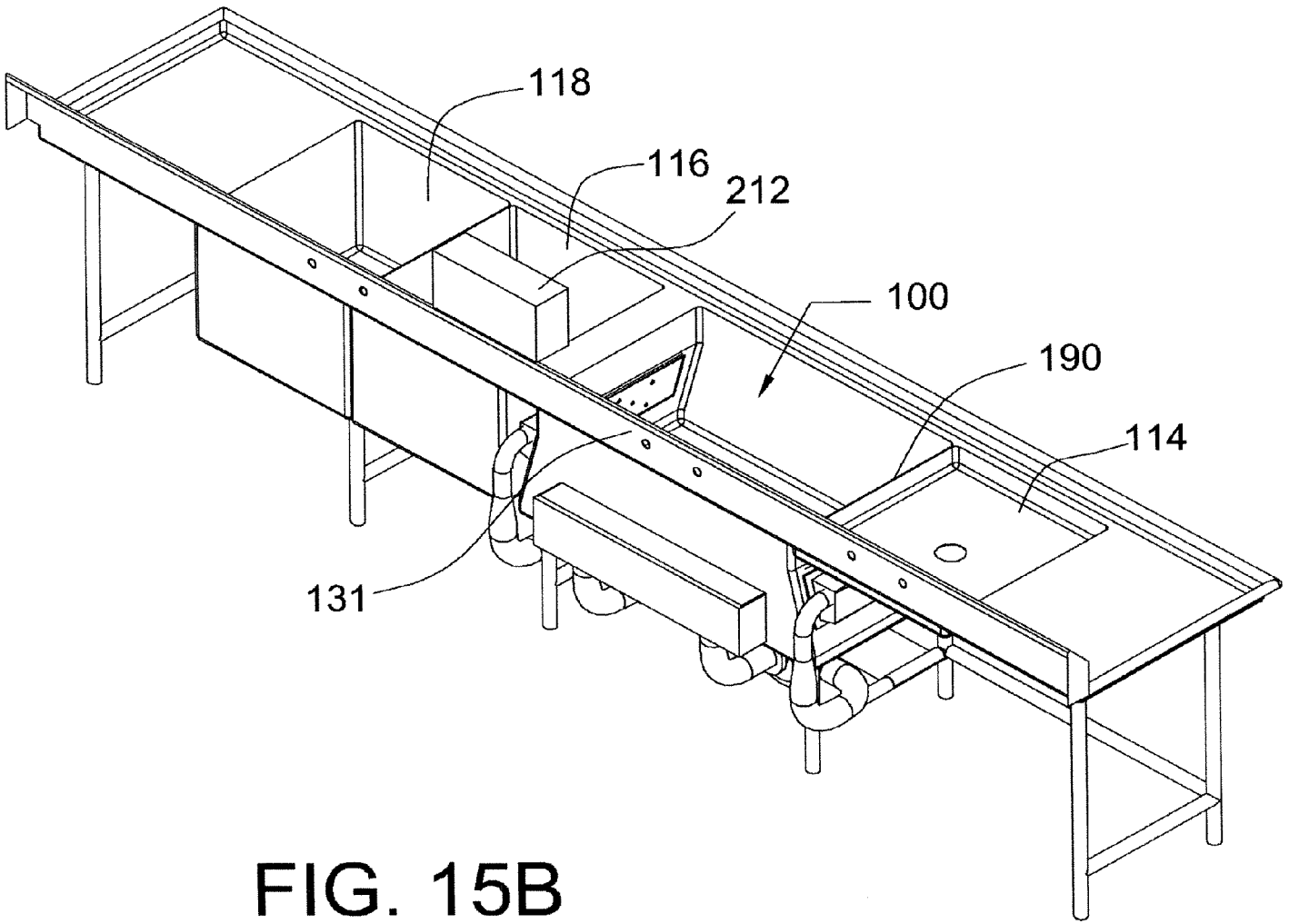

Various aspects of the present disclosure can be adapted to be included in a commercial washer system for commercial or large-scale kitchens, as shown in FIGS. 15A and 15B. Commercial washer systems typically include several contiguous stations such as an initial scraping station to remove bulk food items that have stuck to the dishware, a washing station to wash the remaining food items or food residues from the dishware, a rinsing tank to rinse the soap or cleaning fluids from the dishware, and a sanitizing station to sanitize the cleaned dishware. Various embodiments of the present disclosure provide washers that are capable of washing a variety of kitchenware, including dishware, food service ware and equipment, pots, pans, food trays, grease filters, gratings, or any other items found in commercial or large-scale kitchens that require cleaning.

In various exemplary embodiments, a kitchenware washing assembly generally includes a tank for holding fluid for washing kitchenware. The assembly also includes at least one pump for agitating fluid in the tank and at least one chamber in fluid communication with the tank. At least part of the chamber may be formed unitary with a wall of the tank, which tends to reduce the overall amount of welding, labor, and costs associated with manufacturing the kitchenware washing assembly.

The at least one pump may be configured with at least one drain to allow at least some fluid to drain from the at least one pump. In some embodiments, the at least one drain is at about a low point (e.g., low point of the pump scroll, etc.) of the at least one pump to thereby allow drainage of the fluid from the at least one pump. In addition, locating the at least one drain at about a low point of the at least one pump can advantageously allow drainage of at least some of the fluid from the at least one pump solely via gravity. In some embodiments, substantially all of the fluid can be drained from the at least one pump solely via gravity. In addition to the at least one drain, the at least one pump can also include at least one outlet coupled in fluid communication with at least one outlet of the assembly, such as one or more discharge openings, holes, perforations, pipes, etc. for directing fluid into the tank. In some embodiments, the at least one pump comprises two or more pumps. In such embodiments, at least one valve is coupled to the at least one drain of the two pumps such that the at least one valve is operable for opening and closing the at least one drain of the two pumps.

The tank can also include at least one drain. Some embodiments include an actuator configured for opening and closing both the at least one drain of the tank and the at least one drain of one or more pumps.

The tank may include two wall portions and an outlet positioned on each of the two wall portions. The assembly may further include at least one inlet and one or more pumps for pumping the fluid from the inlet to the outlets. At least one pump and the tank may be connected by at least one fluid passage. The at least one fluid passage may be configured with at least one drain at about a low point of the at least one fluid passage to allow drainage of the fluid from the at least one pump and the at least one fluid passage.

Other aspects relate to methods of draining fluid from at least one pump of a kitchenware washing assembly. In one exemplary embodiment, a method generally includes opening (e.g., manually, automatically, combinations thereof, etc.) at least one drain at about a low point of the at least one pump such that the fluid drains from the at least one pump through the open drain. The method can also include closing the at least one drain.

The process of opening the at least one drain can include opening at least one valve coupled to the at least one drain. For example, an operator may manually open the at least one valve. Or, for example, the at least one valve may be automatically opened without manual intervention, such as by activating at least one solenoid coupled to the at least one valve.

In some embodiments, the tank includes at least one drain. In such embodiments, the method can include substantially simultaneously opening the tank drain and the at least one drain of the at least one pump. Additionally, the method can include opening the at least one drain of the tank and the at least one drain of the at least one pump with a single actuator. The method may also include closing the at least one drain of the tank and the at least one drain of the at least one pump with a single reverse actuation of the actuator.

Various exemplary methods can include monitoring wash cycles to detect an indicator that the fluid for washing kitchenware should be replaced; after detecting the indicator that the fluid for washing kitchenware should be replaced, deactivating the at least one pump; and opening the at least one drain.

Various exemplary methods can include counting a number of wash cycles since a replacement of the fluid for washing kitchenware; comparing the counted number of wash cycles to a preset value; if the counted number of wash cycles is equal to or exceeds the preset value, deactivating the at least one pump; and opening the at least one drain. In some embodiments, the operator is allowed to input the preset value.

Other exemplary methods relate to a kitchenware washing assembly that includes at least one fluid passage connecting the at least one pump and the tank. In one such embodiment, a method generally includes opening at least one drain at about a low point of the at least one fluid passage such that the fluid drains from the at least one pump and the at least one fluid passage through the open drain.

Other aspects relate to methods of assembling kitchenware washing assemblies, where the kitchenware washing assembly includes a tank for holding fluid for washing kitchenware, at least one outlet for dispensing fluid into the tank, at least one inlet for receiving fluid from the tank, and at least one pump for pumping fluid from the at least one inlet to the at least one outlet. In one exemplary embodiment, the method generally includes positioning the at least one pump such that at least one drain thereof is at about a low point of the at least one pump, to thereby allow drainage of fluid for washing kitchenware from the at least one pump.

The method of assembling can also include coupling the at least one drain to at least one valve such that the at least one valve is operable for opening and closing the at least one drain. In some embodiments, the method may include coupling at least one drain of the tank and the at least one drain of the at least one pump to the same actuator for opening and closing the drains.

Exemplary embodiments of the present disclosure may include washing assemblies that include two variable speed pumps, wherein each pump is separately operable at a different speed as compared to the other pump. In such embodiments, one of the pumps may remain active while the other pump is idle or inoperable (e.g., due to a failure or malfunction). In addition, this multi-pump design also increases the effectiveness of the washer by providing more turbulence, while also allowing the washer to clean dishware having varied fragility, for example, by only operating one of the pumps at a relatively low rate while the other pump is idle.

In another aspect of the present disclosure, a kitchenware washing assembly includes a tank for holding fluid for washing and at least one pump. The washing assembly further includes at least one of an intake chamber for receiving fluid from the tank, and an outlet chamber on a wall of the tank for dispensing fluid into the tank. Either or both of the outlet chamber and/or intake chamber can have positive draining. For example, various embodiments include an outlet chamber configured to provide drainage into the tank and/or an intake chamber configured to provide drainage into the tank. In these embodiments, fluid will drain out of the intake chamber and/or outlet chamber into the tank such that little to no fluid will remain within the intake chamber and/or outlet chamber when the washing assembly is drained.

In another aspect of the present disclosure, a kitchenware washing assembly includes a tank for holding fluid for washing kitchenware, at least one pump, at least one outlet for dispensing fluid into the tank, and at least one intake chamber for receiving fluid from the tank. The washing assembly further includes at least one intake cover for separating the intake chamber from the tank. The intake cover includes a plurality of inlets (e.g., holes, perforations, openings, etc.) and at least one projection that extends into the tank. The projection inhibits kitchenware (e.g., plates, pans, etc.) from being drawn up against the inlets and blocking fluid passage through the inlets, which might otherwise decrease operational efficiency of the kitchenware washing assembly. In various embodiments, the intake cover is readily detachable from the tank, which, in turn, allows the intake cover, its inlet holes, and the intake chamber (and components therein) to be more easily serviced. For example, the intake cover can be removed in order to replace the intake cover, to clean out the inlet holes, to clean the intake cover, to clean the intake chamber, and/or to replace a heating element within the intake chamber.

In another aspect of the present disclosure, a kitchenware washing assembly includes a tank for holding fluid for washing kitchenware, at least one pump, and at least one inlet for receiving fluid from the tank. The washing assembly also includes at least one outlet chamber on a wall of the tank for dispensing fluid into the tank. The washing assembly further includes at least one detachable outlet cover configured to cover the outlet chamber. The detachable outlet cover includes a plurality of outlets (e.g., discharge openings, holes, perforations, pipes, etc.) for directing fluid into the tank. In various embodiments, the outlet cover is readily detachable from the tank, which, in turn, allows the outlet cover and outlet chamber to be serviced (e.g., cleaned, replaced, etc.) much easier.

In addition, various embodiments include a plurality of detachable interchangeable outlet covers each of which is configured to cover the outlet chamber. Each outlet cover has a plurality of outlets forming a different pattern (e.g., arranged differently, differently sized, differently shaped, etc.) from the other outlet covers. By selecting from amongst the interchangeable outlet covers, the fluid flow pattern into the tank can be customized or varied for a particular application (e.g., particular type of kitchenware, different customer performance levels, etc.). Accordingly, the interchangeable outlet covers can further increase the utility and efficiency of the kitchenware washing assembly.

In another aspect of the present disclosure, a kitchenware washing assembly includes a tank for holding fluid for washing kitchenware, at least one pump, at least one outlet for dispensing fluid into the tank, and at least one inlet for receiving fluid from the tank. The washing assembly further includes a control system with a consolidated removable control module. The consolidated removable control module includes electronic components (e.g., a circuit breaker, a fuse, a motor starter, a relay, a printed circuit board electronic circuitry, etc.) for substantially controlling one or more operations of the washing assembly. In various embodiments, the removable control module is a pluggable module such that, in the event of a failure, the entire module can be removed and replaced in its entirety by a layperson. Advantageously, this can allow for the elimination of costly service calls by a technician, for example, to perform diagnostics in the field to determine which individual component failed, and downtime of the machine while waiting for that service to be performed.

Any of the above described aspects of the present disclosure can be used individually or in combination with any one or more of the other aspects of the present disclosure.

An exemplary kitchenware washing assembly embodying several aspects of the present disclosure is illustrated in FIGS. 1 through 13 and is indicated generally by reference character 100. As shown in FIGS. 1 through 13, the washing assembly 100 includes a tank 102, two pumps 104 and 106, and outlets or discharge openings 108.

The tank 102 can and typically should include a drain 110 and valve system (not shown) to allow the tank 102 to be filled and emptied. The tank 102 will also typically include a faucet (not shown) to fill the tank 102.

In general operation, the tank 102 is filled to operating level. One or both of the pumps 104 and/or 106 can be operating to pump cleaning fluid (e.g., water and a detergent or soap) from tank 102 through intake cover 150 to outlets or discharge openings 108. The drain 110 and valve system should be in a closed position to maintain the cleaning fluid in the tank 102. By way of example only, FIGS. 15A and 15B show the washing assembly 100 incorporated into an overall commercial washing system, including a scraping station 114, the washing assembly 100, a rinsing station 116, and a sanitizing station 118. Also shown in FIGS. 15A and 15B is an exemplary control system 212 (described in more detail below and shown in FIGS. 34 through 36) that can be used for controlling one or more operations of the kitchenware washing assembly 100.

Figure 1:
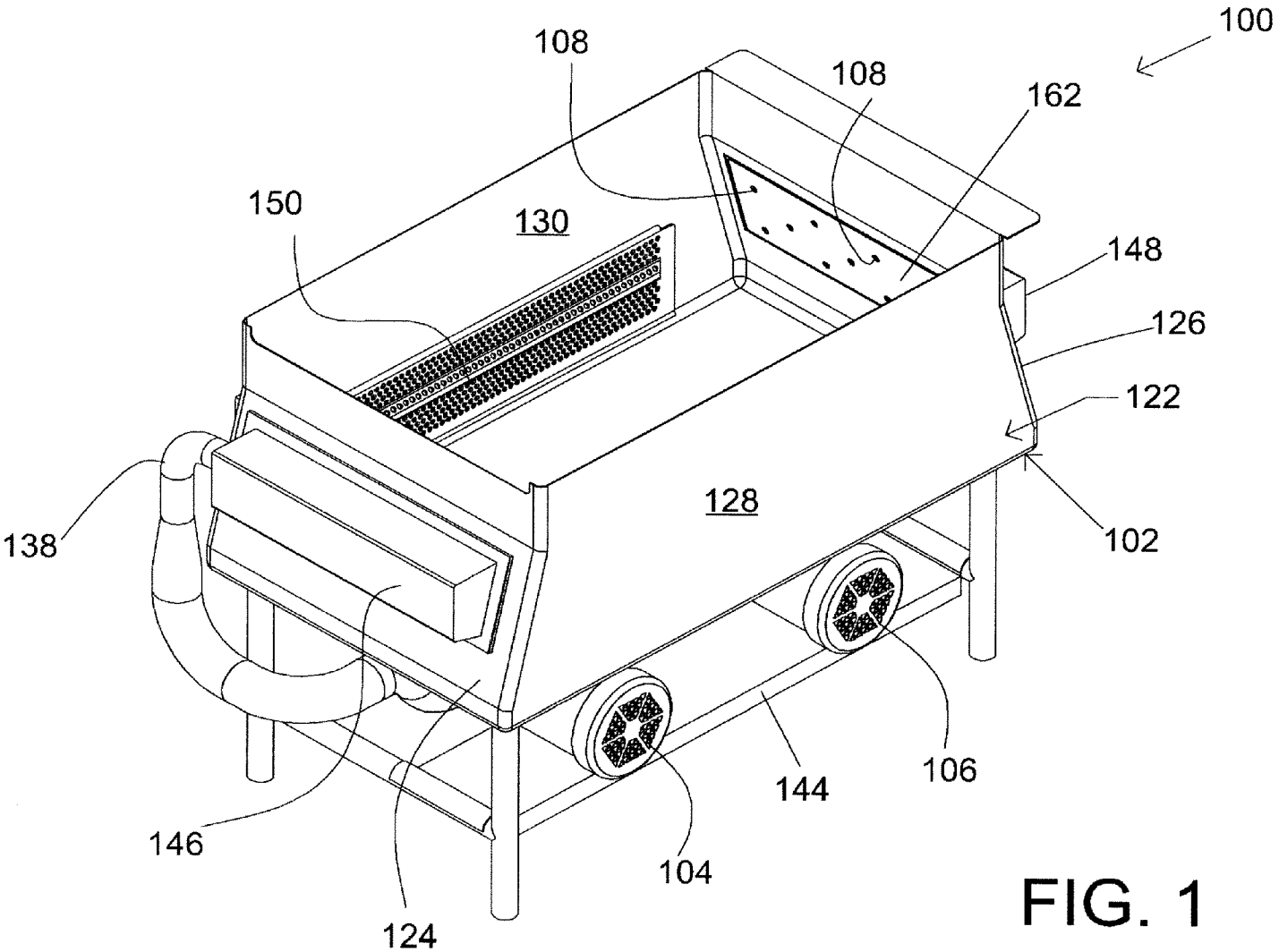
FIG. 1 is an upper perspective view of a kitchenware washing assembly according to one embodiment of the present disclosure.
Figure 2:
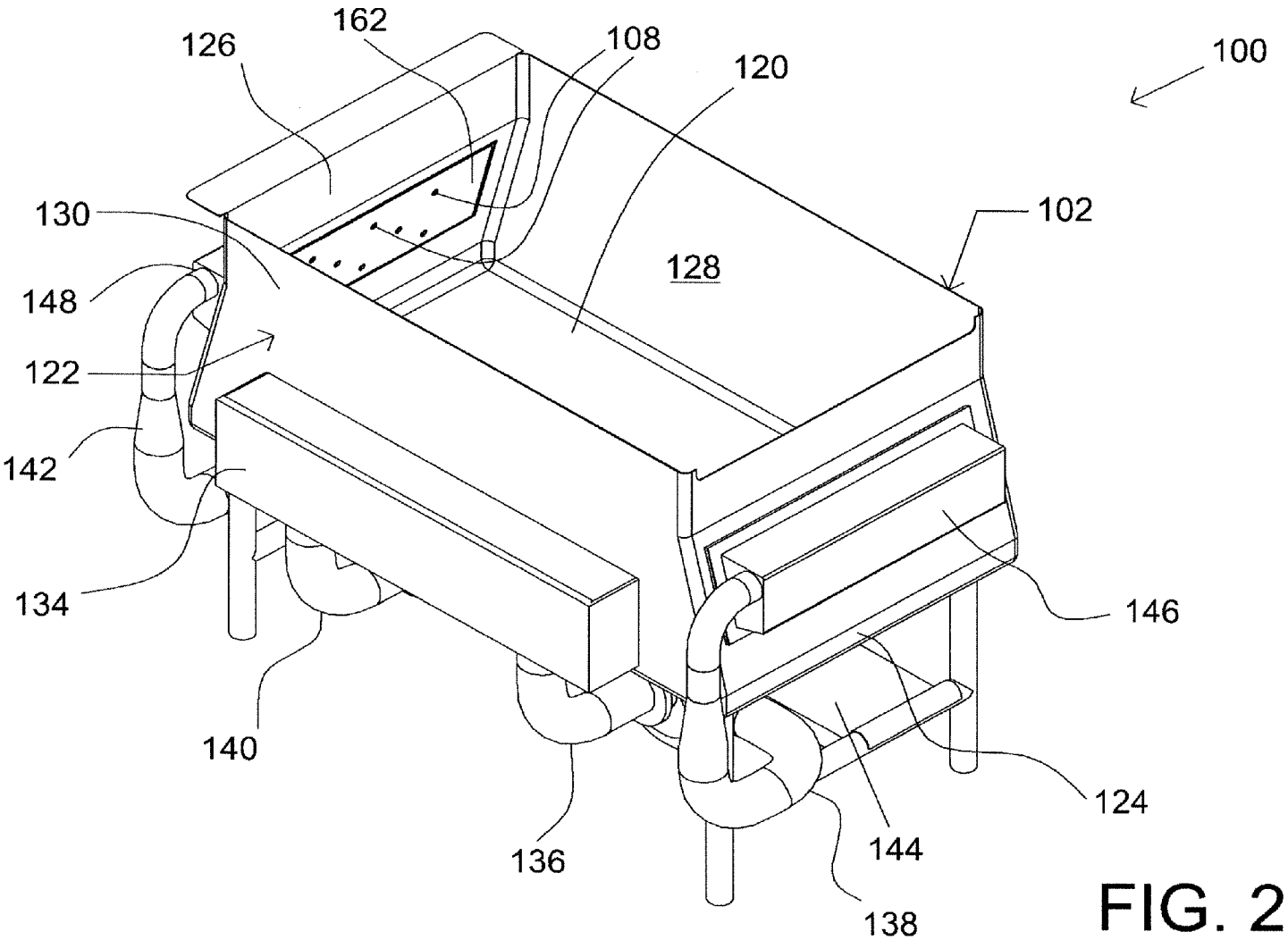
FIG. 2 is another upper perspective view of the kitchenware washing assembly shown in FIG. 1.
Figure 3:
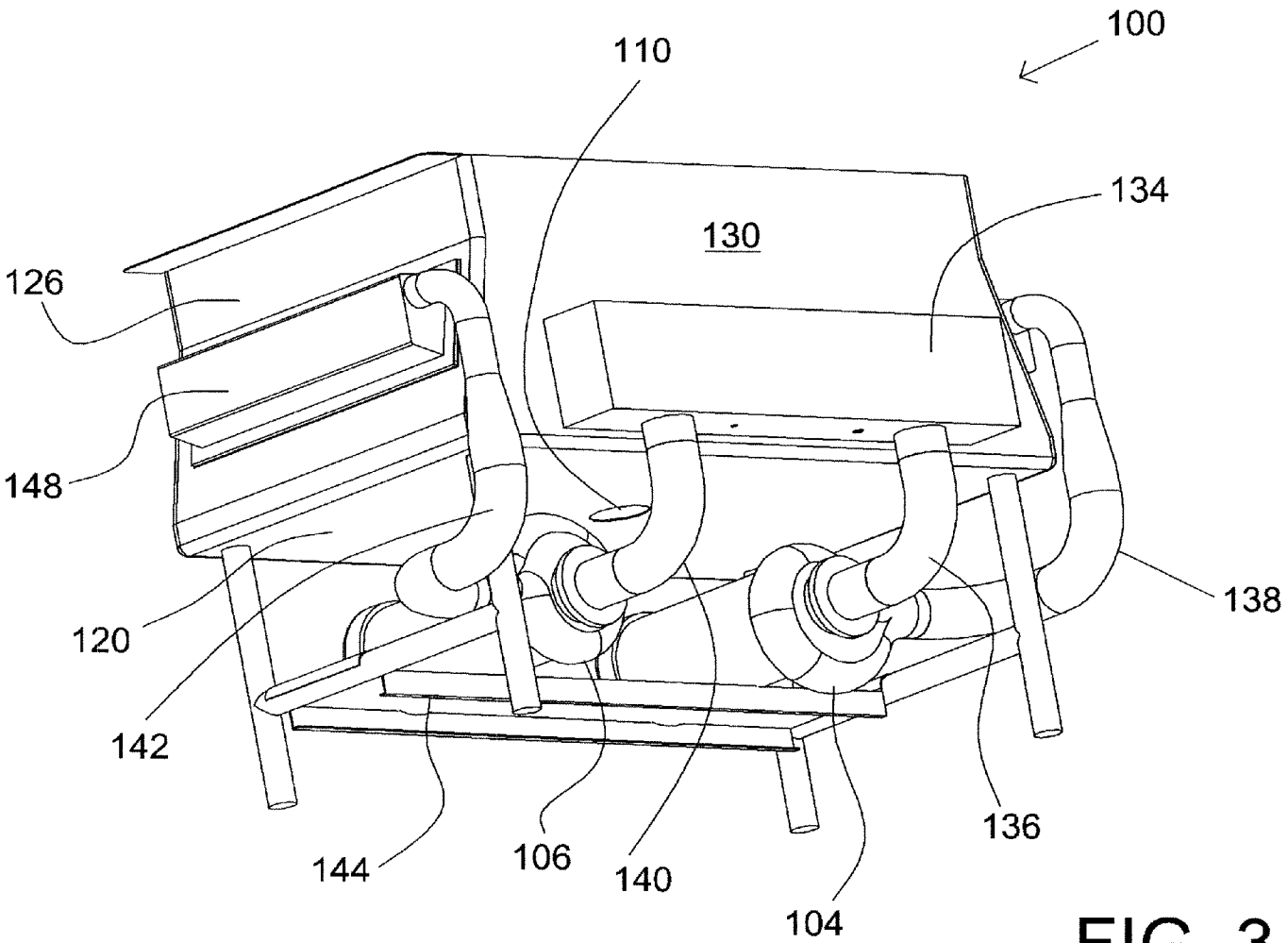
FIG. 3 is a lower perspective view of the kitchenware washing assembly shown in FIG. 1.

With continued reference to FIGS. 1 through 3, the tank 102 includes a bottom 120 and an enclosure wall 122 extending generally upwardly from the bottom 120. In the illustrated embodiment, the enclosure wall 122 is formed by four walls 124, 126, 128, and 130. Alternative embodiments, however, can include tanks formed with more or less than four walls and/or formed in any other suitable configuration including cup-shaped, cylindrical, cubical, triangular, trapezoidal, circular, ovular, prismatic, a configuration having four walls generally perpendicular to the bottom, etc.

When the tank 102 is oriented as shown in FIG. 1, the walls 124 and 126 are sidewalls, wall 128 is a front wall, and wall 130 is a back wall. In the illustrated embodiment, the sidewalls 124 and 126 are shorter in height from top to bottom than the length from left to right of the front and back walls 128 and 130. Accordingly, the tank 102 is wider from left to right than the tank 102 is deep from front to back.

In one particular embodiment, the sidewalls 124 and 126 are preferably about twenty-eight inches in length from front to back and eighteen inches in height from top to bottom. Walls 128 and 130 are preferably about forty-two inches in length from left to right at the bottom edge, and preferably about thirty-six inches in length from left to right at the top edge. This difference in length between the top and bottom edges accounts for the angled portions 170 and 172 of walls 124 and 126. Front wall 128 is preferably the same height from top to bottom as sidewalls 124 and 126. In addition, a backsplash 131 can be provided that is preferably slightly higher than the tank walls by a few inches, as shown in FIGS. 15A and 15B. The dimensions are set forth as mere examples and can be varied as understood by those skilled in the art. For example, alternative tank configurations can include a configuration in which all tank walls are the same size and shape, a configuration in which the tank is circular or cup-shaped, or some other geometric configuration.

A wide range of materials can be used for the tank walls and bottom. In one embodiment, the tank walls and bottom are formed from stainless steel, thus providing a sturdy, long-lasting structure. Alternatively, other materials can be used for the tank walls and bottom. For example, the tank could be injection molded or thermoformed from a plastic or other suitable material.

The thickness of the tank walls can also vary depending, for example, on the particular application. In one embodiment, the tank walls and the bottom are formed from fourteen-gauge stainless steel, type 304.

The tank's bottom 120 can be downwardly sloped to cause water to flow to the drain 110 (FIG. 8) when the drain 110 is open. The drain 110 can be conventionally connected to the facility plumbing and drainage system (not shown). Drain 110 can also include a shutoff valve (not shown) that allows the user to open and close the drain 110 to allow the tank 102 to be filled and emptied as desired. The drain 110 can further include a screen or perforated cover (not shown) to prevent debris from entering the drain 110 and clogging or partially clogging it. In various embodiments, the drain 110 and its connection to facility plumbing is standard and in use in most commercial washers.

A commercial washer of the variety disclosed herein should be able to circulate fluid within the tank to create turbulence in the tank. The turbulence helps to clean kitchenware and loosen tough food residues or remnants that become caked-on kitchenware during the cooking or food preparation process. In various embodiments of the present disclosure, the following components generally provide this function: intake opening 132, pumps 104 and 106, and outlets or discharge openings 108.

As just mentioned, the turbulence in the tank 102 helps to clean kitchenware and loosen tough food residues or remnants that become caked-on kitchenware during the cooking or food preparation process. In various embodiments, operation of the pumps 104 and 106 can advantageously heat the fluid within the tank 102 even without using a heater (e.g., heater 216, 416, 516, 616, etc.). In one particular embodiment, operation of the pumps 104 and 106 can increase the temperature of the fluid within the tank from about sixty-five degrees to about one hundred eighteen degrees Fahrenheit in about ninety minutes without using a heater. This heating can occur, for example, by way of the pumps 104 and 106 creating sufficient turbulence in the tank and by friction-generated heat from the rotating pump impellers. Advantageously, this can allow for reduced operating time for the heater (s), which, in turn, can provide significant energy savings, operating costs, prolong the useful life of the heater.

Figure 12:
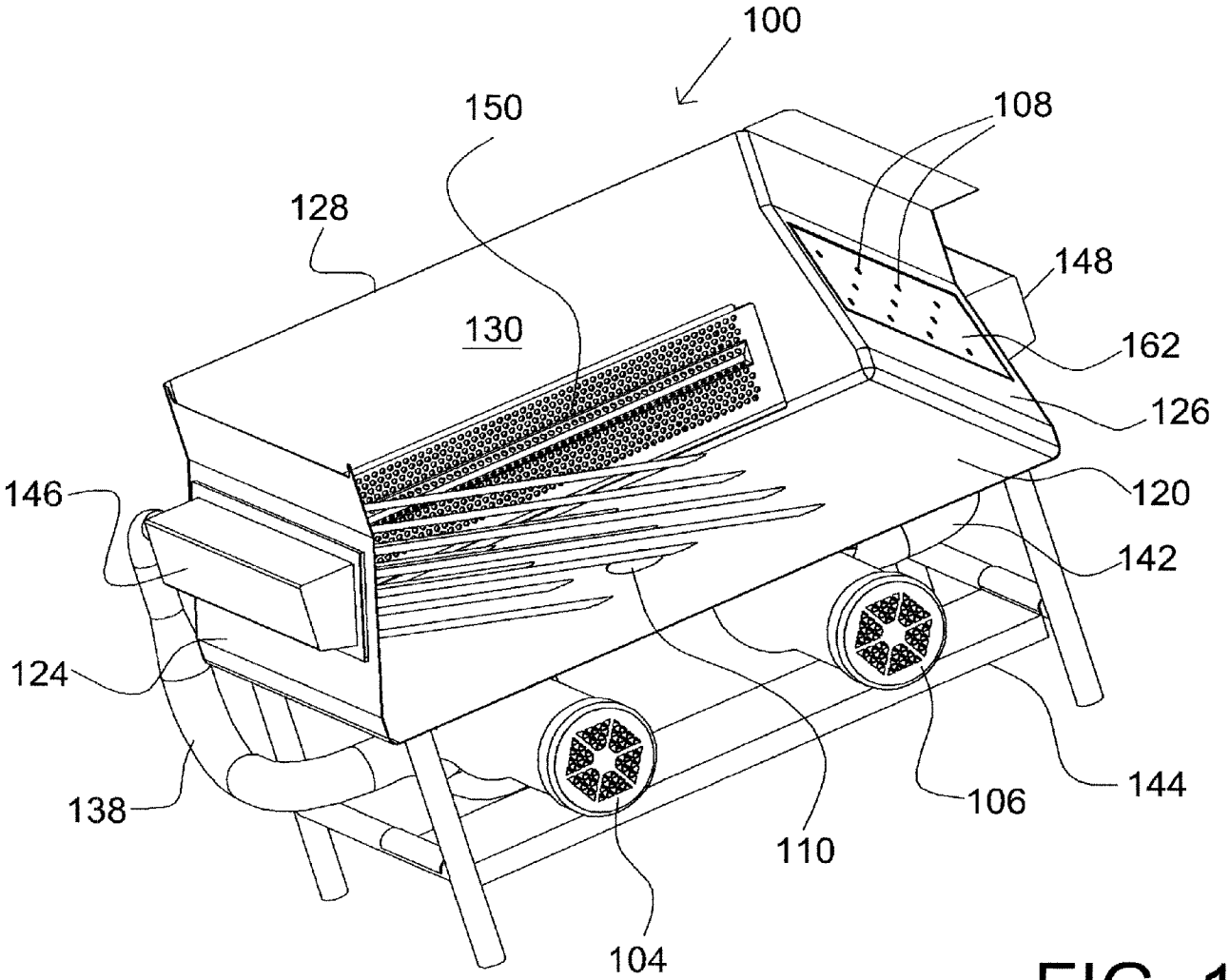
FIG. 12 is a perspective view of the kitchenware washing assembly shown in FIG. 1 with a portion broken away to reveal the fluid flow when only one pump is operating.
Figure 13:
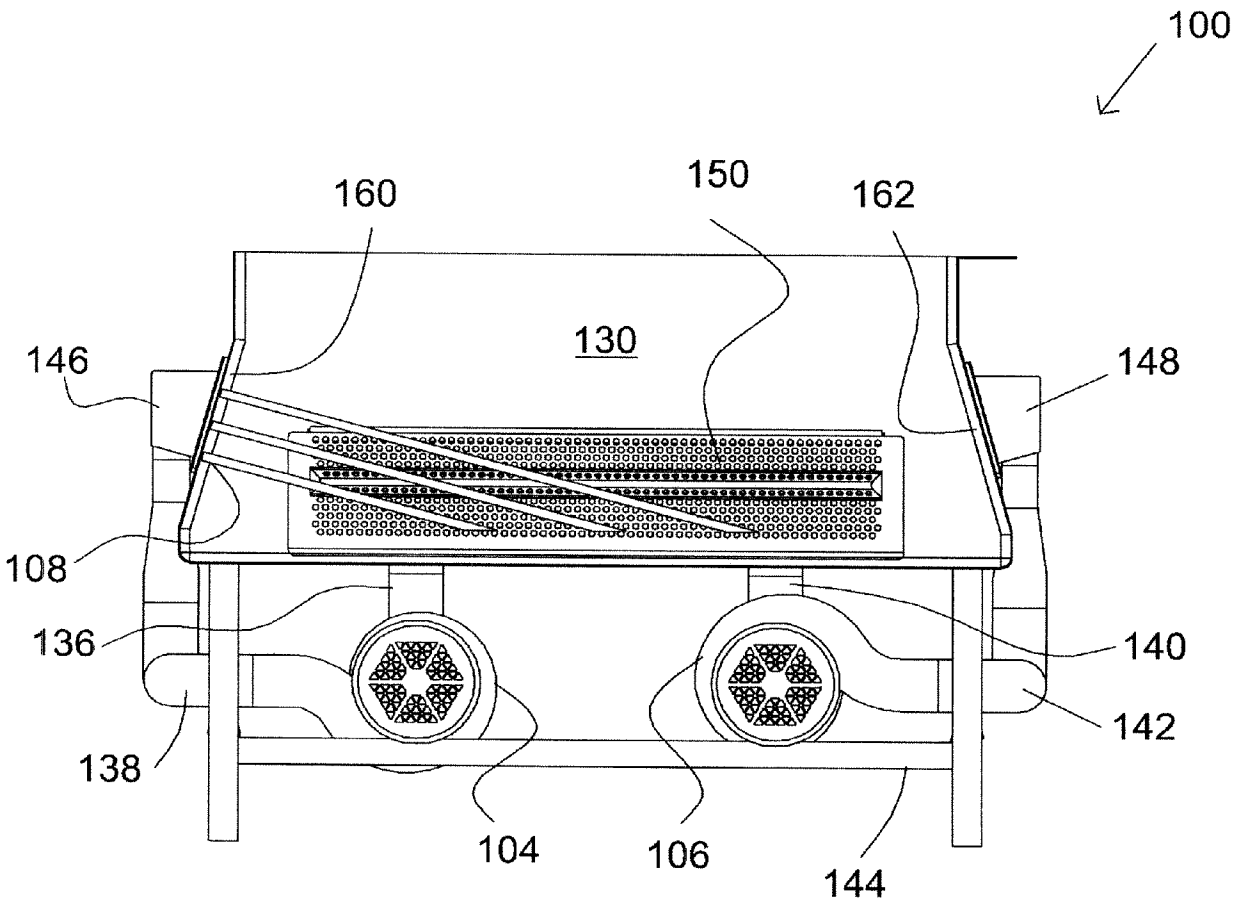
FIG. 13 is a cross-sectional view of the kitchenware washing assembly of FIG. 12 showing the fluid flow from the discharge openings when only one pump is operating.

Each pump 104 and 106 is coupled in fluid communication with the tank 102 through the intake opening 132 on the back wall 130 and through outlets or discharge openings 108 on a respective one of the tank sidewalls 124 and 126. By using two pumps 104 and 106, one of the pumps may remain active while the other pump is idle or inoperable due to failure or malfunction, as shown in FIGS. 12 and 13. Accordingly, a multi-pump system allows for at least some use of the tank 102 even when one pump is inoperable and/or being serviced.

As compared to commercial washers having a single pump that is single speed and that creates a constant level of turbulence, a multi-pump design can increase the effectiveness of the washer by providing adjustable levels of turbulence as well as providing higher turbulence, which can be especially useful for removing inordinately "caked-on" food. With a multi-pump design of the present disclosure, one pump may be shut down while the other pump runs at a low rate in order to reduce the turbulence to a level more suitable for cleaning more fragile and delicate dishware, such as china and expensive ceramic plates. A multi-pump design also allows for reducing the length (and costs) of the fluid conduits as compared to the fluid conduit length for connecting a single pump to the inlet and both outlets. Either or both pumps 104 and/or 106 can be cycled off and on at various speeds and durations to alter flow patterns in the tank 102. Accordingly, embodiments of the present disclosure are suitable for use with a variety of cleaning needs including large pots and pans that are not subject to breaking under turbulent tank conditions as well as more delicate and fragile dishware.

Alternative embodiments, however, can include more or less than two pumps depending, for example, on the particular application. For example, another embodiment includes a third pump which may be connected to an outlet chamber on the front wall. Yet another embodiment includes a washing assembly that includes only one pump. Further embodiments can include a separate intake chamber for each pump rather than having each pump 104 and 106 connected to a single intake chamber 134. In such embodiments, one pump can be coupled in fluid communication between a respective intake chamber and outlet, and the other pump can be coupled in fluid communication between the other intake chamber and outlet.

Referring to FIGS. 1 through 3, fluid conduits are used for coupling each pump 104 and 106 in fluid communication between the intake chamber 134 and the outlet chambers 146, 148 on the respective sidewalls 124 and 126. More specifically, fluid conduits 136 and 138 respectively connect the pump 104 to the intake chamber 134 and to the outlet chamber 146. Fluid conduits 140 and 142 respectively connect the pump 106 to the intake chamber 134 and to the outlet chamber 148. Alternatively, however, either or both pumps 104 and 106 can be connected directly to the intake chamber 134 and/or outlet chamber 146, 148 without any connecting fluid conduits.

In various embodiments, the pumps 104 and 106 are positioned relative to the intake chamber 134 and outlet chambers 146, 148 in order to optimize (or at least reduce) the length of the conduits 136, 138, 140, 142. For example, and as shown in FIG. 3, each pump 104 and 106 is positioned under the bottom 120 of the tank 102 such that each pump's inlet is aligned with the respective location at which the fluid conduit 136 and 140 connects to the intake chamber 134. This, in turn, reduces the conduit length needed to connect each pump to the intake chamber 134. The shorter conduit lengths can allow the washing assembly 100 to operate more quietly because of less resistance (less wasted power) due to the shorter intake and discharge lengths. In addition, various embodiments allow for smoother less turbulent (and thus quieter) flow in the conduits due to smoother transitions (e.g., fewer sharp corners, fewer turns). Further, the shorter suction conduits reduce the chance of pump cavitation, which, in turn, also allows for quieter operation.

Although the illustrated embodiment includes outlets on two opposing walls, aspects of the present disclosure are not so limited. For example, alternative embodiments of the present disclosure include a tank having outlets on only one wall, a tank having outlets on two walls that are not opposing, and a tank having outlets on more than two walls. In addition, other embodiments include a tank having an outlet and an intake opening on the same wall.

A wide range of materials can be used for the fluid conduits 136, 138, 140, and 142, and the same material need not be used for each fluid conduit. Exemplary materials that can be used for the fluid conduits include rubber, plastic, stainless steel, and combinations thereof, among other suitable materials. In one particular embodiment, the fluid conduits 136, 138, 140, 142 are formed from two-inch or three-inch diameter rubber tubing such that the fluid conduits are relatively flexible. While the fluid conduits 136, 138, 140, 142 are illustrated with generally circular cross-sections, other suitable cross-sectional shapes can be used for the fluid conduits.

Figure 16:
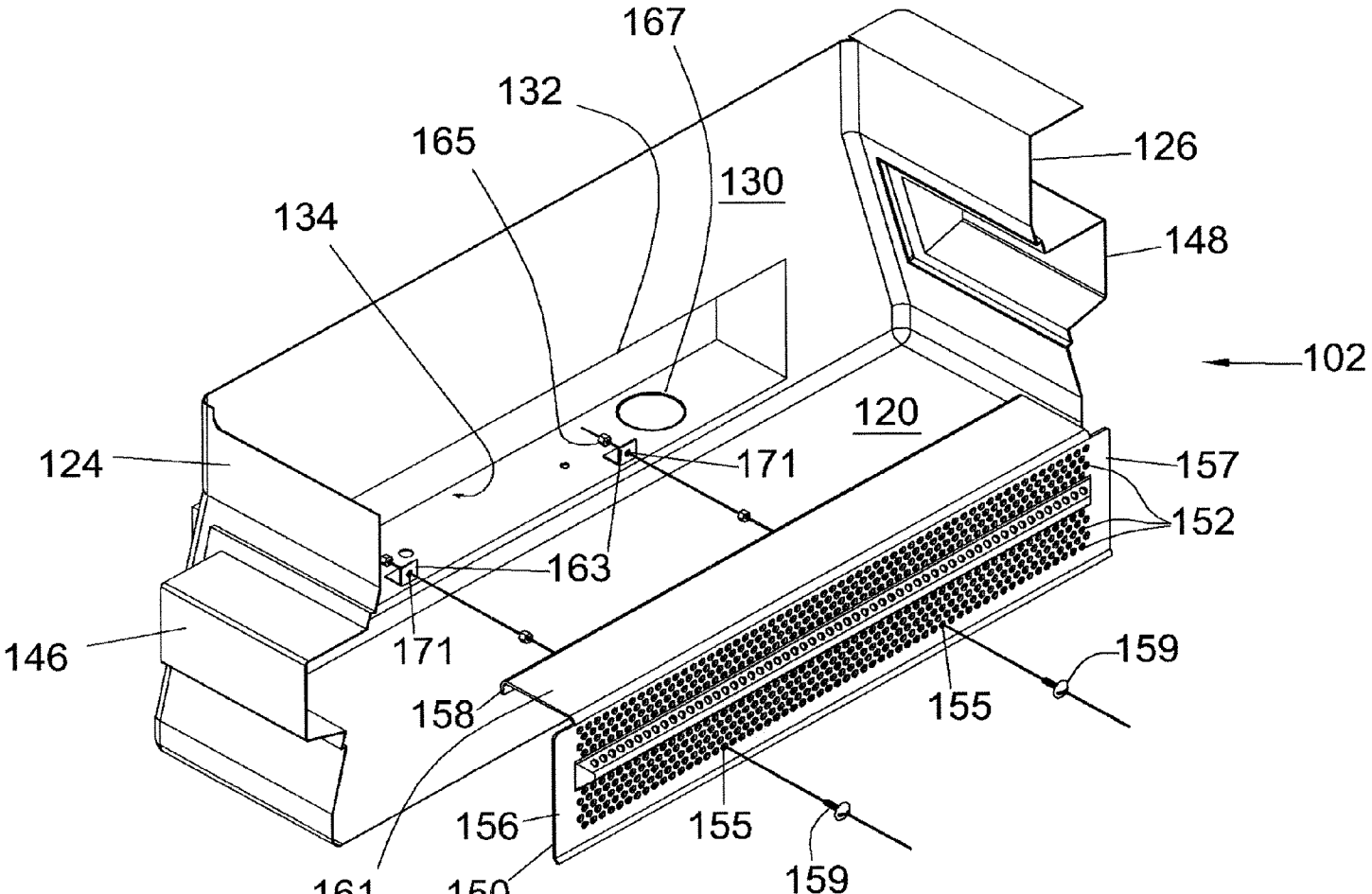
FIG. 16 is a partial exploded perspective view of a kitchenware washing assembly with a front portion of the tank broken away and illustrating an intake cover that can be used for separating an intake chamber from the tank according to one embodiment of the present disclosure.
Figure 17:
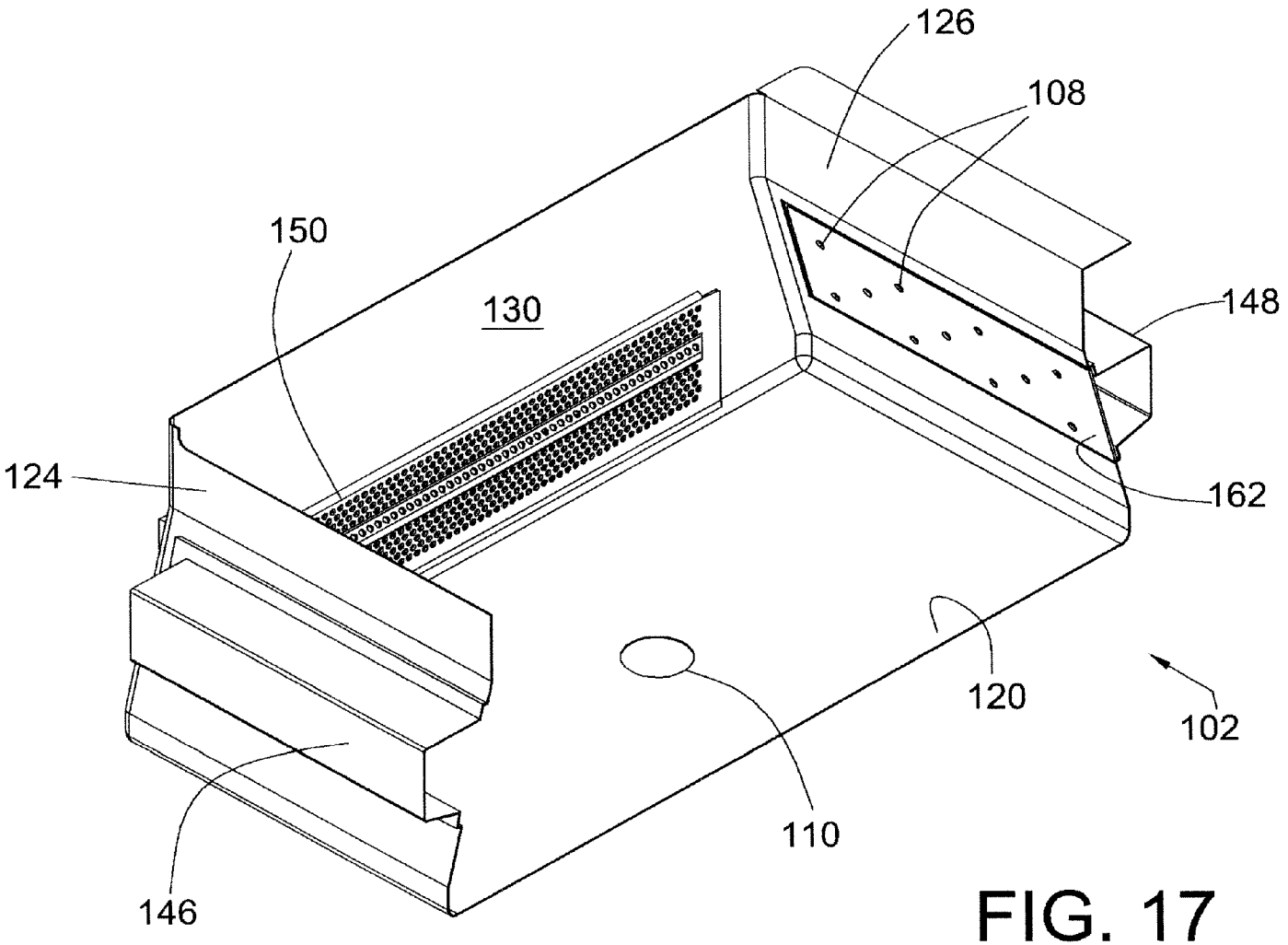
FIG. 17 is a partial perspective view of the tank and intake cover shown in FIG. 16 after the intake cover has been positioned over the intake chamber.

As shown in FIG. 16, the intake opening 132 comprises a front open portion of the intake chamber 134, which, in turn, is disposed on the back wall 130. Alternatively, the intake opening 132 and intake chamber 134 can be located at any other tank location, such as the front wall, bottom, sidewalls, etc.

The fluid conduits 136 and 140 connect to the intake chamber 134 along the bottom of the intake chamber 134 such that the fluid conduits 136 and 140 are spaced apart from one another. Alternatively, the fluid conduits 136 and 140 can be connected to the intake chamber 134 at other suitable locations.

The fluid conduits 136 and 140 can be coupled to the intake chamber 134 in various ways. In embodiments in which the fluid conduits 136 and 140 are formed from relatively rigid pipes, such as stainless steel, the fluid conduits 136 and 140 can be welded, bolted (e.g., by flange connection), threaded, bonded, etc. to the intake chamber 134. In one example embodiment, the fluid conduits 136, 140 and the intake chamber 134 are formed from a weldable material like stainless steel. In this particular example, the fluid conduits 136 and 140 are welded to a wall of the intake chamber 134.

Figure 14A:
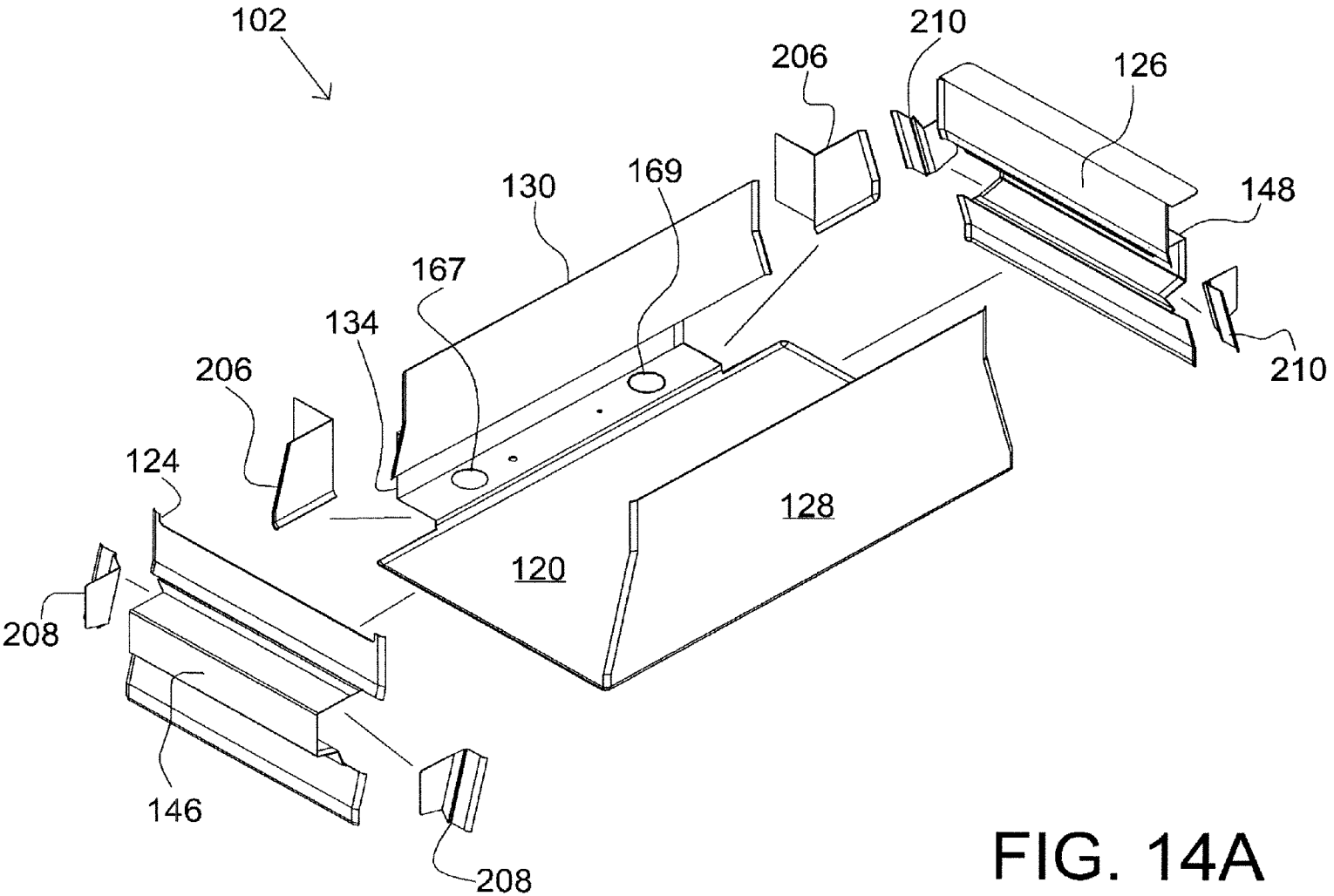
FIGS. 14A through 14E are exploded perspective views of a kitchenware washing assembly according to one embodiment in which portions of the tank are unitarily formed.

In embodiments in which the fluid conduits 136 and 140 are formed from generally flexible tubing or hoses, the fluid conduits 136 and 140 can be connected to the intake chamber 134 by way of connector members or fittings, such as hose barbs or bibs. For example, hose barbs 135 (FIG. 14B) can be attached (e.g., bolted, welded, adhesively bonded, threaded, etc.) to the intake chamber 134 at locations 167 and 169 (FIG. 14A). Alternatively, in those embodiments in which the tank is formed by injection molding or thermoforming, hose barbs can be unitarily or monolithically formed with the tank such that the hose barbs would not be separately attached to the intake chamber.

A wide range of materials can be used for the hose barbs 135, depending, for example, on the particular material(s) used for intake chamber 134 and/or the particular means by which the hose barbs 135 will be attached to the intake chamber 134. In one particular embodiment, the hose barbs 135 are formed from stainless steel and are welded to the intake chamber 134.

The fluid conduits 136 and 140 can be coupled to the hose barbs 135 in various ways depending, for example, on the particular material(s) forming the hose barbs 135 and conduits 136, 140. In one particular embodiment, end portions of the conduits 136 and 140 are slid over the hose barbs 135, and then clamps (not shown) are used to retain the conduits 136 and 140 to the hose barbs 135. Alternatively, other suitable means can be employed for coupling the fluid conduits 136 and 140 to the intake chamber 134.

The fluid conduits 138 and 142 connect to the respective outlet chambers 146 and 148 along the chamber end walls 208, 210. Alternatively, the fluid conduits 138 and 142 can be connected to the respective outlet chambers 146 and 148 at other suitable locations.

The fluid conduits 138 and 142 can be coupled to the respective outlet chambers 146 and 148 in various ways. In embodiments in which the fluid conduits 138 and 142 are formed from relatively rigid pipes, such as stainless steel, the fluid conduits 138 and 142 can be welded, bolted (e.g., by flange connection), threaded, bonded, etc. to the respective outlet chambers 146 and 148. In one exemplary embodiment, the fluid conduits 138, 142 and the outlet chambers 146, 148 are formed from a weldable material, such as stainless steel. In this particular example, each fluid conduit 138 and 142 is welded (e.g. extrusion welded, etc.) to a wall of the corresponding outlet chamber 146 and 148.

In embodiments in which the fluid conduits 138 and 142 are formed from generally flexible hoses, the fluid conduits 138 and 142 can be connected to the respective outlet chambers 146 and 148 by way of connector members or fittings, such as hose barbs or bibs. For example, hose barbs can be attached (e.g., bolted, welded, adhesively bonded, threaded, etc.) to the outlet chambers 146 and 148 in various ways. Alternatively, in those embodiments in which the tank is formed by injection molding or thermoforming, hose barbs can be unitarily or monolithically formed with the outlet chambers 146 and 148 such that the hose barbs would not be separately attached to the outlet chambers.

A wide range of materials can be used for the hose barbs, depending, for example, on the particular material(s) forming the outlet chambers 146, 148 and/or the particular means by which the hose barbs are attached to the outlet chambers 146 and 148. In one particular embodiment, the hose barbs are formed from stainless steel and are welded to the outlet chambers 146 and 148.

The fluid conduits 138 and 142 can be coupled to the hose barbs in various ways depending, for example, on the particular material(s) forming the hose barbs and conduits 138 and 142. In one particular embodiment, end portions of the conduits 138 and 142 are slid over the hose barbs, and then clamps (not shown) are used to retain the conduits 138 and 142 to the hose barbs. Alternatively, other suitable means can be employed for coupling the fluid conduits 138 and 142 to the respective outlet chambers 146 and 148.

Figure 9:
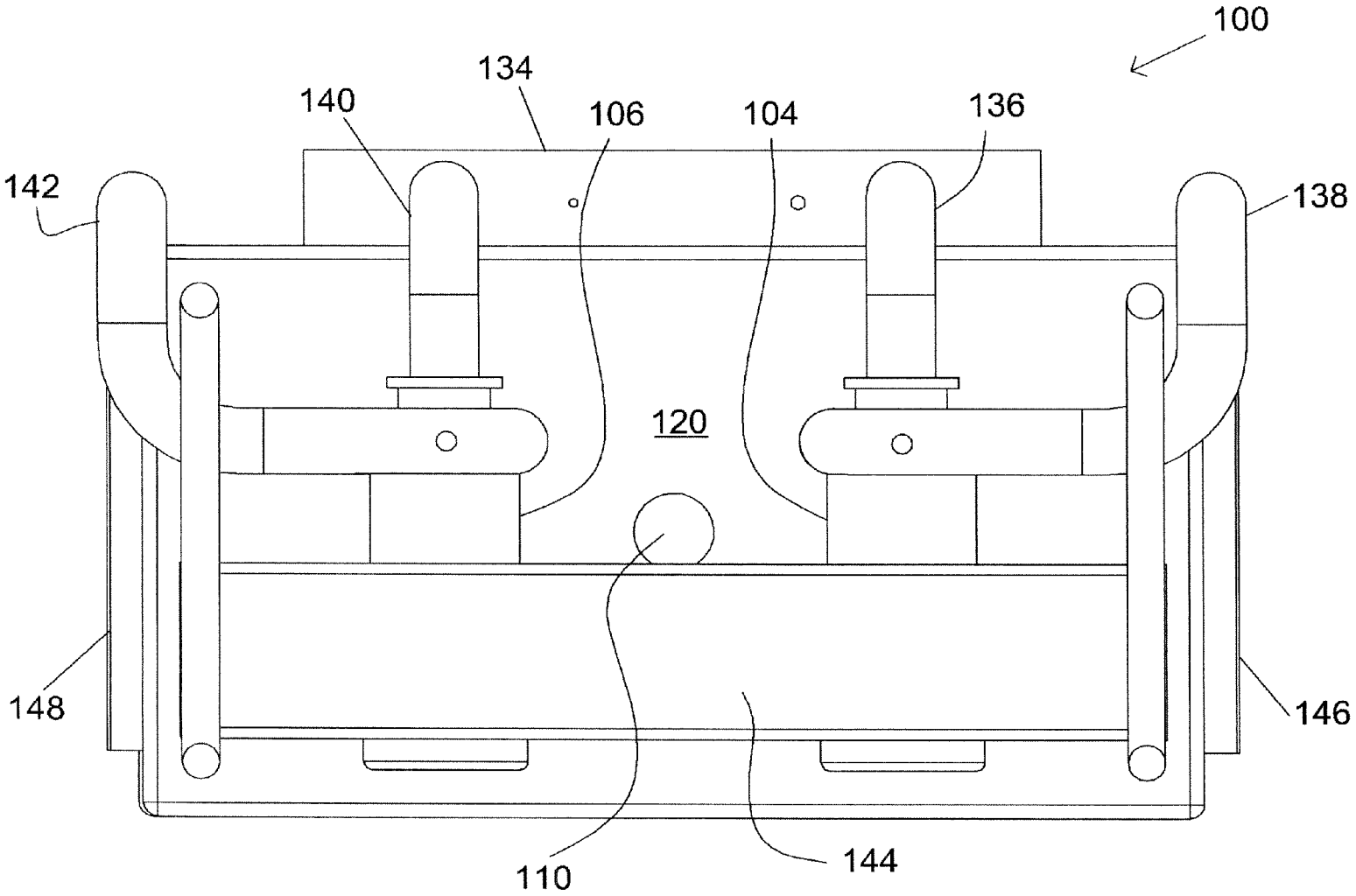
FIG. 9 is a bottom plan view of the kitchenware washing assembly shown in FIG. 1.

As shown in FIG. 9, the pumps 104 and 106 are positioned and supported by a slidable shelf 144. The shelf 144 can be positioned generally under the tank 102, thereby providing a convenient storage location for the pumps 104 and 106. When the pumps 104 and/or 106 need to be serviced, the shelf 144 can be slidably moved out from under the tank 102 to thereby provide access to the pumps 104 and 106. In some embodiments, each pump 104 and 106 is positioned on a separate shelf so that each pump can be separately slid out from under the tank 102. In such embodiments, one pump can thus be serviced without having to disconnect and/or slide the other pump out from under the tank. In various embodiments, the pumps 104 and 106 are configured such that they can be readily detached from their respective conduits 136, 138, 140, and 142.

Figure 41:
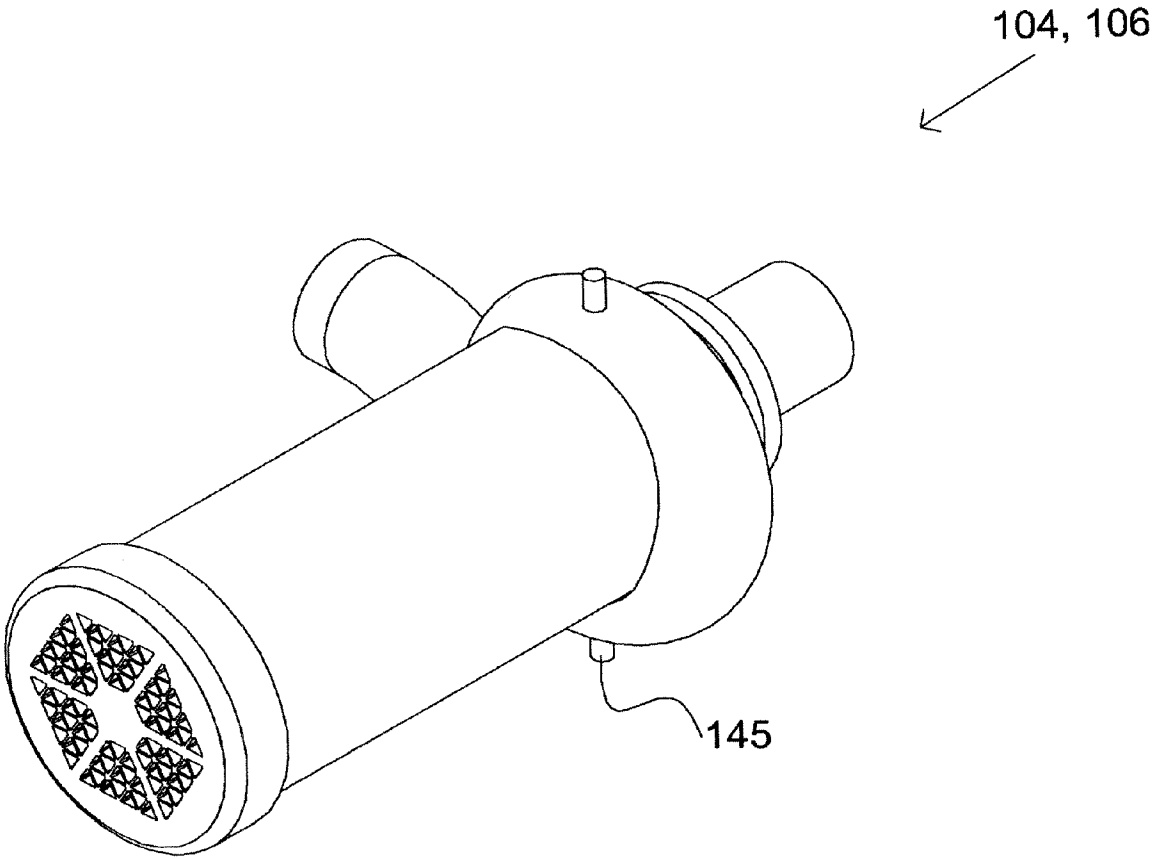
FIG. 41 is a perspective view of a pump having a drain according to one embodiment of the present disclosure.

As shown in FIG. 41, each pump 104 and 106 includes a drain 145 positioned at or near a low point in each pump. These drains 145 provide an operator with the ability to drain a substantial portion of the fluid from the tank 102, interconnecting conduits 136, 138, 140, 142 and/or from each pump 104 and 106. Each drain 145 is preferably operable with little effort by the operator. By way of example only, these drains 145 can be controlled by a manual valve, an actuator activated valve, combinations thereof, and/or by other suitable means.

In various embodiments, each pump 104 and 106 is a variable speed pump that is separately operable at a different speed as compared to the other pump. A control system (e.g., control system 212 described herein and shown in FIGS. 34 through 36) can be used for controlling the operation of the pumps 104 and 106. The control system can include one or more modes configured to operate one pump at a different speed than the other pump. For example, the control system may include a mode in which one pump is idle while the other pump is operational.

When operating, the pumps 104 and 106 draw cleaning fluid from the tank 102 through inlet holes 152 of the intake cover 150 and into the respective fluid conduits 136 and 140. The pumps 104 and 106 direct the cleaning fluid through the respective fluid conduits 138 and 142 to the outlet chambers 146 and 148 for discharge by the openings 108 into the tank 102.

A wide range of pumps can be used for pumps 104 and 106. In one particular embodiment, each pump 104 and 106 comprises a one and one-half horsepower three thousand four hundred fifty revolutions per minute pump. In another each pump 104 and 106 is a closed-coupled, end suction centrifugal pump with a maximum capacity of three hundred gallons per minute at eighteen hundred revolutions per minute, and each pump 104 and 106 includes a two horsepower, frequency drive duty motor. Alternatively, other suitable pumps can be used.

In one particular embodiment, the intake opening 132 is preferably about seven inches in height from top to bottom, and thirty inches in length from left to right. In addition, the intake chamber 134 is preferably about four inches deep from front to back as measured from the intake opening 132 to the back wall of the intake chamber 134. The dimensions are set forth as mere examples and can be varied as understood by those skilled in the art.

Referring now to FIGS. 16 through and 23, an intake cover 150 can be positioned to cover intake opening 132. The intake cover 150 includes inlets and a projection 154 that extends into the tank 102.

As used herein, the term "inlet" broadly includes any opening for receiving fluid from the tank, such as perforations, pipes, and holes. In the illustrated embodiment, the intake cover's inlets are inlet holes 152 in the intake cover 150. The term "inlet holes", as used herein, refers to mere holes in the intake cover 150, or equivalent openings, which do not include separate parts such as pipes, nozzles, or the like for receiving fluid flow from the tank.

The inlet holes 152 allow fluid to be drawn into the intake chamber 134, while the intake cover 150 restricts food debris and other small items like silverware from entering the intake opening 132 and entering the pumps 104 and 106. In addition, the projection 154 helps keep kitchenware (e.g., plates, pans, dishware, etc.) from being drawn up flush against the inlet holes 152 and blocking fluid passage through the inlet holes 152, which might otherwise decrease operational efficiency of the kitchenware washing assembly.

Figure 19:
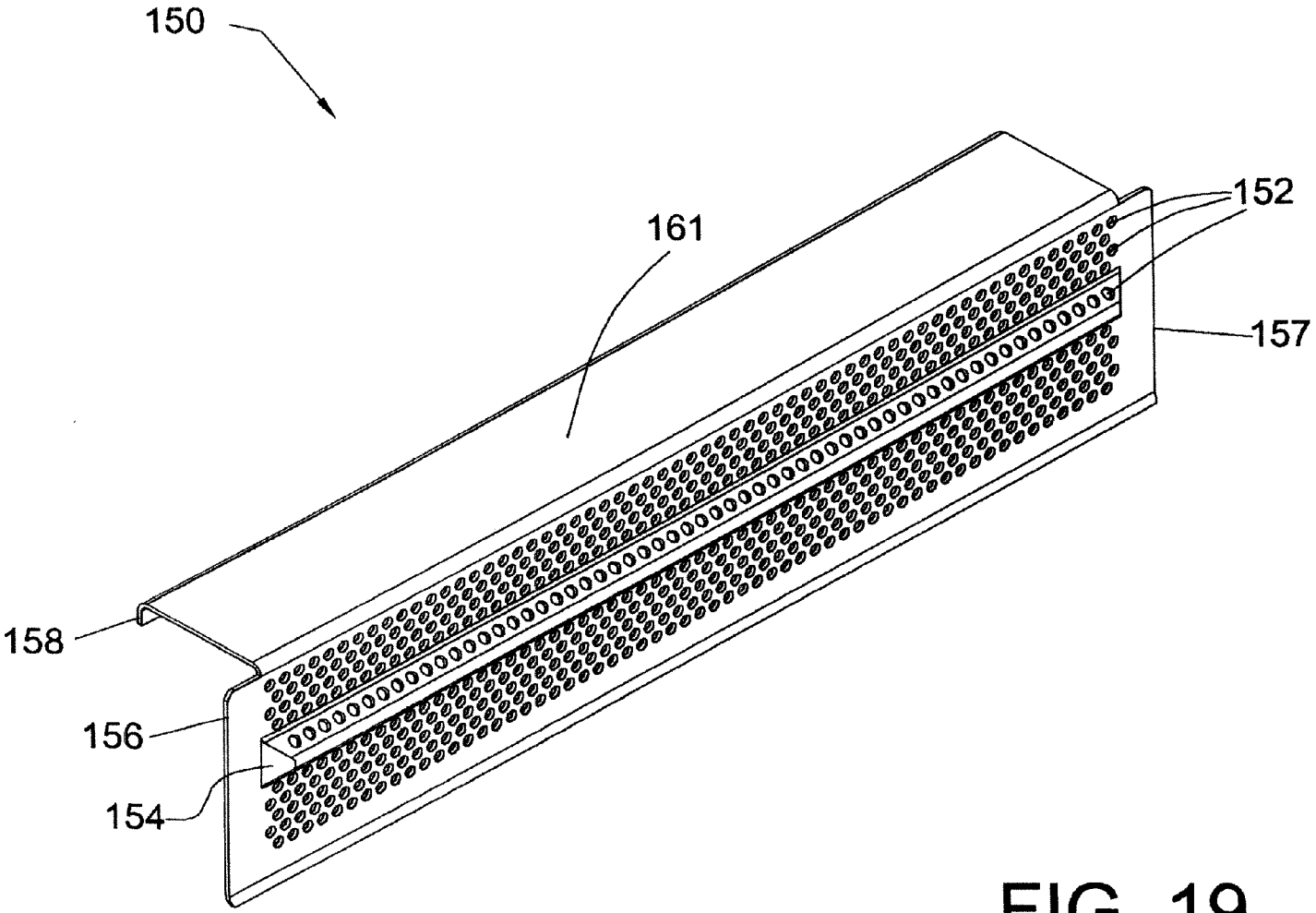
FIG. 19 is an outer perspective view of the intake cover shown in FIG. 16.
Figure 20:
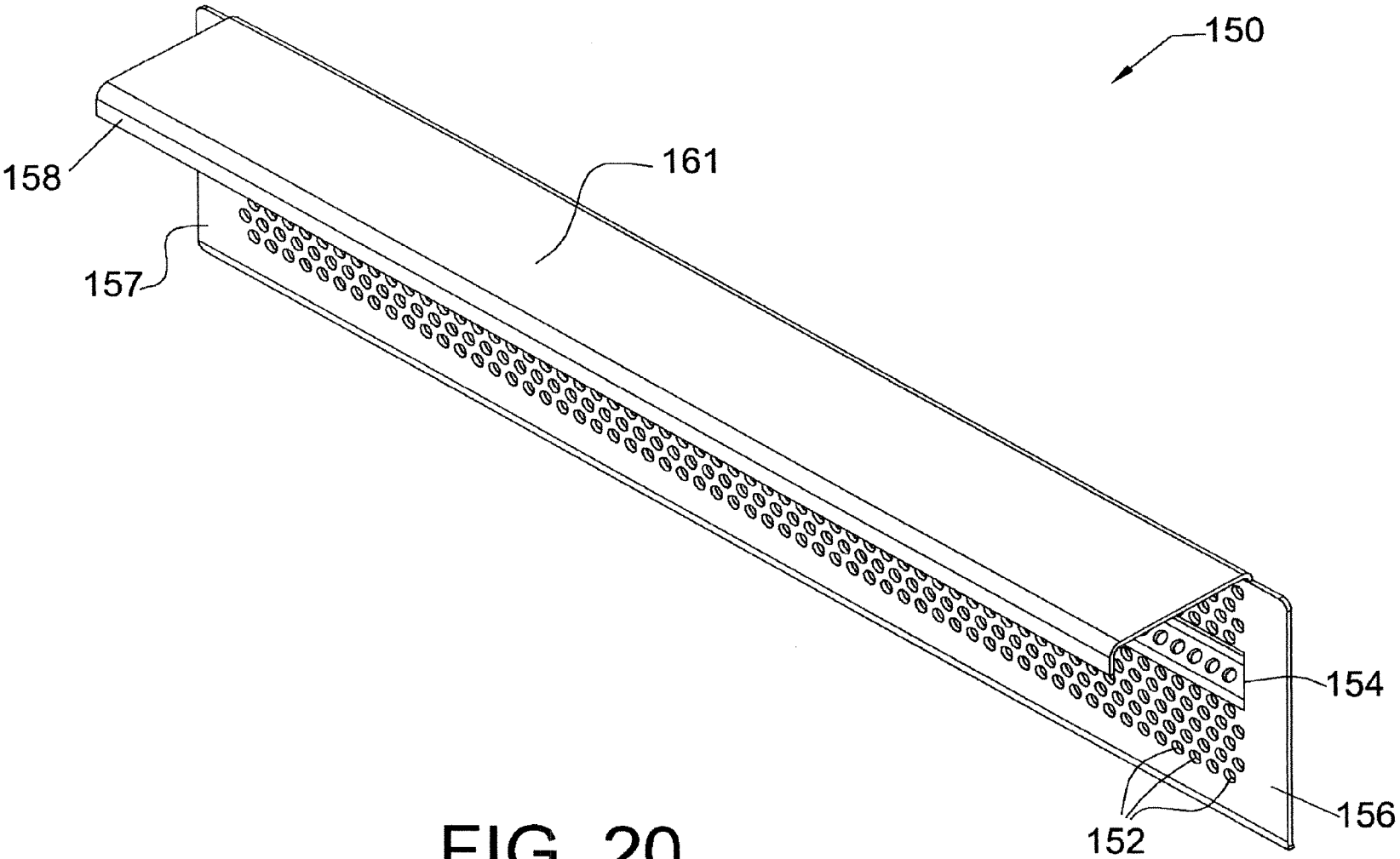
FIG. 20 is an inner perspective view of the intake cover shown in FIG. 16.
Figure 21:
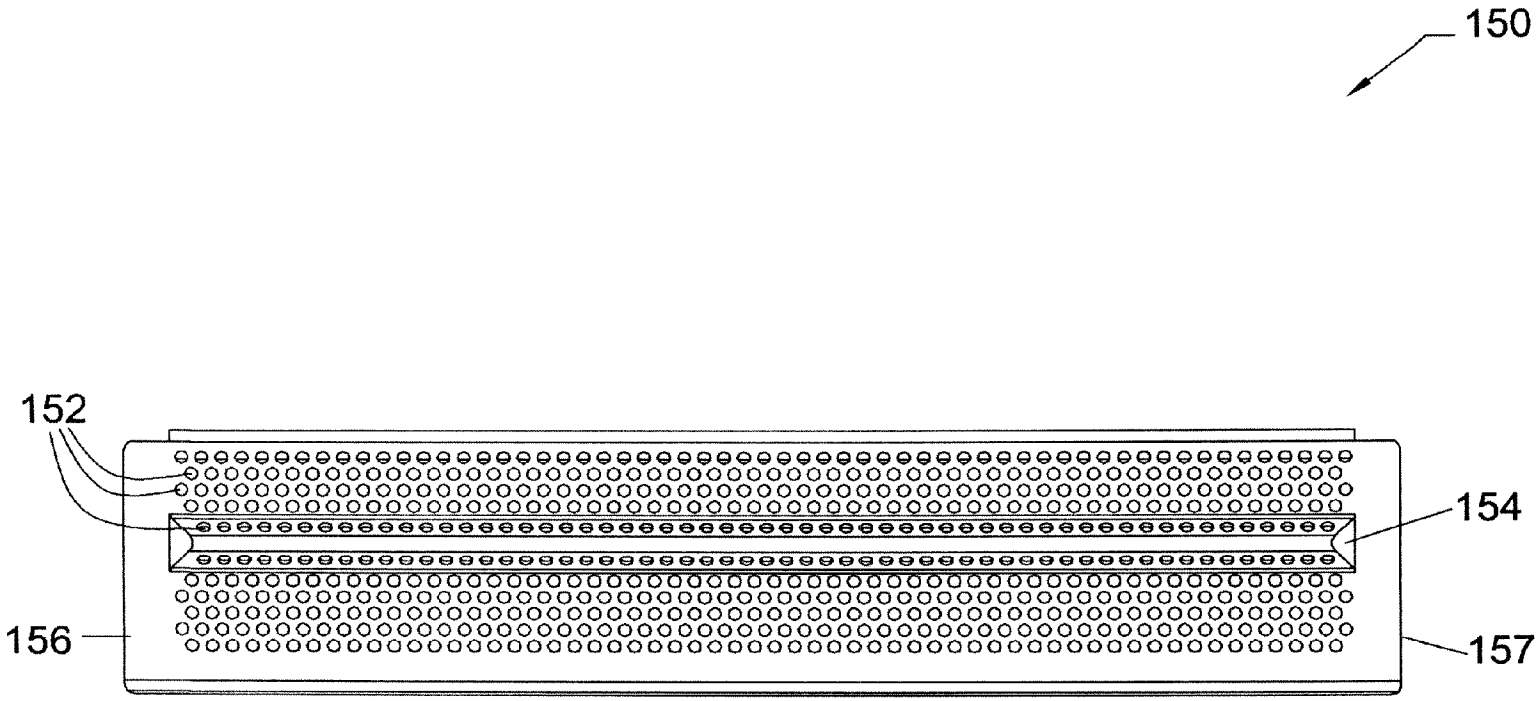
FIG. 21 is a front elevation view of the intake cover shown in FIG. 16.
Figure 43:
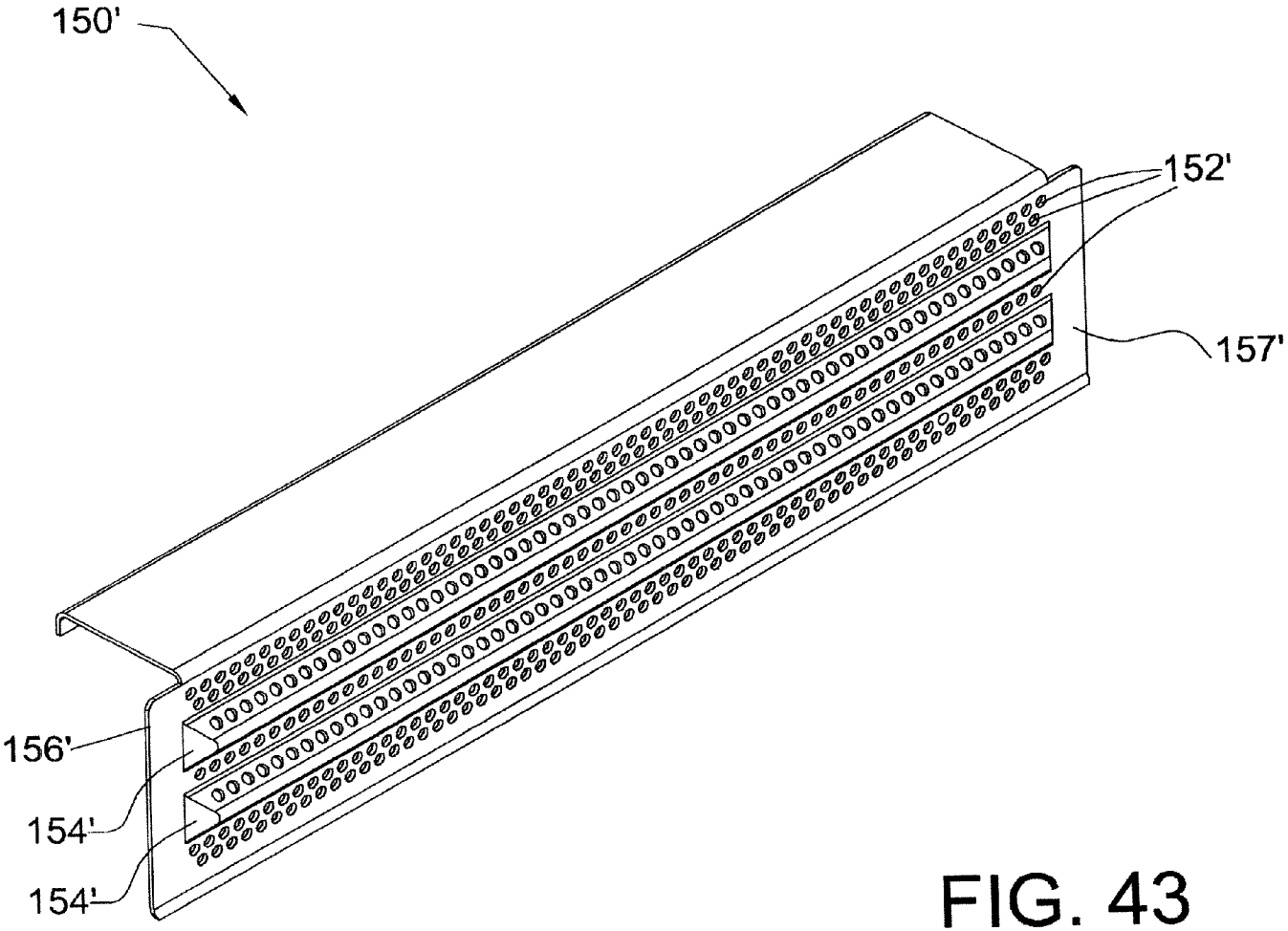
FIG. 43 is an outer perspective view of an intake cover that includes a plurality of projections extending into the tank according to one embodiment of the present disclosure.

In the illustrated embodiment, the projection 154 comprises a rib that extends longitudinally between the first and second sides 156 and 157 of the intake cover 150. As shown in FIG. 19, the projection 154 does not extend completely across the intake cover 150. But in other embodiments, the projection extends completely across the intake cover from its first side to its second side. Yet other embodiments include one or more projections that extend diagonally across the intake cover (e.g., between upper and lower corners of the intake cover). Additional embodiments include one or more vertically extending projections. In further embodiments, the intake cover includes a plurality of projections that extend into the tank. These projections can extend longitudinally, vertically, diagonally, in a crossing pattern, parallel with one another, and combinations thereof, etc. The particular number and arrangement of projections on the intake cover can vary depending, for example, on the particular application. By way of example only, FIG. 43 shows an alternative embodiment of an intake cover 150' having inlet holes 152' and two projections 154' longitudinally extending between the intake cover's first and second sides 156' and 157'.

Figure 22:
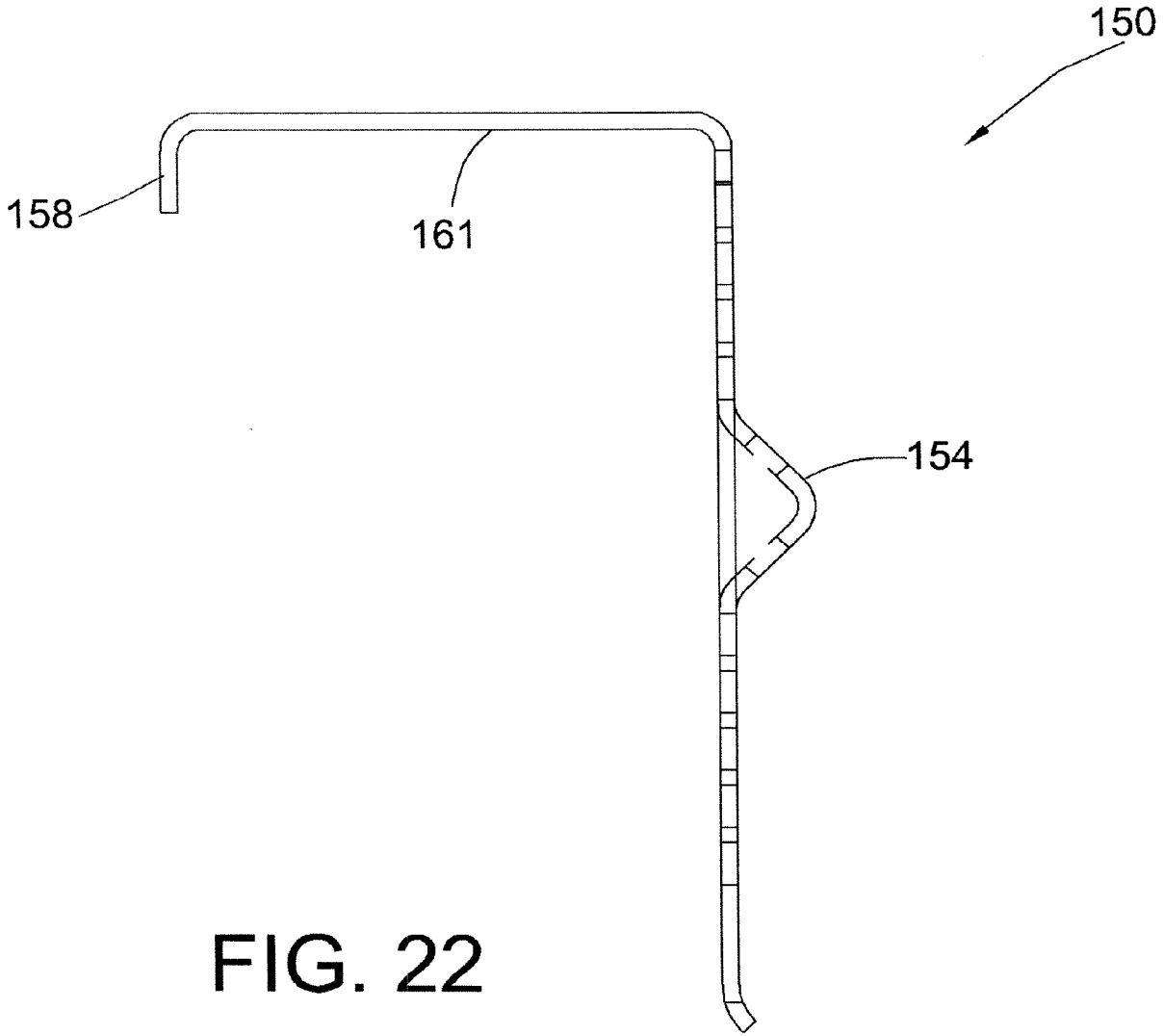
FIG. 22 is a side elevation view of the intake cover shown in FIG. 16.
Figure 23:
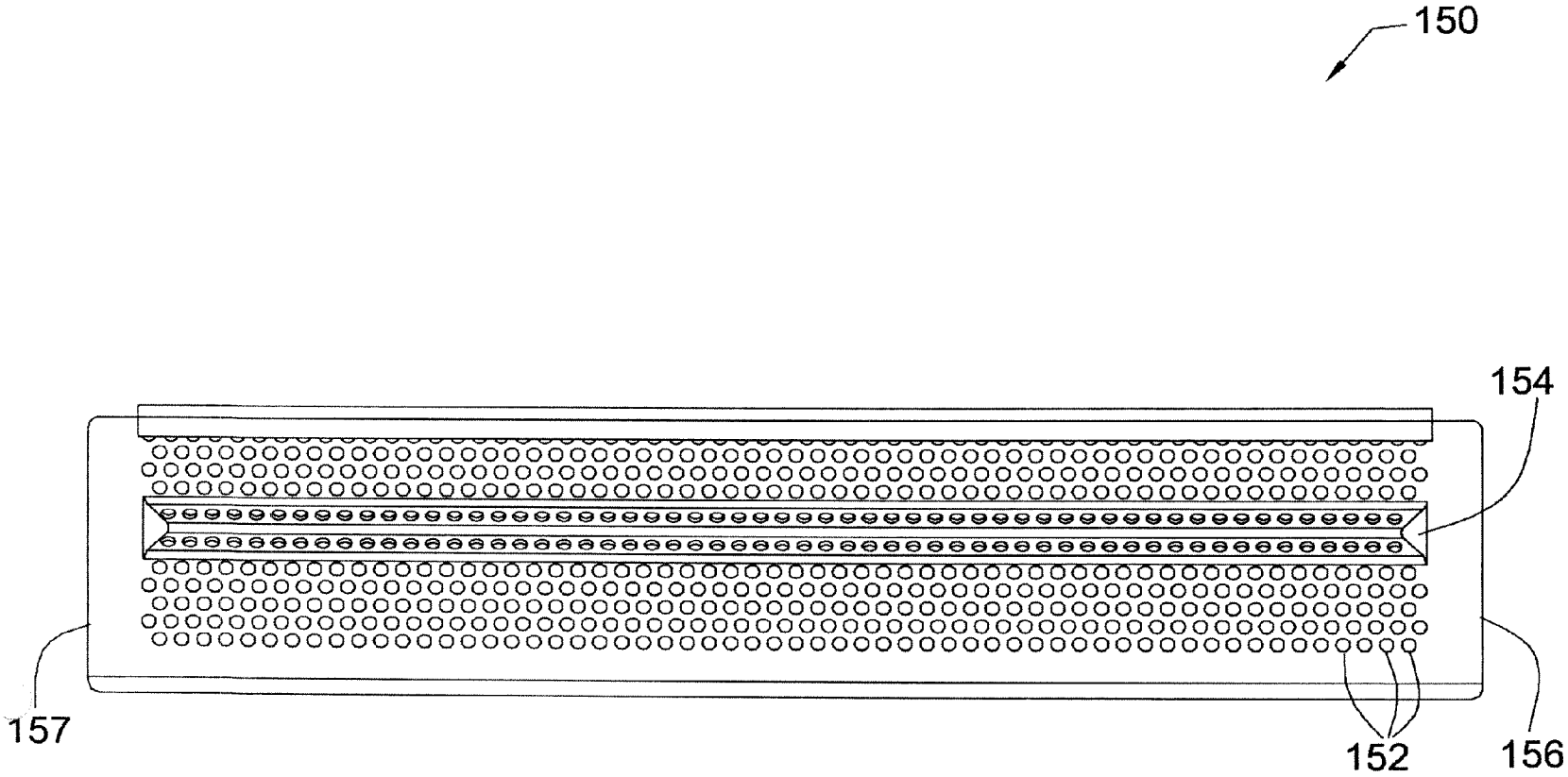
FIG. 23 is a rear elevation view of the intake cover shown in FIG. 16.

With further reference to FIG. 22, the projection 154 has a generally V-shaped longitudinal cross-section with a generally flat or rounded bottom portion. Stated differently, the projection 154 defines a generally V-shaped channel with inwardly sloping walls that connect to a generally flat or rounded bottom portion.

Alternative embodiments, however, include projections having other cross-sectional shapes and geometric configurations including hemispherical, and substantially solid cross-sections (e.g. trapezoidal, triangular, rectangular, etc.) that do not define a channel, among other suitable cross-sectional shapes and geometric configurations.

In various embodiments, the intake cover 150 is detachable from the tank 102. Advantageously, this allows the interior of the intake chamber 134 (and components therein) to be readily accessed, for example, for cleaning and sanitizing. In addition, having a detachable intake cover 150 also allows the intake cover 150 itself and its inlet holes 152 to be more easily serviced, for example, to replace the intake cover 150, clean out the inlet holes 152, and/or clean other portions of intake cover 150.

Figure 18:
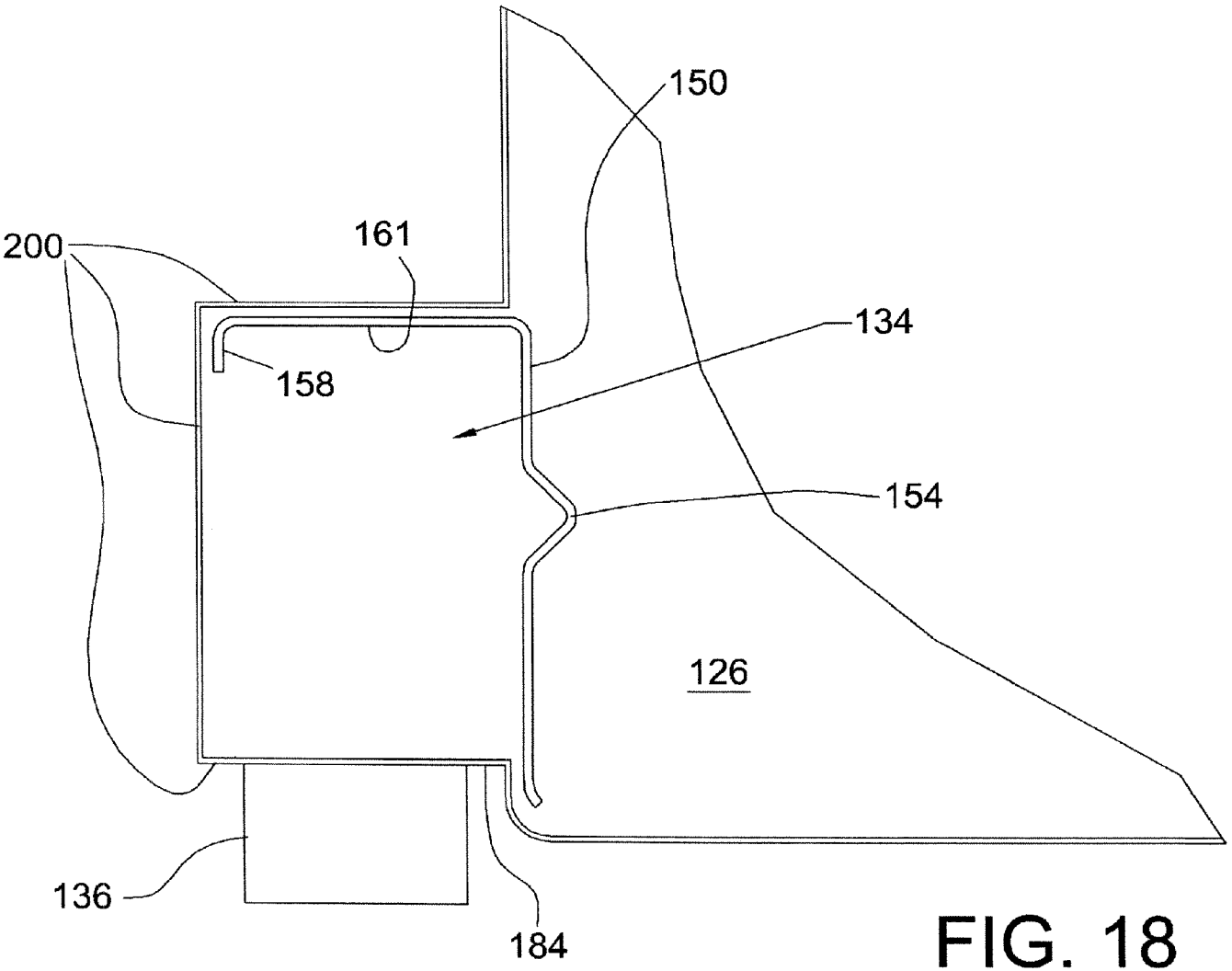
FIG. 18 is a partial side cross-sectional view of the intake cover shown in FIG. 16 after the intake cover has been positioned over the intake chamber.

As shown in FIG. 16, the intake cover 150 includes fastener holes 155, and an upper flange 161 having a downwardly depending lip 158. The intake cover 150 is installed by positioning the intake cover 150 over the intake opening 132 such that the lip 158 is positioned adjacent a back wall of the intake chamber 134, as shown in FIG. 18. Screws 159 (FIG. 16) are inserted into the fastener holes 155, through holes 171 of tabs 163, and retained to tabs 163 by nuts 165. Alternatively, the intake cover 150 can be attached to the tank 102 using other suitable means. For example, another embodiment includes an intake cover that is hingedly attached to the tank using hinge bars. In this embodiment, the intake cover can hingedly swing open into the tank to thereby provide access to the intake chamber and any components therein (e.g., heater, etc.).

The particular inlet hole pattern (e.g., the number, size, shape, and positions of the holes, etc.) can vary depending, for example, on the desired velocity or fluid flow rate through the inlet holes. In the illustrated embodiment, the projection 154 includes a portion of the inlet holes 152. Alternatively, the projection 154 can instead include all or none of the inlet holes 152.

In addition, the inlet holes 152 can be patterned (e.g. shaped, sized, positioned, etc.) to substantially distribute the flow of intake fluid across the intake cover 150. In one embodiment, the inlet holes 152 are patterned to substantially evenly distribute the intake fluid pressure across a lateral length of the intake cover 150. In this particular embodiment, the inlet holes 152 are patterned such that more of the intake cover's material mass is relatively distributed in front of the locations (e.g., 167 and 169 in FIG. 14A) at which the fluid conduits 136 and 140 connect to the intake chamber 134. The inlet holes 152, which are aligned with the locations at which the fluid conduits 136 and 140 connect to the intake chamber 134, can be smaller and/or be more spaced apart than the other inlet holes 152. Varying the inlet hole size and/or staggering inlet hole spacing can help equalize the fluid pressure and flow across the lateral length of the intake cover 150. This, in turn, can help equalize the static pressure and return velocity of the fluid within the intake chamber 134, thereby reducing turbulence of the fluid flow into the conduits 136 and 140.

In one particular embodiment, the intake cover 150 is formed from a sheet of stainless steel into which the inlet holes 152 are formed (e.g., laser cut, etc.). The sheet can be cut into a particular configuration (e.g., width, length, etc.), and then bent to form the projection 154, upper flange 161 and downwardly depending lip 158. Alternatively, a wide range of other suitable materials and manufacturing processes can be used to form the intake cover.

The washer assembly 100 includes outlets for directing fluid from the pumps 104 and 106 into the tank 102. As used herein, the terms "outlet" broadly includes any opening such as perforations, pipes, and discharge openings for directing fluid into the tank.

In the illustrated embodiment of FIGS. 24 through 30, the outlets are discharge openings 108 that are formed in the detachable outlet covers 160 and 162. The term "discharge openings", as used herein, refers to mere holes in the outlet covers 160 and 162, or equivalent openings, which do not include separate parts such as pipes, nozzles, or the like for directing the fluid flow.

Because it is desirable to have the fluid directed down into the tank 102 to avoid splashing fluid out of the tank, the walls 124 and 126 preferably include portions 170 and 172 (FIG. 4) that are angled downwardly. The outlet covers 160 and 162 (FIG. 11) are disposed on these downwardly angled wall portions 170 and 172 such that at least some of the discharge openings 108 are located on the angled wall portions, and, more preferably, all discharge openings 108 are located on the angled portions.

By providing the angled wall portions 170 and 172, the need to include separate pipes and nozzles to direct fluid down into the tank is eliminated and the size of the opening at the top of the tank 102 is increased. Eliminating the need for separate pipes and nozzles also allows for the elimination of problems associated with pipes and nozzles unnecessarily extending into the tank and getting in the way when then tank is full of dishware, personnel catching their hands on pipes and nozzles during the dishwashing process, and/or increased manufacturing costs associated with pipes and nozzles.

In other embodiments, however, a similar effect is accomplished by angling the entire tank walls, but this reduces the size of the opening at the top of the tank. Nevertheless, aspects of the present disclosure will work fine by angling the entire wall and/or locating the discharge openings on the wall itself. If the entire wall is angled it, of course, includes an angled portion.

Figure 10:
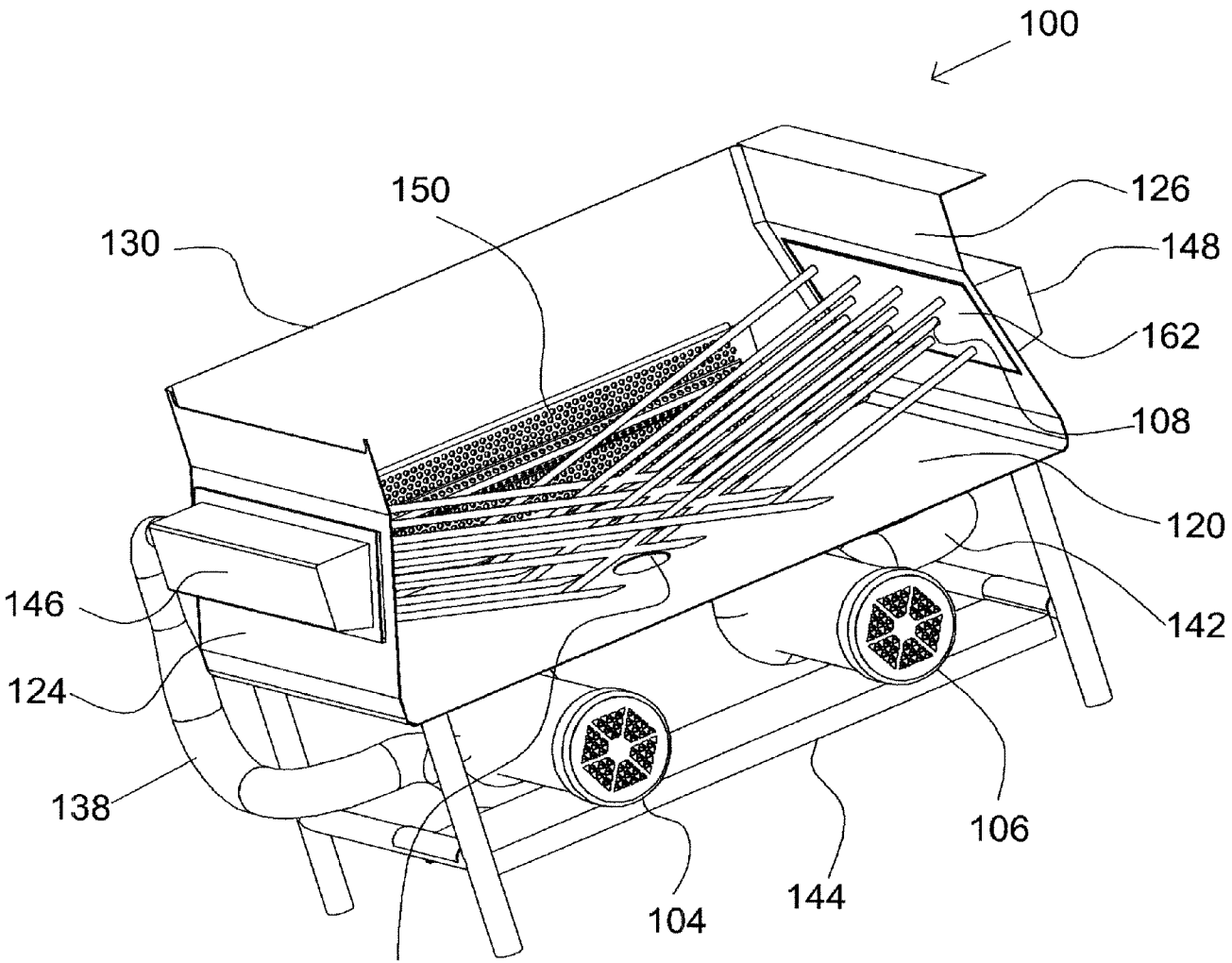
FIG. 10 is a perspective view of the kitchenware washing assembly shown in FIG. 1 with a portion broken away to reveal the crisscross fluid flow in the tank when fluid is circulated through the discharge openings.
Figure 11:
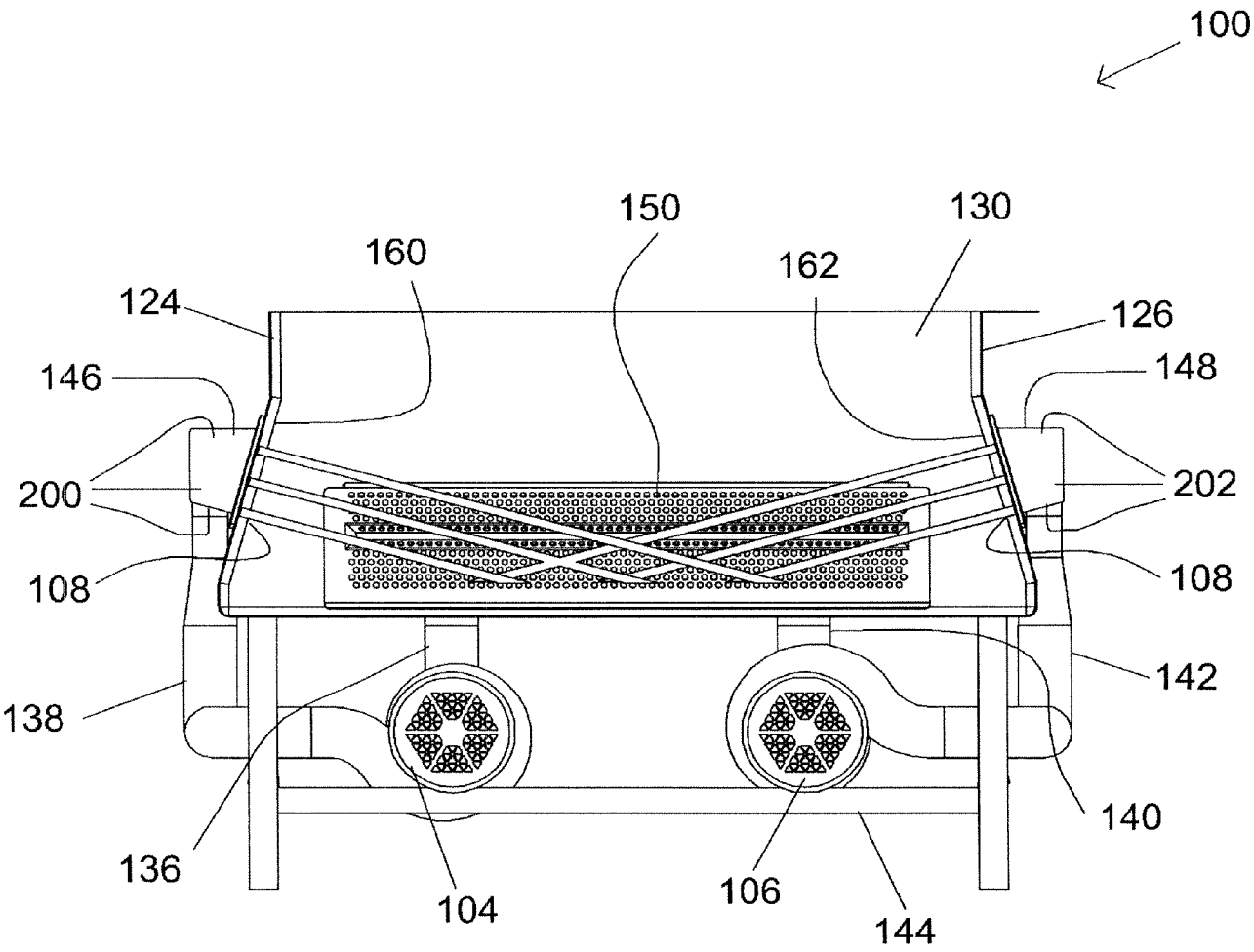
FIG. 11 is a cross-sectional view of the kitchenware washing assembly of FIG. 10 showing the crisscross pattern of fluid flow from the discharge openings.

In the illustrated embodiment, the outlet covers 160 and 162 are positioned on opposing walls 124 and 126. In embodiments having a circular or ovular shaped tank, the outlet covers 160 and 162 can be positioned on opposed portions of the curved wall. Alternative embodiments, however, include washer assemblies having outlets or discharge openings on only one wall or on more than two walls. But placing the outlets on opposed walls is generally preferred. With the opposed configuration, turbulence in the tank is increased to facilitate cleaning kitchenware. As shown in FIGS. 10 and 11, the opposed discharge openings 108 discharge the fluid such that the fluid forms a crossing pattern. The crossing pattern causes increased turbulence in the tank 102 to enhance the cleaning ability of the washer assembly 100 while minimizing (or at least reducing) splashing of washing fluid from the tank 102.

The particular pattern (e.g., number of, size, shape, positions of the discharge openings, etc.) can vary depending, for example, on the desired velocity or fluid flow rate through the openings. For example, the illustrated embodiment includes circular discharge openings 108 having a diameter of about 7/16 inches. Alternatively, other sizes and shapes of openings can be used, for example, in order to increase or decrease the velocity or fluid flow rate through the openings.

Figure 28:
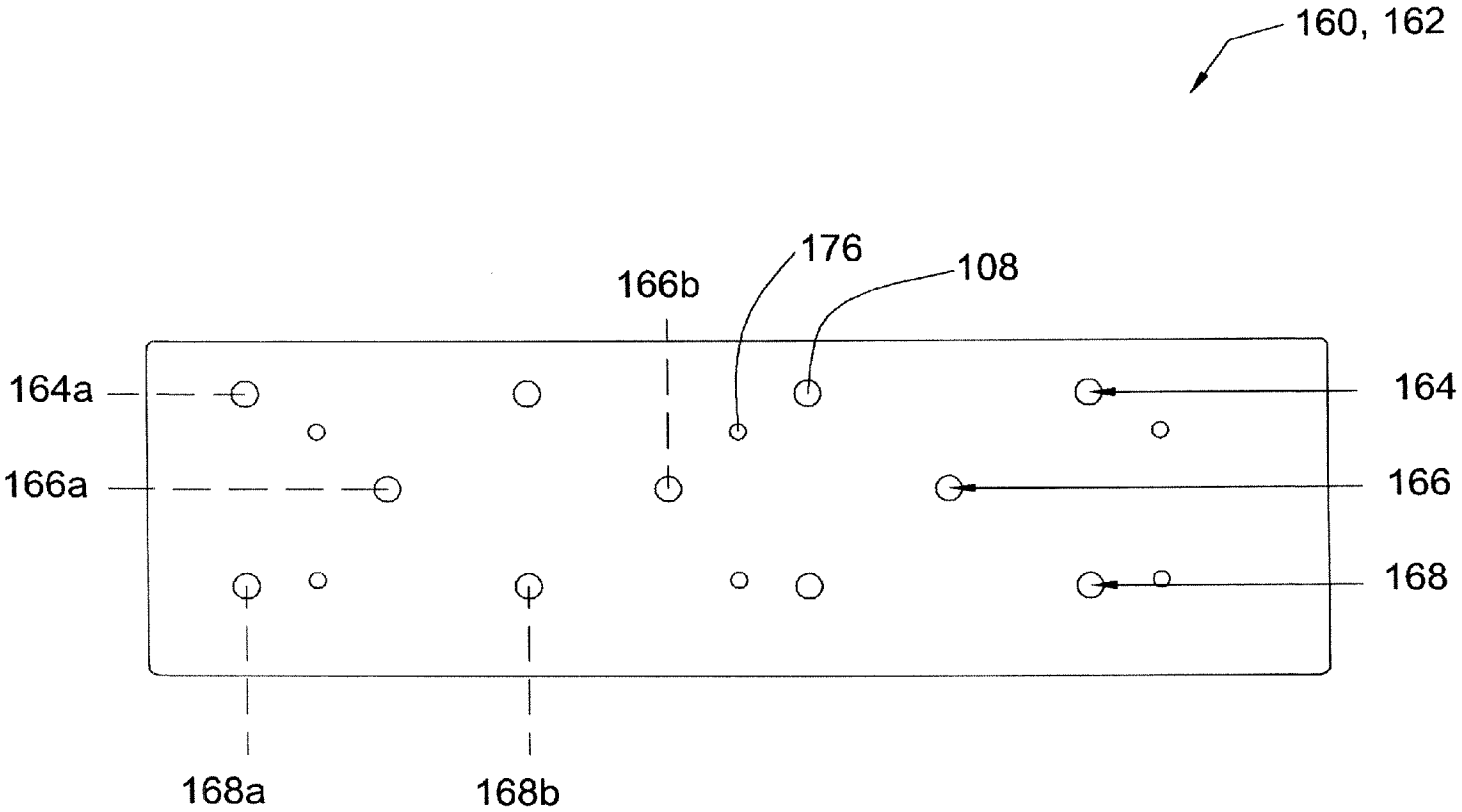
FIG. 28 is a front elevation view of the outlet cover shown in FIG. 24.
Figure 29:
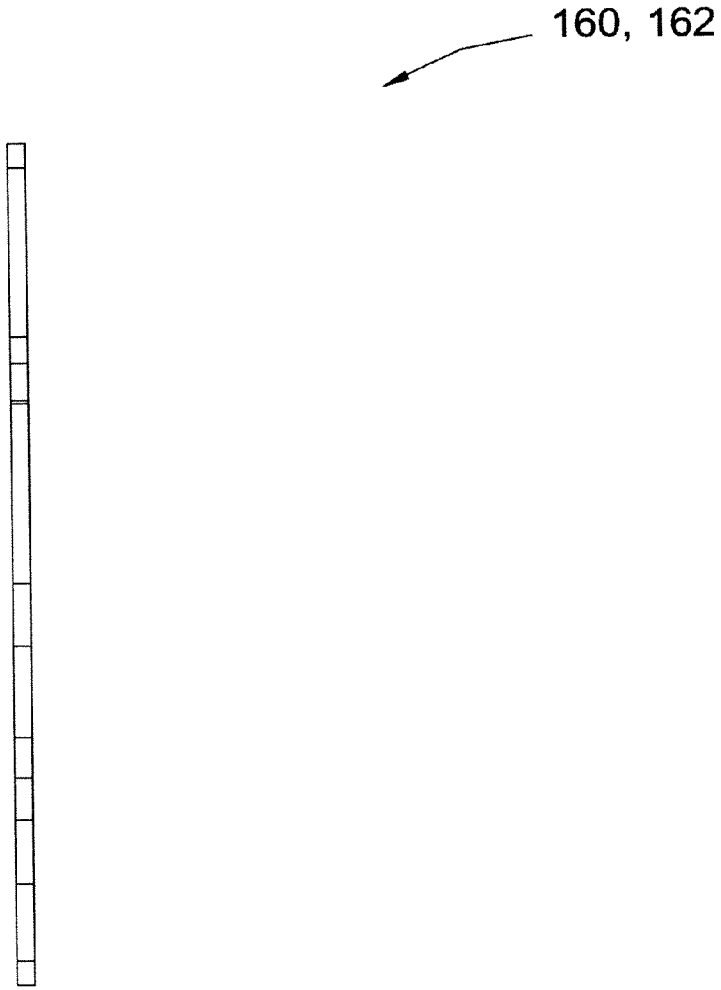
FIG. 29 is a side elevation view of the outlet cover shown in FIG. 24.
Figure 30:
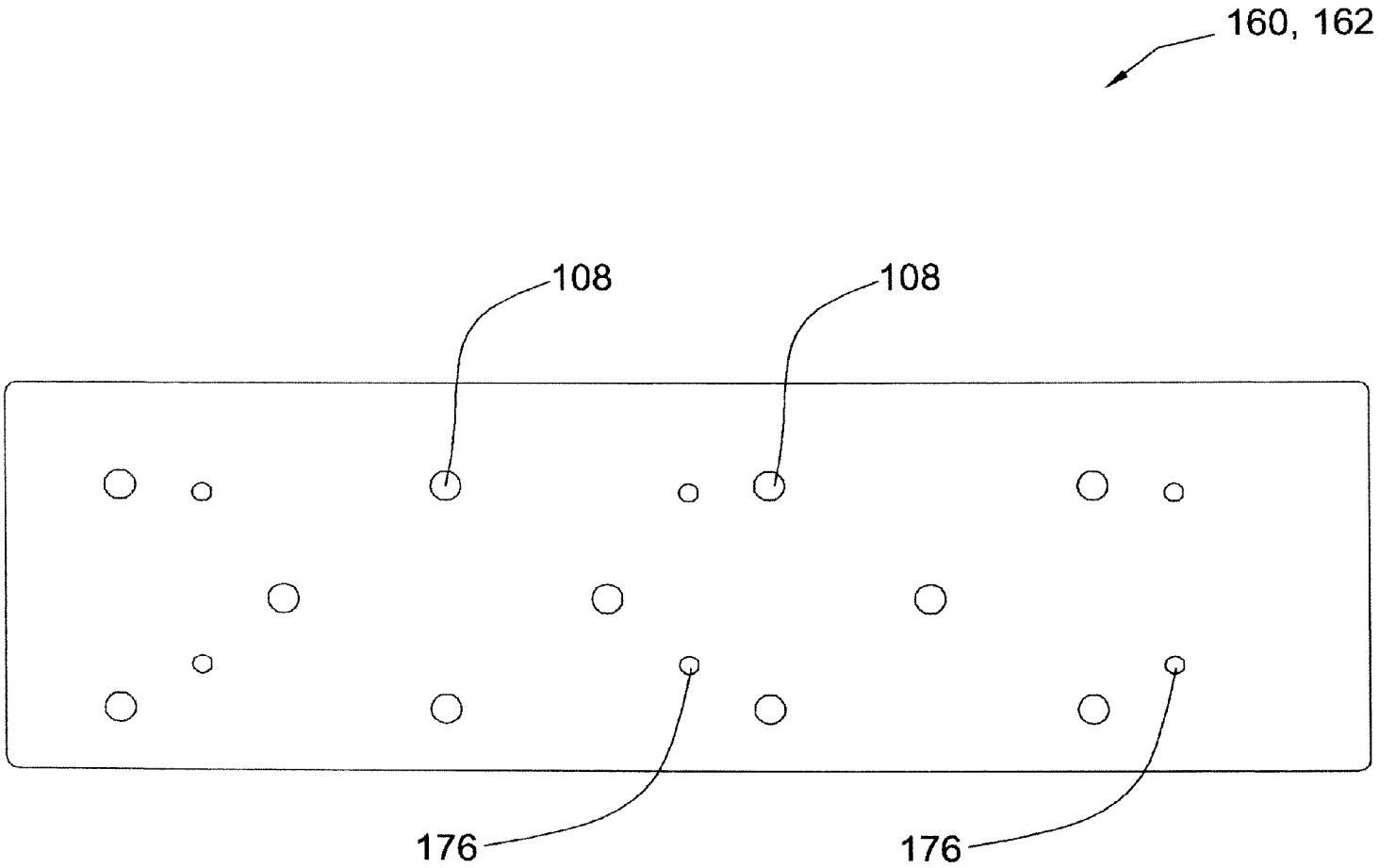
FIG. 30 is a rear elevation view of the outlet cover shown in FIG. 24.
Figure 31:
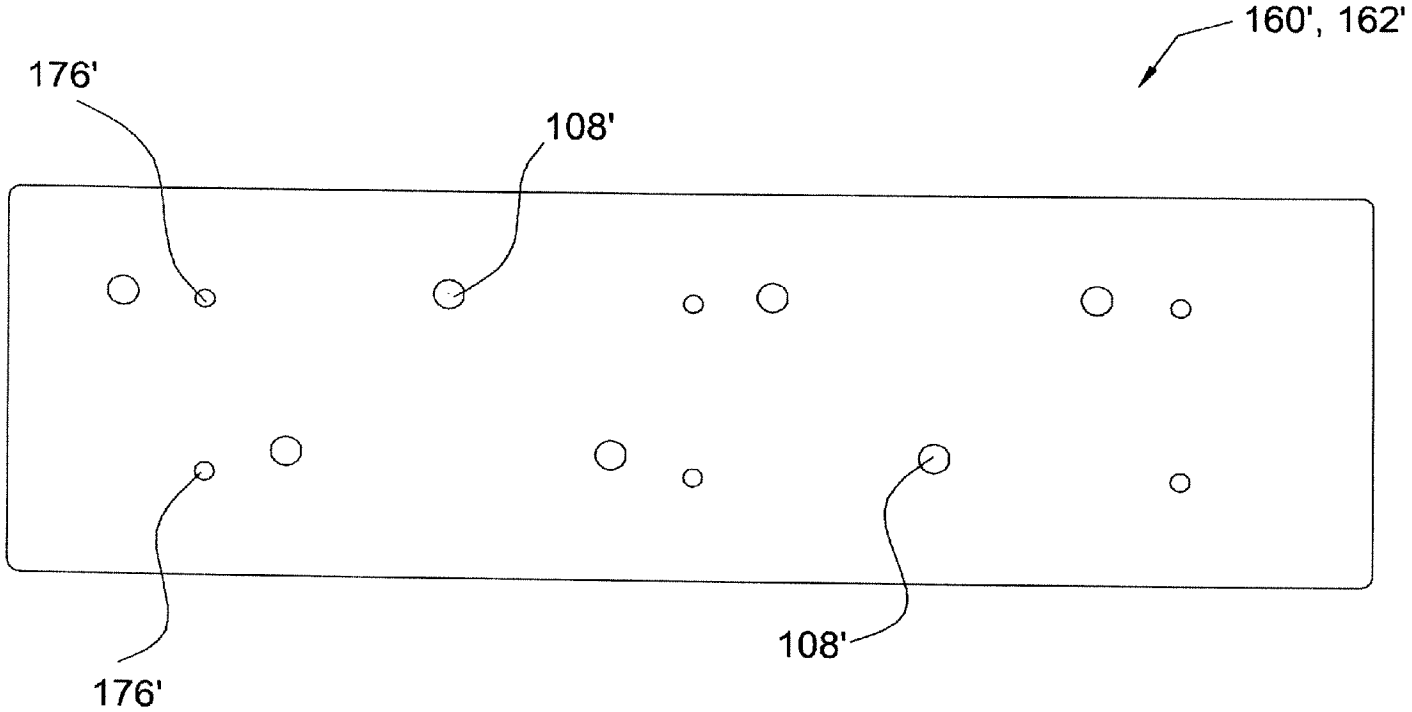
FIG. 31 is a front elevation view of another embodiment of an outlet cover with a different outlet pattern than the outlet cover shown in FIG. 24.
Figure 32:
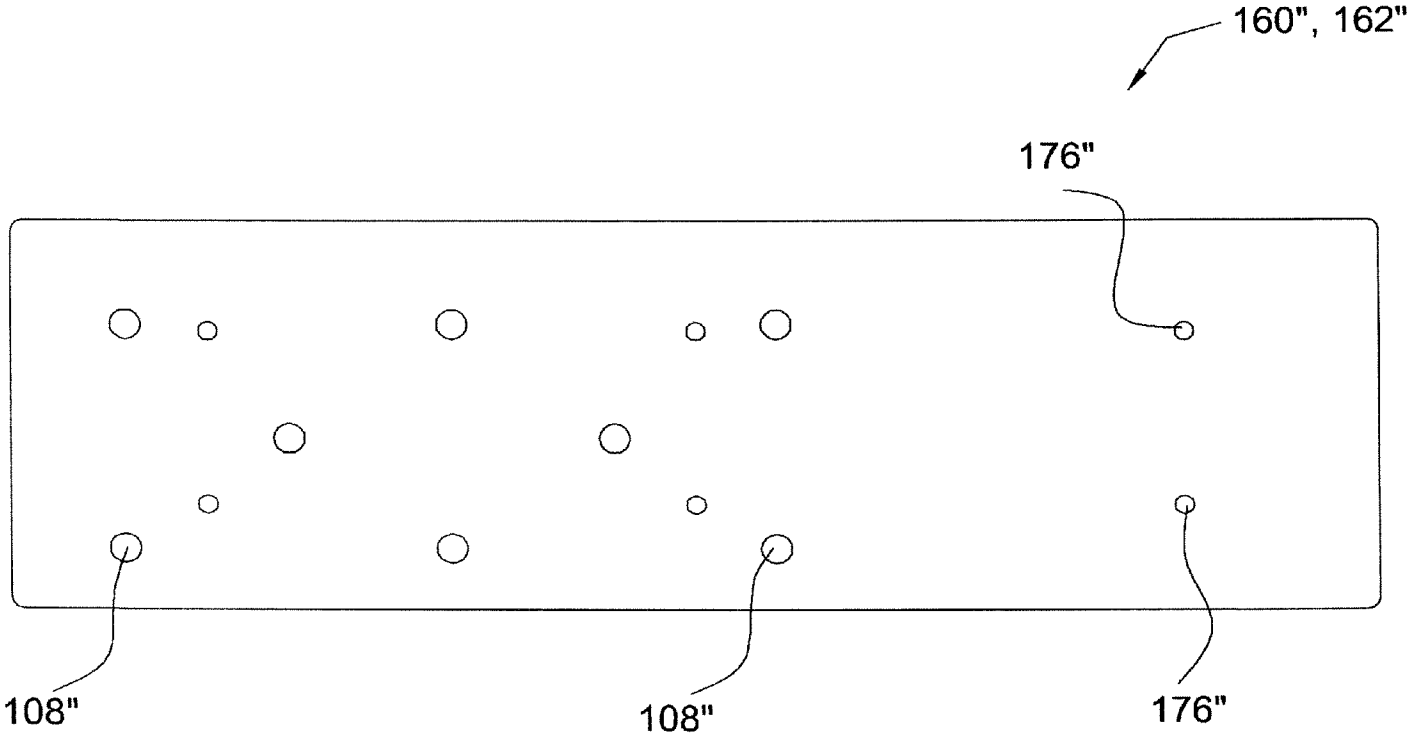
FIG. 32 is a front elevation view of another embodiment of an outlet cover with a different outlet pattern than the outlet covers shown in FIGS. 24 and 31.

In addition, the discharge openings 108 of each outlet cover 160 and 162 can be arranged in any number of rows and columns. FIG. 28 illustrates an exemplary arrangement in which the discharge openings 108 are arranged in three rows 164, 166, 168. In one embodiment, the distance between horizontal centers of the discharge openings 108 is preferably about 5.27 inches (as shown in FIG. 28 between points 168*a* and 168*b*). The vertical distance between centers of the openings 108 in each row is preferably about 1.94 inches (as shown in FIG. 28 between points 164*a* and 166*a*). The horizontal distance between hole centers for adjacent rows is preferably half the distance between horizontal centers in a given row and is about 2.635 inches (as shown in FIG. 28 between points 166*b* and 168*b*). The distances, number, and arrangement of discharge openings 108 shown and described are exemplary only, as the distances, number, and arrangement of such openings can be altered. For example, FIGS. 31 through 32 respectively illustrate outlet covers 160', 162' 160", 162', having outlets 108', 108" and fastener holes 176', 176". The outlets 108', 108" form a pattern that is different than the outlet pattern of the outlet covers 160, 162 shown in FIG. 28.

Figure 4:
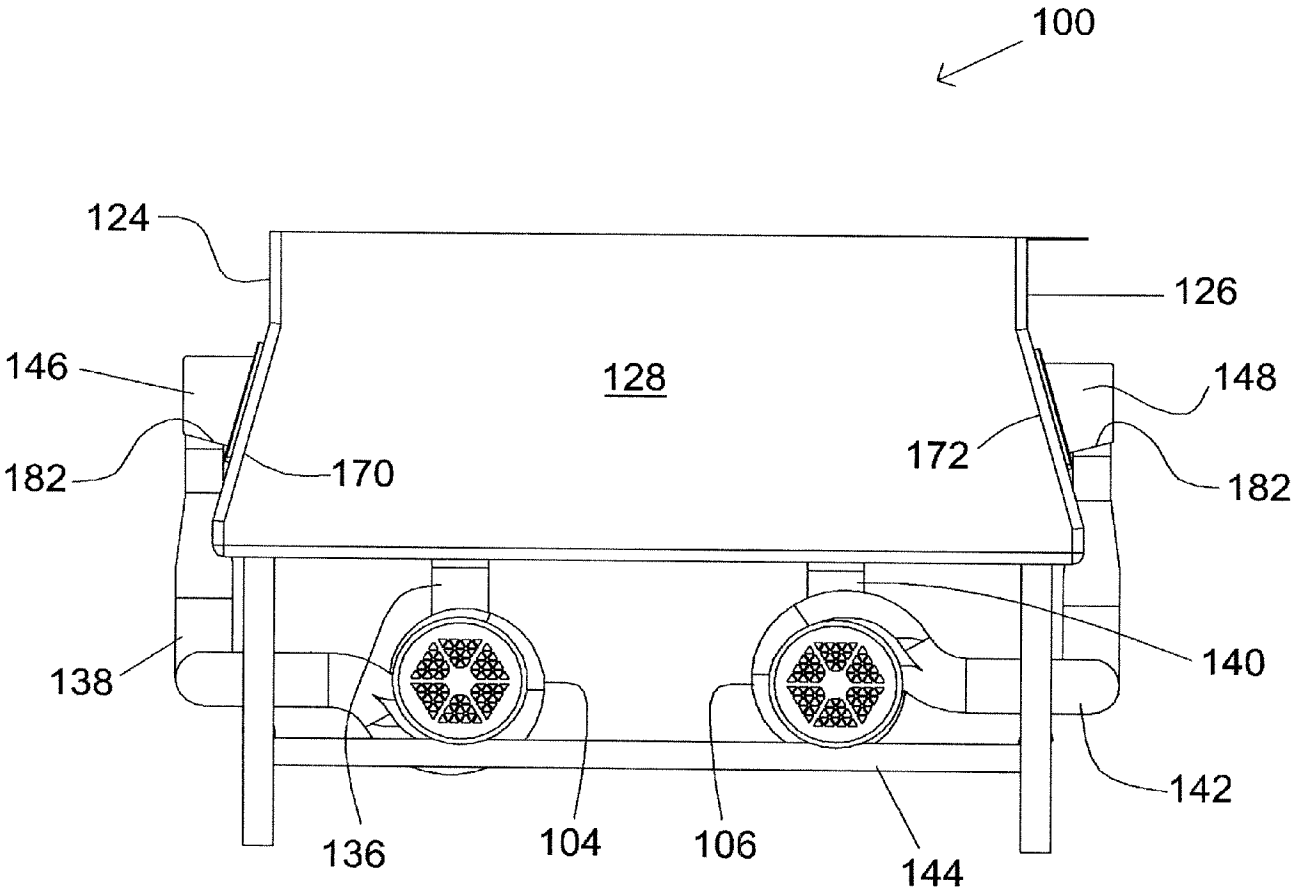
FIG. 4 is a front elevation view of the kitchenware washing assembly shown in FIG. 1.
Figure 5:
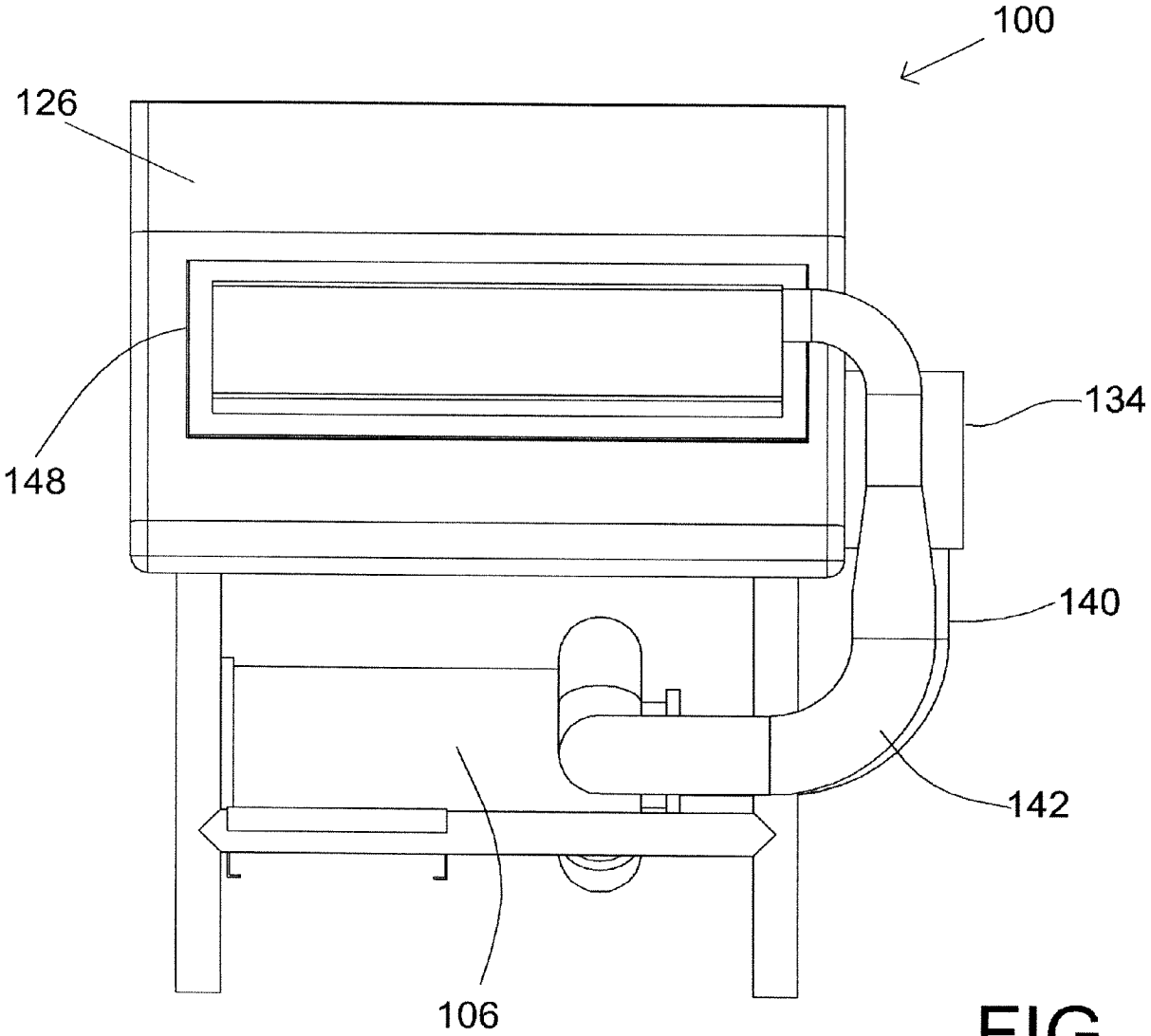
FIG. 5 is a right side elevation view of the kitchenware washing assembly shown in FIG. 1.
Figure 6:
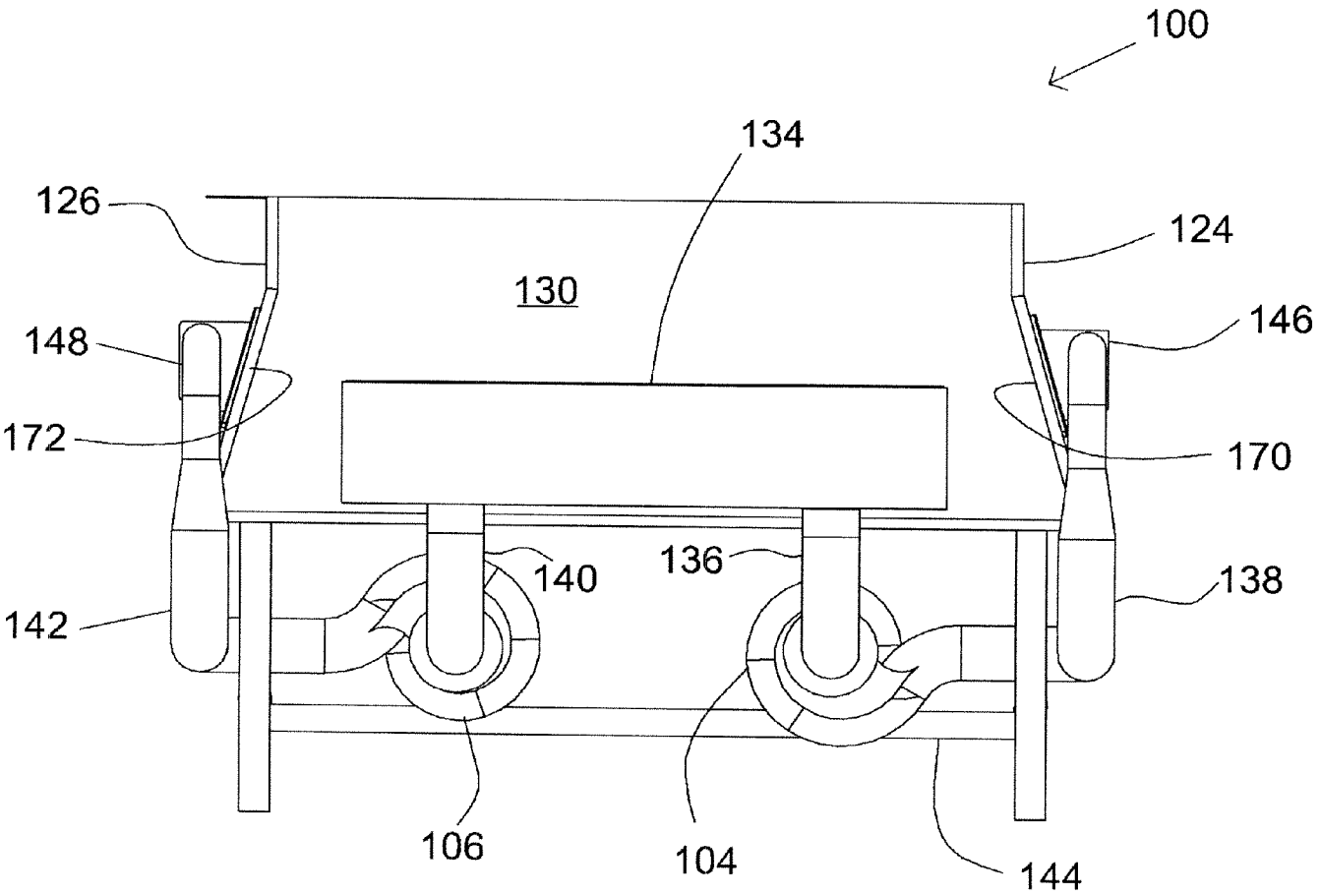
FIG. 6 is a rear elevation view of the kitchenware washing assembly shown in FIG. 1.
Figure 7:
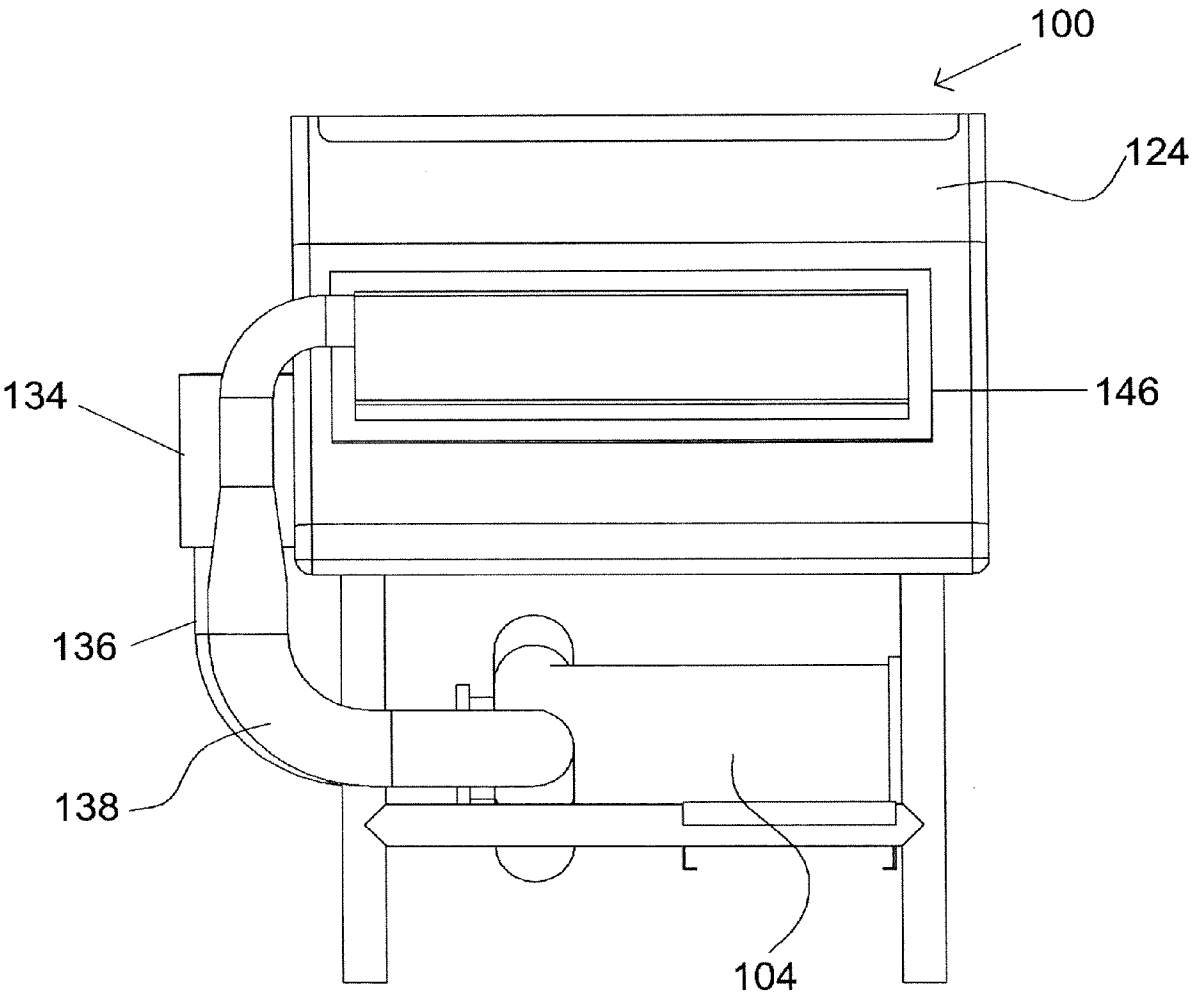
FIG. 7 is a left side elevation view of the kitchenware washing assembly shown in FIG. 1.
Figure 8:
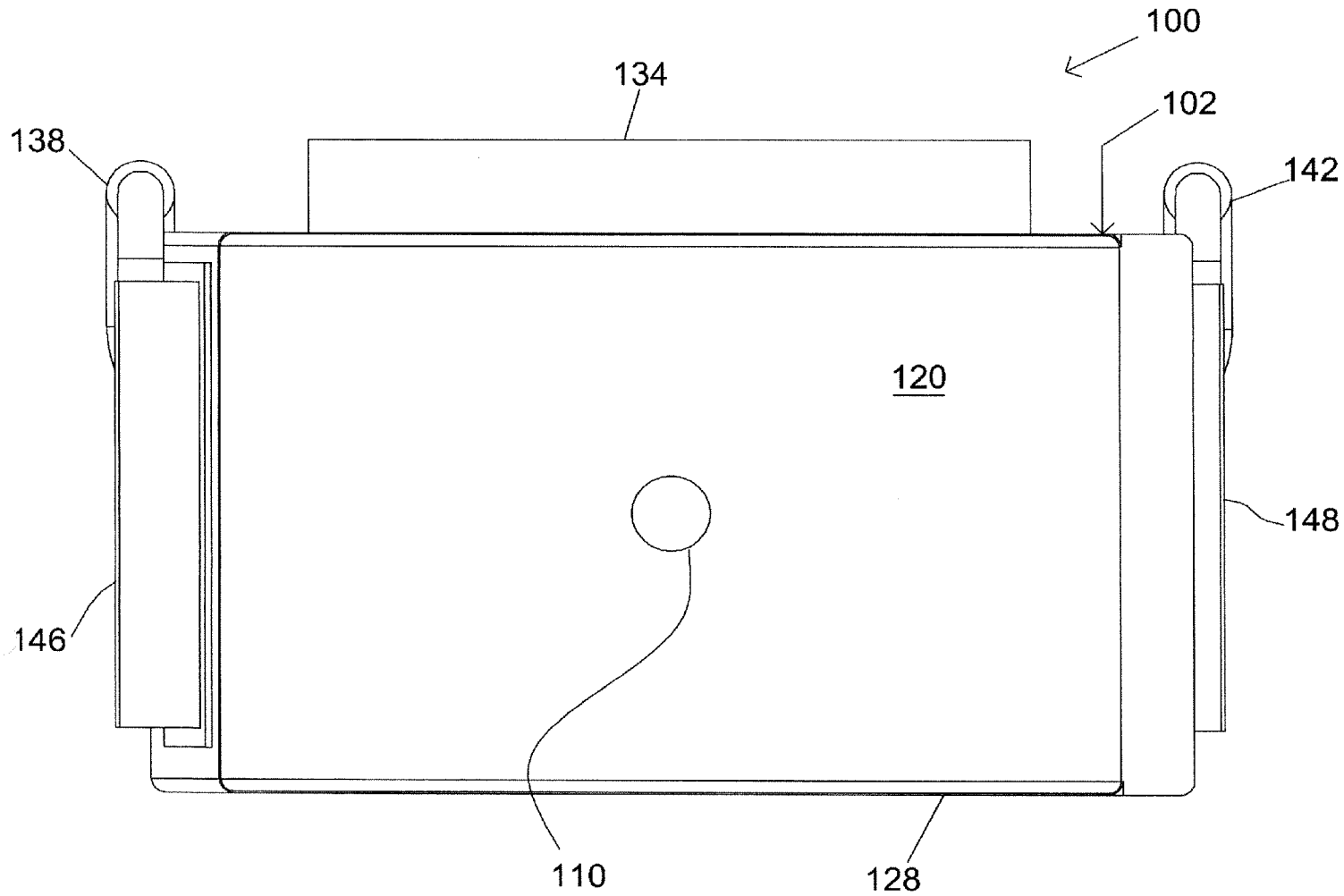
FIG. 8 is a top plan view of the kitchenware washing assembly shown in FIG. 1.

As shown in FIG. 4, sidewalls 124 and 126 include angled portions 170 and 172, respectively, upon which the outlets or discharge openings 108 (FIG. 25) are located. In one embodiment, the angled wall portions 170 and 172 are angled between about sixty degrees and eighty degrees from horizontal. In another embodiment, the angled portions 170 and 172 are angled about seventy-five degrees from the horizontal. In the illustrated embodiment, the outlet covers 160 and 162 include discharge openings 108 which are located on the angled portions 170 and 172 such that fluid directed through the discharge openings 108 forms a crossing pattern as shown in FIGS. 10 and 11. To enhance fluid rotation in the tank 102, various embodiments offset the opposing patterns on the opposed walls 124 and 126 so that the discharge openings 108 are not on directly opposed paths. In one particular embodiment, this is accomplished by shifting the discharge openings pattern on one of the outlet covers slightly to the left, and/or shifting the discharge openings pattern on the other outlet cover slightly to the right.

In one exemplary embodiment, the rearward-most discharge openings 108 of the outlet cover 160 are preferably about 7.3 inches from the back edge of wall 124, and the forward-most discharge openings 108 of outlet cover 160 are about 4.6 inches from the front edge of wall 124. This adjustment is reversed for the outlet cover 162 in order to create a forward/rearward offset between opposed discharge openings. The rearward-most discharge openings 108 of the outlet cover 162 are preferably about 4.6 inches from the back edge of wall 126, and the forward-most discharge openings 108 of outlet cover 162 are about 7.3 inches from the front edge of wall 126. The arrangement shown creates desirable fluid rotation within the tank 102. Aspects of the present disclosure will, however, work well if the discharge openings on opposed walls are in direct opposed relationship. Turbulence in the tanks is still significant, even though fluid rotation is less.

Figure 24:
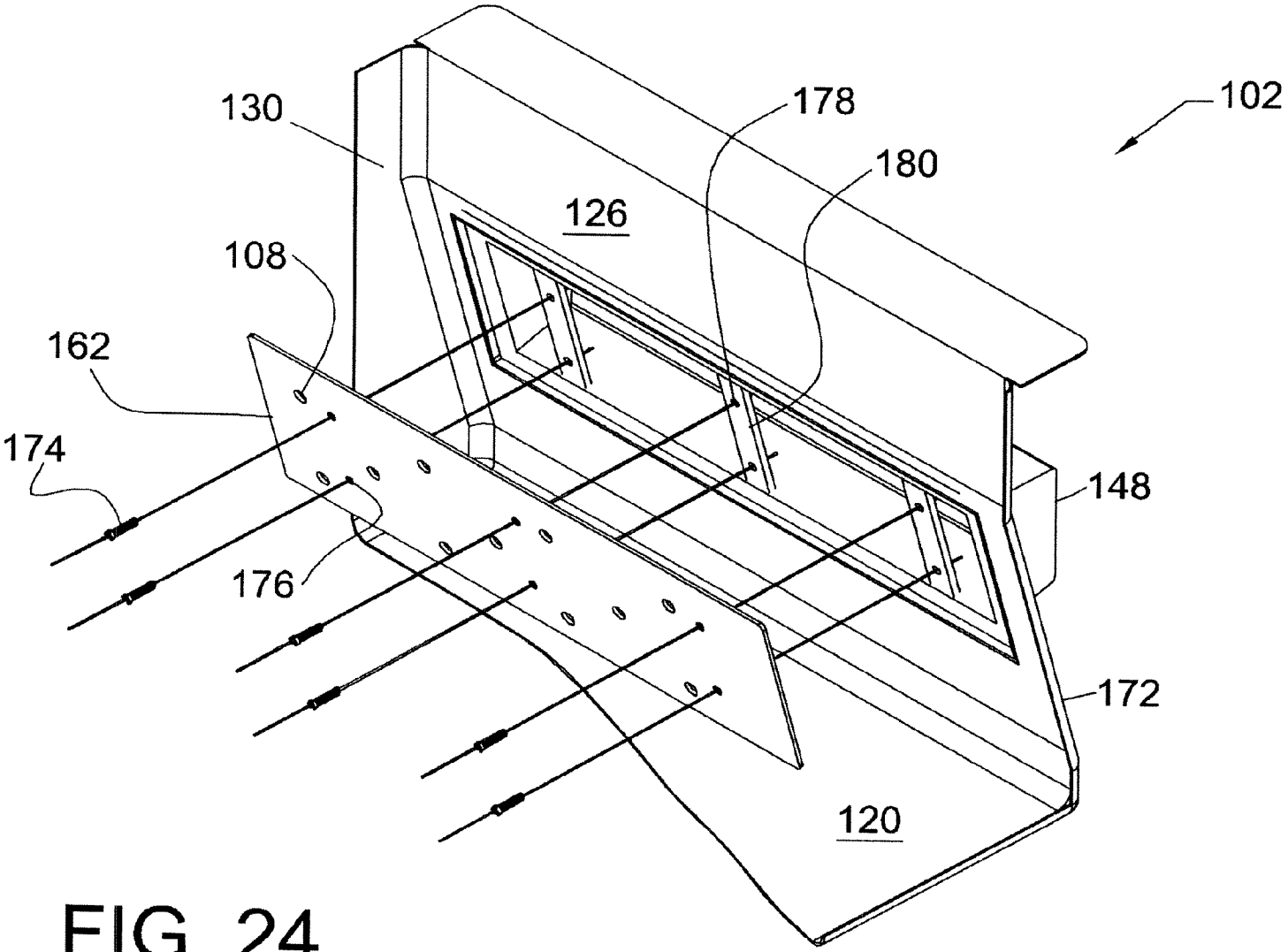
FIG. 24 is a partial exploded perspective view of a kitchenware washing assembly with a portion of the tank broken away and illustrating an outlet cover that can be removably attached to the tank to cover an outlet chamber according to one embodiment of the present disclosure.

As shown in FIG. 24, the outlet covers 160 and 162 can be detached from the tank 102. Advantageously, this feature allows the interior of the outlet chambers 146 and 148 to be readily accessed, for example, for cleaning. Having detachable outlet covers also allows the outlet covers themselves to be more easily serviced, for example, to replace the outlet covers, clean out the outlets or discharge openings, and/or clean the outlet covers.

A wide range of systems and methods can be used to detachably connect the outlet covers 160 and 162 to the tank 102. In the illustrated embodiment, screws 174 are inserted through fastener holes 176 defined by the covers 160 and 162, and through fastener holes 178 defined by vertically extending supports members 180. The support members 180 are coupled to the tank 102, for example, by welding or other suitable attachment means. The particular type of fastening method, number of fasteners, and arrangement of the fastener holes can vary depending, for example, on the pressure at which the fluid will be discharged from the discharge openings 108 into the tank 102.

In various embodiments, each outlet cover 160 and 162 can have its perimeter sealed in a substantially fluid-tight manner. In addition, the fastener holes 178 can also be sealed in a substantially fluid-tight member. This sealing can help ensure that fluid is discharged into the tank 102 through the discharge openings 108 and that the fluid doesn't circumvent the discharge openings 108 by escaping through the fastener holes 178 and/or the interface between the outlet covers 160, 162 and the tank walls 124 and 126. By way of example, the interfaces between the tank walls 124, 126 and the respective outlet covers 160, 162 can be sealed by positioning a resilient sealing member generally around each outlet cover's perimeter between the outlet cover and the tank wall. And by way of further example, resilient O-rings can be used to seal the fastener holes 178. Alternatively, a wide range of other sealing members can be employed for sealing the outlet covers 160 and 162 and/or fastener holes 178.

In various embodiments, a plurality of detachable interchangeable outlet covers is provided. Each outlet cover (or each respective pair) can have outlets or discharge openings forming a different pattern (e.g., arranged differently, differently sized openings, differently shaped openings, etc.) from the other detachable covers. By selecting from amongst the interchangeable outlet covers, the operator can customize the kitchenware washing assembly with a particular pattern of outlets or discharge openings. For example, the operator may want to use a particular outlet pattern for heavy pots and pans, but use a different pattern for more delicate and fragile dishware. Or, for example, the operator may want to use a particular outlet pattern for one tank wall, but use a different pattern for another tank wall. Accordingly, the interchangeable outlet covers can even further increase the utility and efficiency of a kitchenware washing assembly.

In the illustrated embodiment, the outlet chambers 146, 148 and the intake chamber 134 are configured to provide drainage into the tank. With this positive drainage, fluid will drain out of the outlet chambers 146, 148 and intake chamber 134 such that little to no fluid will remain within these chambers 134, 146, 148. By eliminating (or at least reducing) the amount of standing fluid within the intake chamber 134 and outlet chambers 146, 148, the kitchenware washing assembly will be more sanitary.

Figure 33:
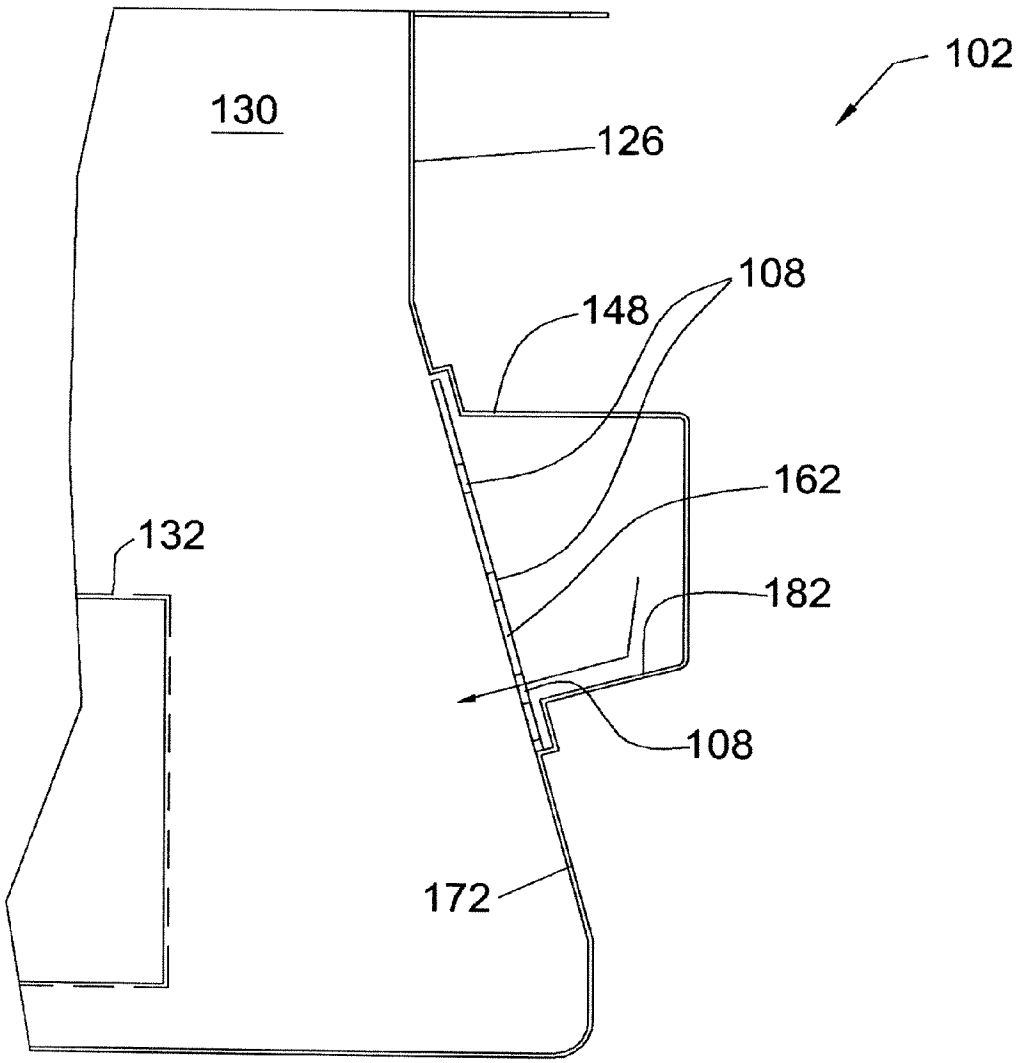
FIG. 33 is a partial cross-sectional side view of an outlet chamber of a kitchenware washing assembly having positive drainage according to one embodiment of the present disclosure.

As shown in FIGS. 4 and 33, the outlet chambers 146 and 148 include a bottom 182 that generally slopes downwardly towards the tank 102, thereby providing positive drainage into the tank 102. Positive draining into the tank 102 is further facilitated by the positioning of the outlet chambers 146 and 148 on the respective angled wall portions 170 and 172.

Figure 25:
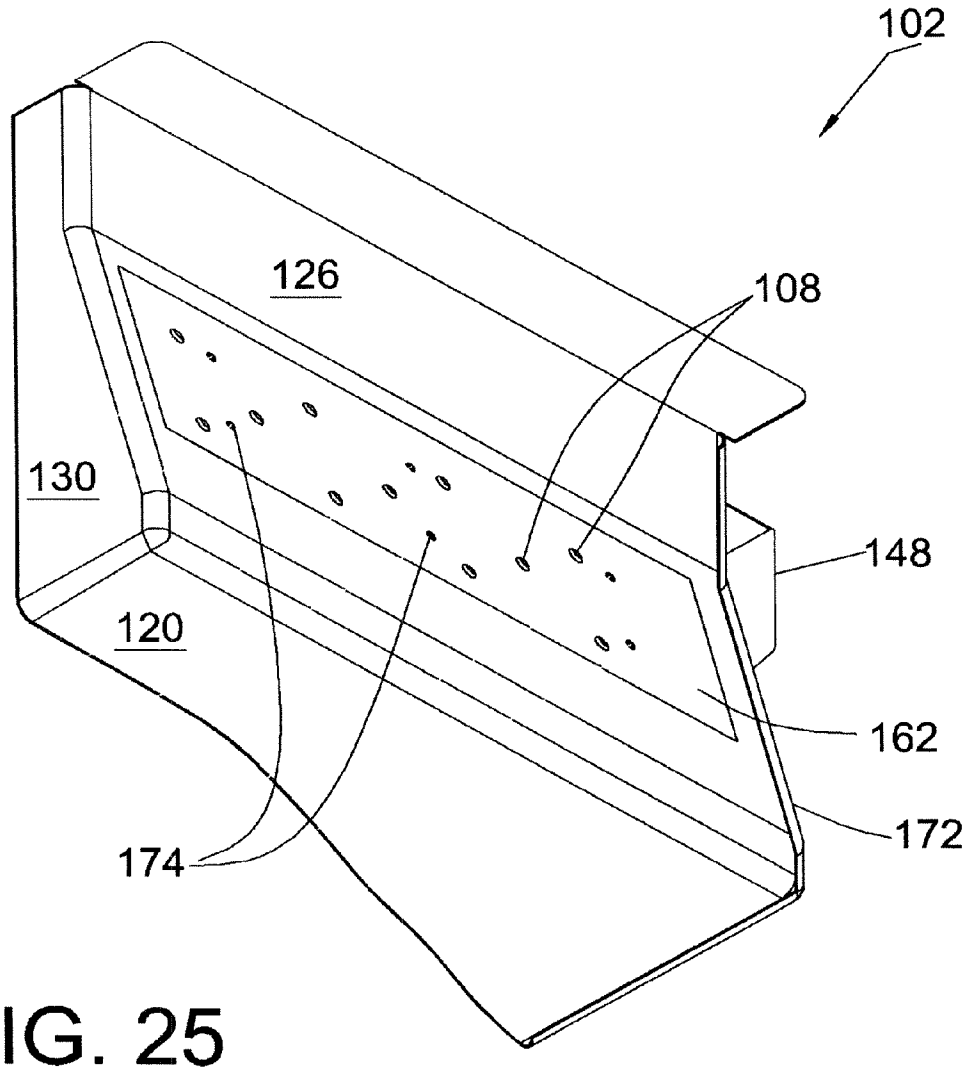
FIG. 25 is a partial perspective view of the tank and outlet cover shown in FIG. 24 after the outlet cover has been removably attached to the tank.
Figure 26:
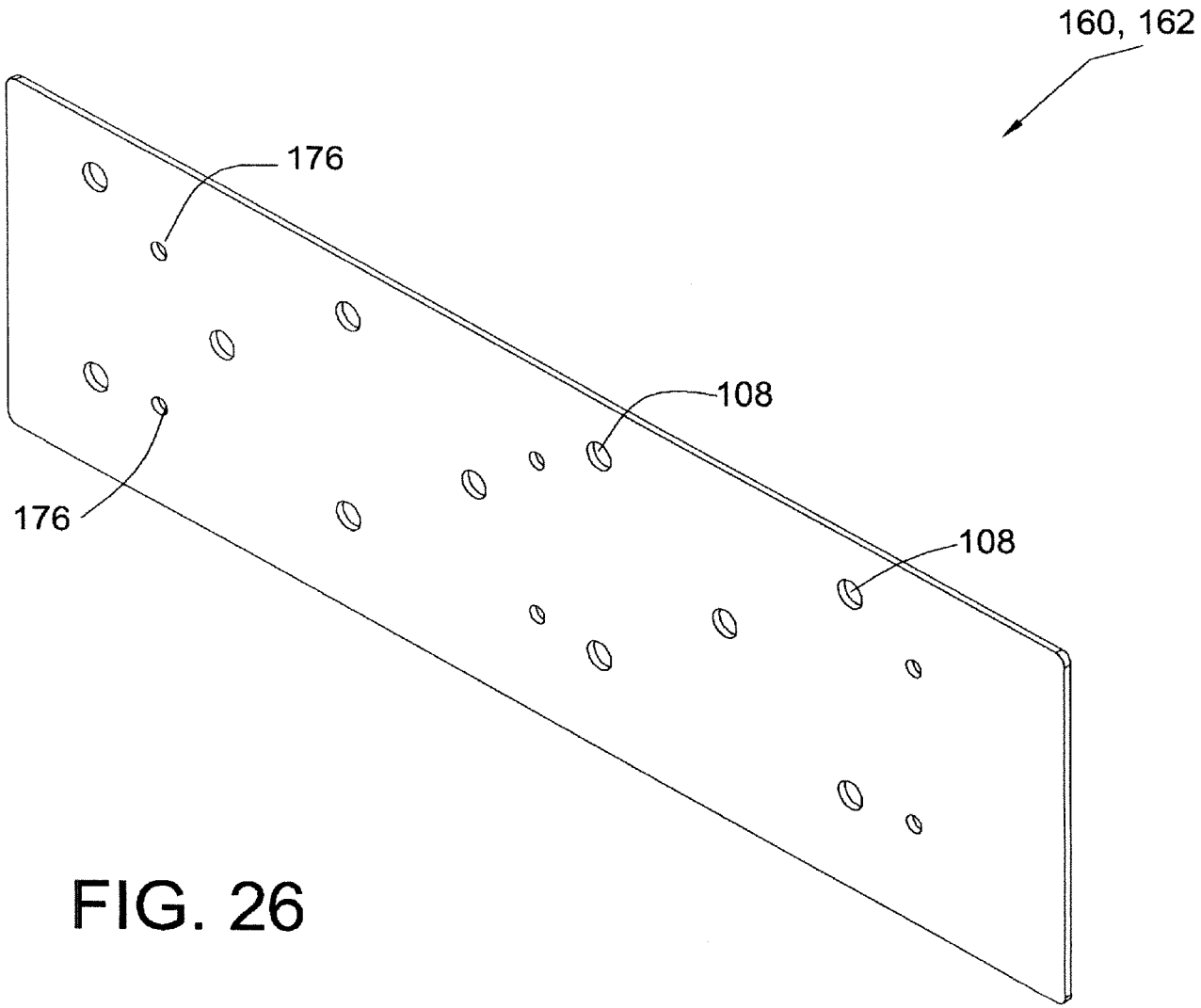
FIG. 26 is an outer perspective view of the outlet cover shown in FIG. 24.
Figure 27:
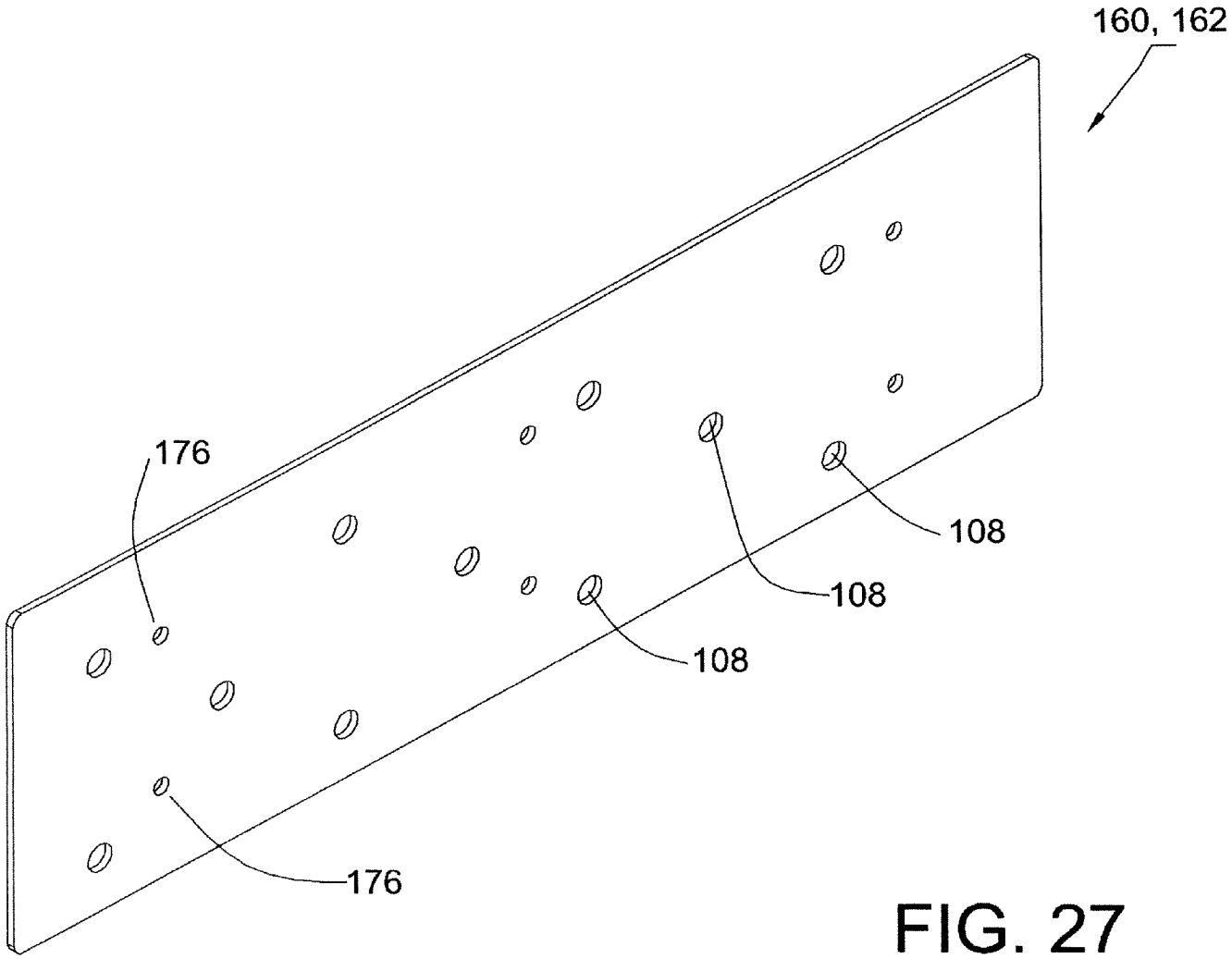
FIG. 27 is an inner perspective view of the outlet cover shown in FIG. 24.

The outlet covers 160 and 162 also include at least some discharge openings 108 adjacent the bottom 182 of the respective outlet chambers 146 and 148 when the outlet covers 160 and 162 are positioned to cover the outlet chambers 146 and 148, as shown in FIGS. 24 and 25. This also facilitates drainage from the outlet chambers 146 and 148 through those discharge openings 108 into the tank 102.

Figure 42:
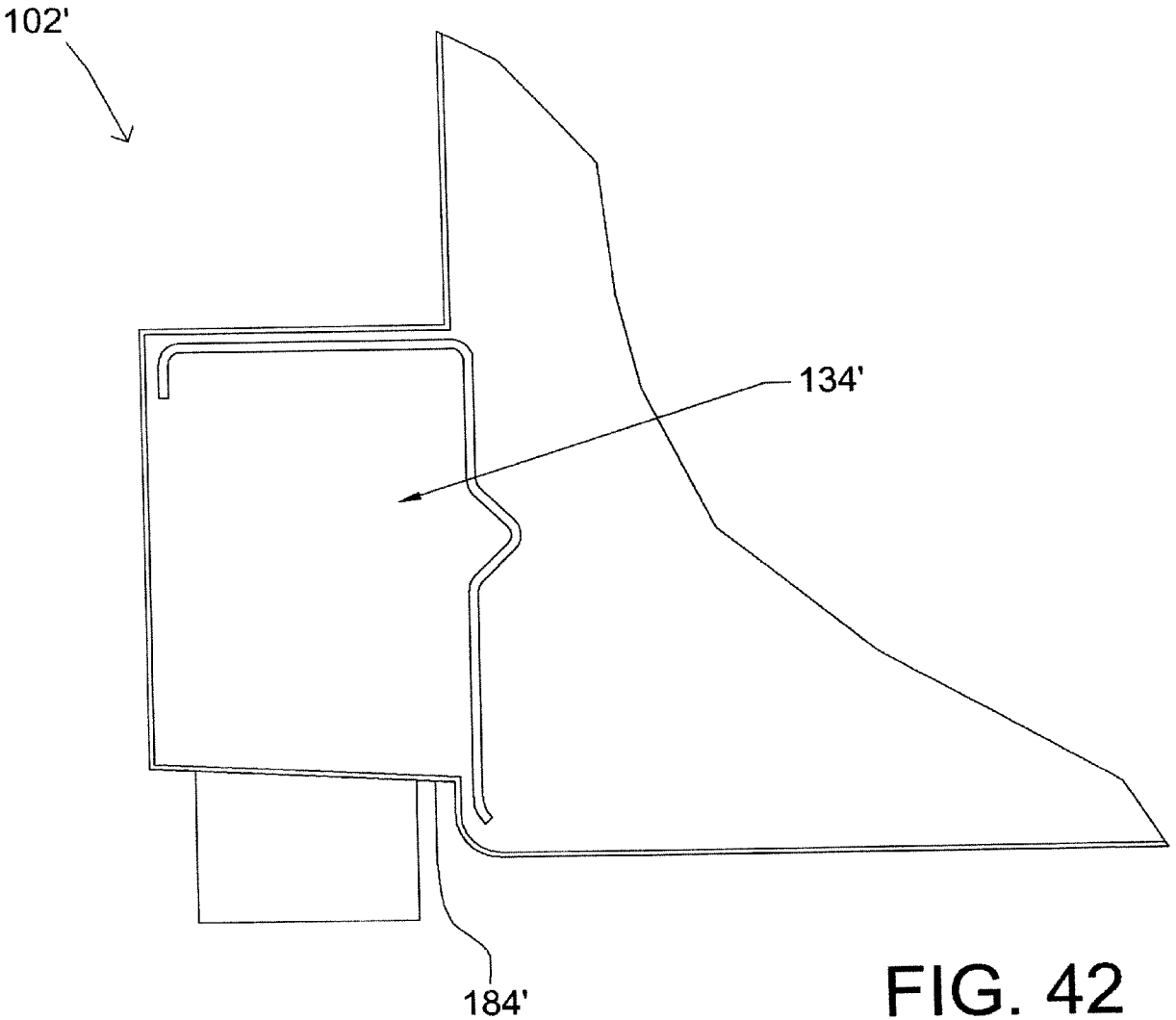
FIG. 42 is a partial side cross-sectional view of a kitchenware washing assembly with a portion of the tank broken away and illustrating an intake chamber having a downwardly sloping bottom portion according to one embodiment of the present disclosure.

The intake chamber 134 can also have positive draining into the tank 102. For example, at least some of the inlet holes 152 in the intake cover 150 can be positioned adjacent the bottom 184 of the intake chamber 134 in order to facilitate drainage from the intake chamber 134 through those inlet holes 152 into the tank 102. See FIG. 18. Additionally, or alternatively, the intake chamber 134' can also include a bottom 184' that generally slopes downwardly toward the tank 102' to provide positive drainage from the intake chamber 134' into the tank 102', as shown in FIG. 42. As yet another alternative, the intake chamber 134 can be positioned on a wall portion that is angled downwardly.

Figure 14B:
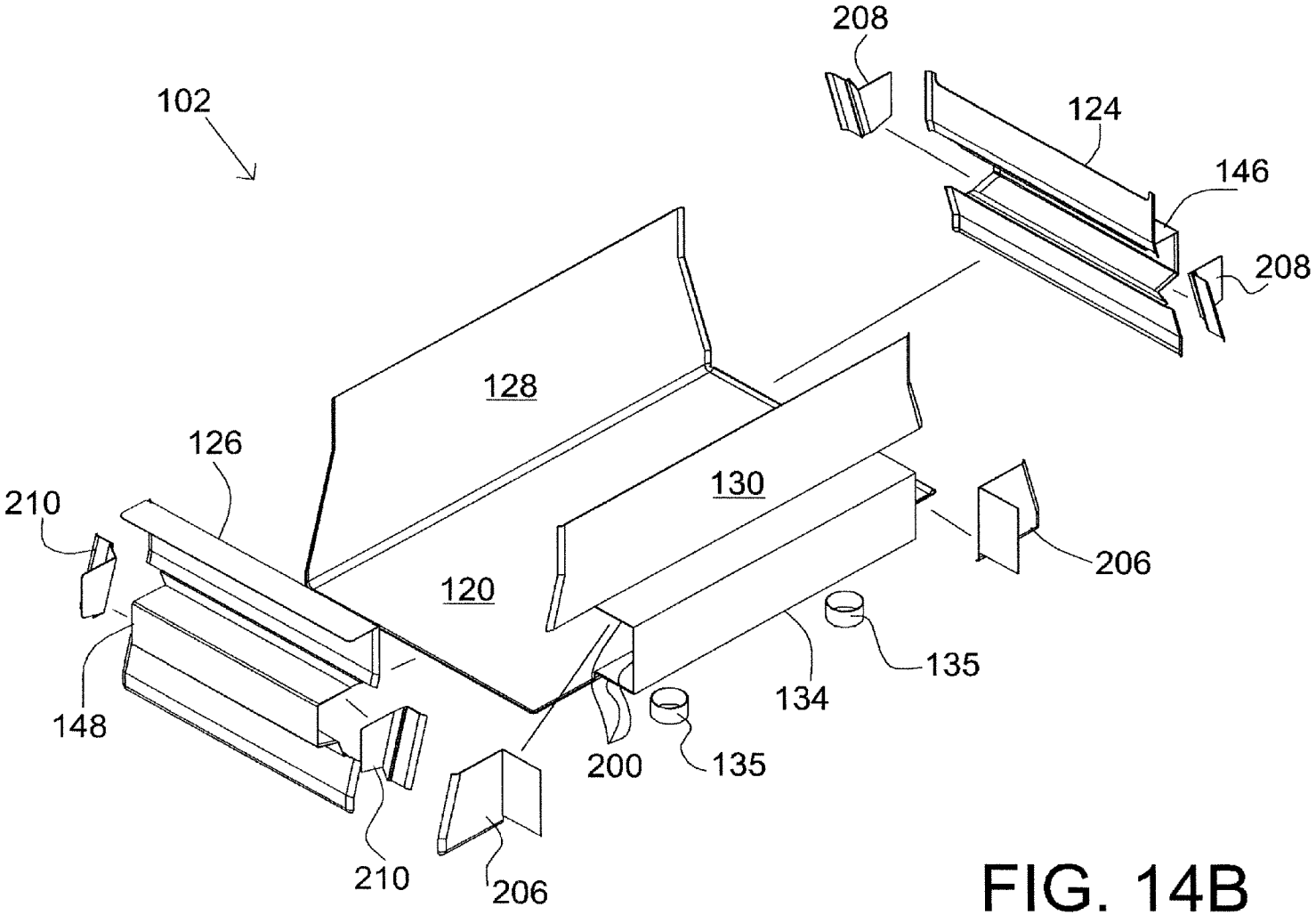
Figure 14C:
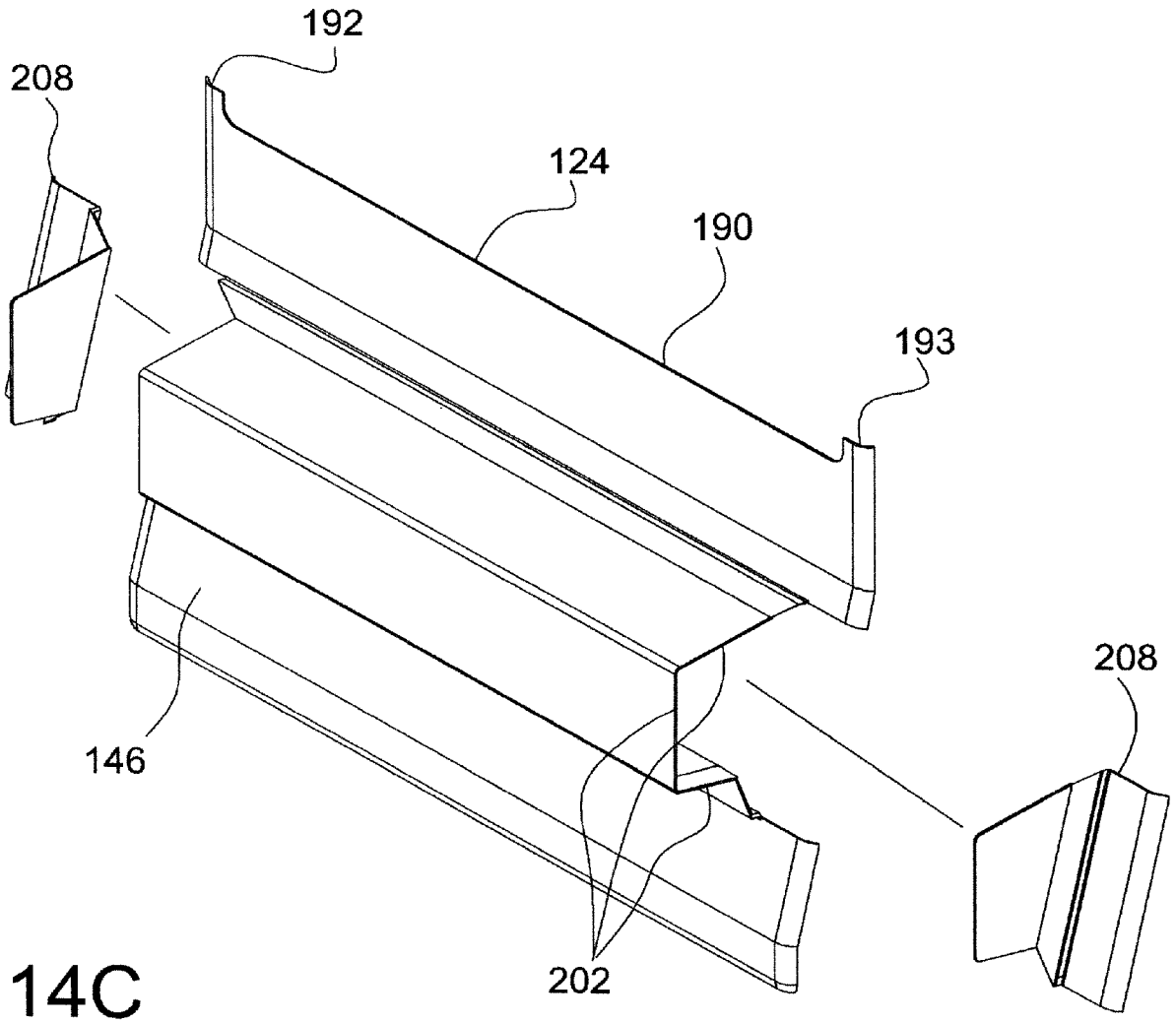

As shown in FIG. 14C, 15A and 15B, the washer assembly 100 includes an overflow 190 formed as an elongated cutaway portion between edges 192 and 193 in sidewall 124 adjacent its top edge. When fluid in the tank 102 reaches the overflow 190, fluid spills over into the scraping station 114 (FIGS. 15A and 15B) and down the scraping station's drain. Further, grease and floating debris also spill over the overflow 190 and are disposed of in the scraping station 114. The scraping station 114 is equipped to dispose of grease and debris. Thus, the overflow 190 can serve two purposes: ensuring that the tank 102 does not overfill and spill onto the surrounding floor, and allowing grease or floating debris to be removed from the tank 102. The overflow 190 could also be formed by cutting a narrow, elongated opening in sidewall 124.

The tank 102 can be formed using a wide range of manufacturing processes. In various embodiments, the tank 102 includes an at least partially unitary construction. This can provide considerable reduction in manufacturing costs as compared to existing tank designs in which the tank walls are all formed from pieces that are welded together to form the tank. Forming two or more of the tank components unitary or monolithically with one another can reduce the overall amount of welding labor, and costs associated with manufacturing a tank.

The manufacturing process according to one particular embodiment will now be described in detail. As shown in the figures, the intake chamber 134 is on the back wall 130, and outlet chambers 146 and 148 are on the respective sidewalls 124 and 126. A substantial portion of each chamber 134, 146, and 148 is formed unitary or monolithically with the corresponding wall 130, 124, and 126 on which it is disposed.

As shown in FIGS. 14A and 14B, the tank's front and back walls 128 and 130 and bottom 120 are unitarily formed with one another. The tank's sidewalls 124 and 126, however, are separate components that are attached (e.g., welded, etc.) to the front and back walls 128 and 130 and bottom 120.

Figure 14D:
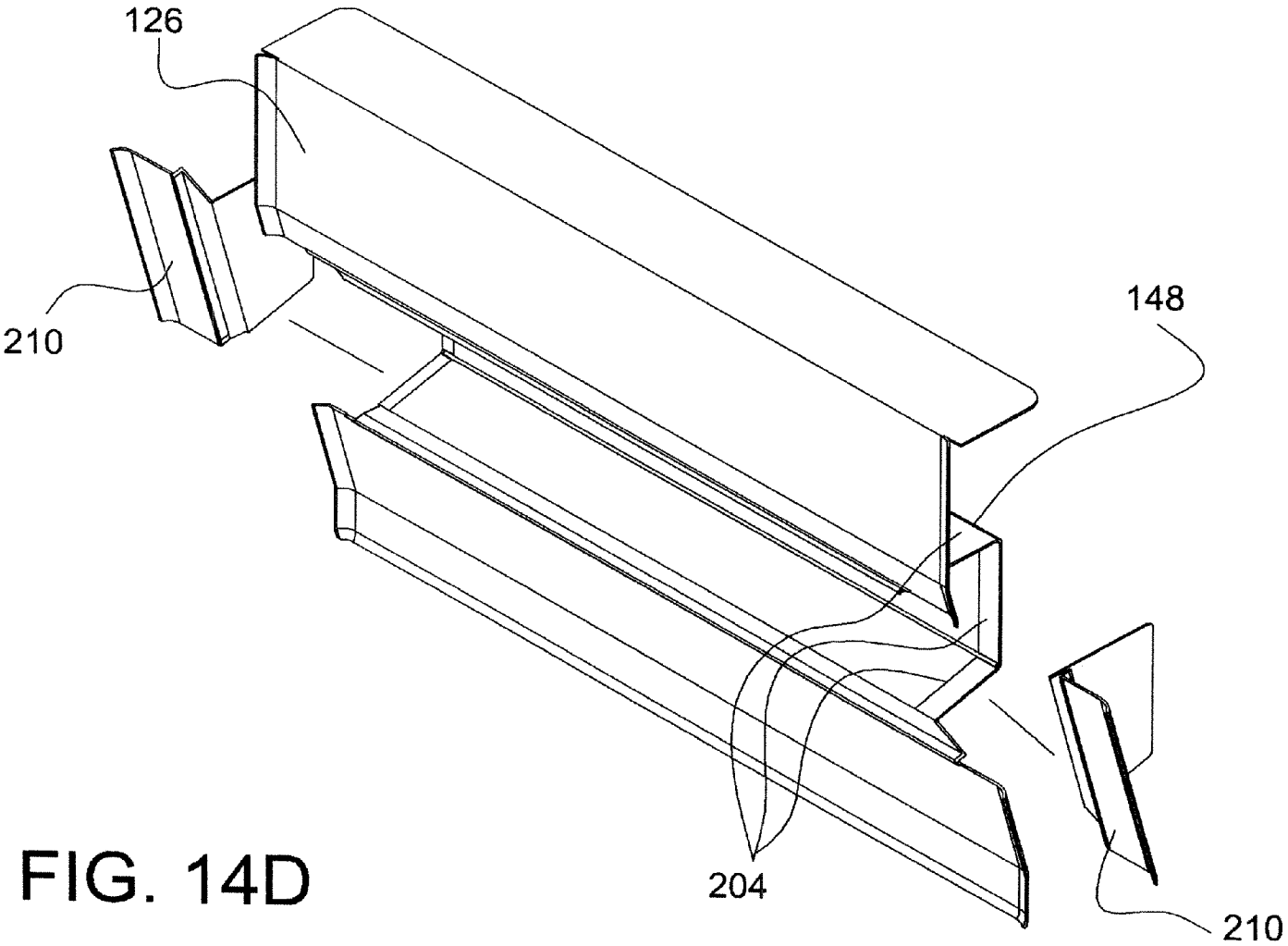
Figure 14E:
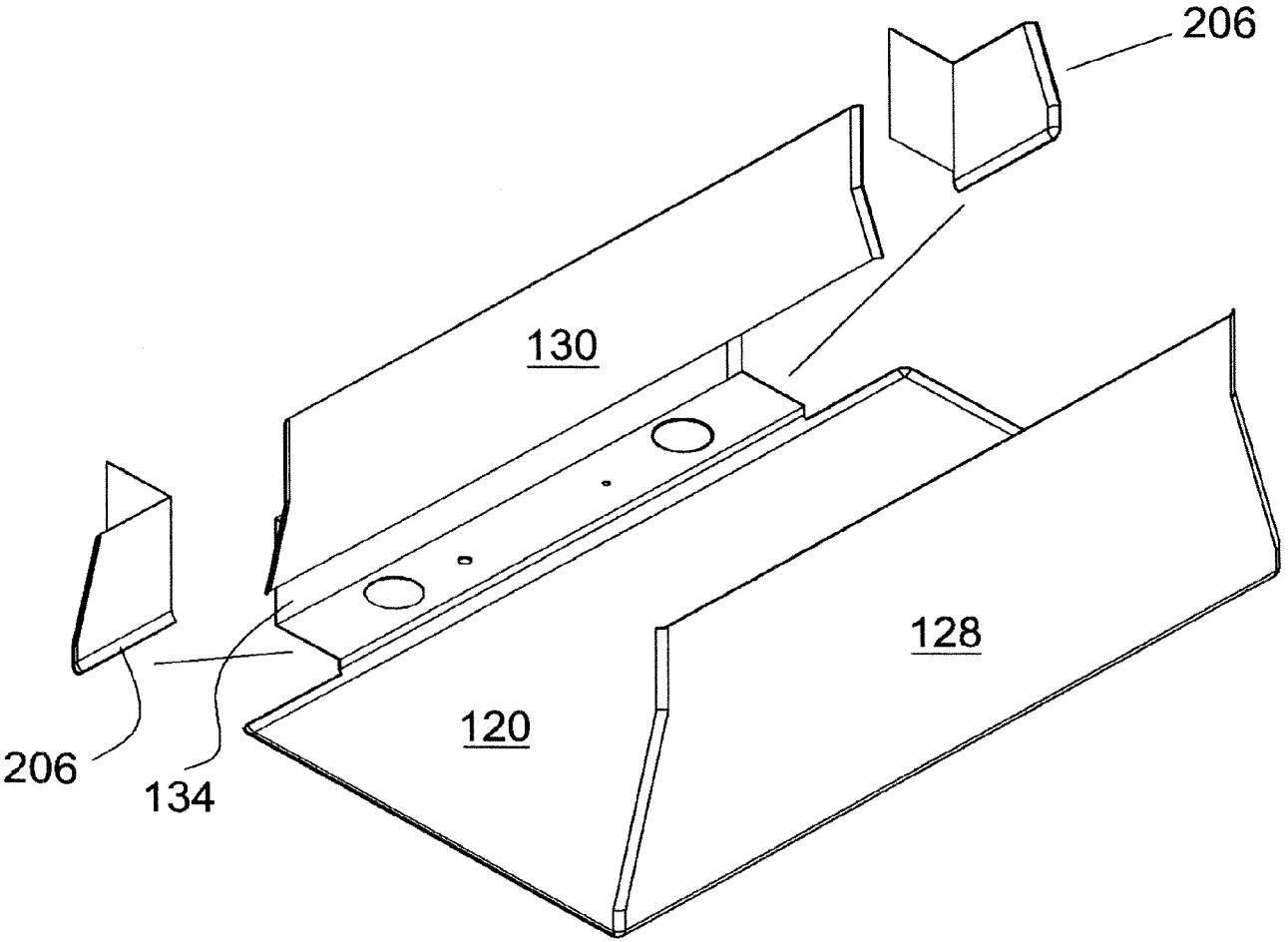

In addition, the intake chamber 134 includes a longitudinal wall 200 (FIG. 14B) that is formed unitary with the back wall 130. The outlet chamber 146 includes a longitudinal wall 202 (FIG. 14C) that is formed unitary with the sidewall 124. The other outlet chamber 148 includes a longitudinal wall 204 (FIG. 14D) that is formed unitary with the sidewall 126. Each longitudinal wall 200, 202, 204 forms at least portions of a top, back and bottom of the corresponding chamber 134, 146, 148 such that each chamber is generally box-shaped with an open side into the tank 102. Alternatively, other chamber walls besides longitudinally extending chamber walls and/or chamber walls having other geometries besides box-shaped (e.g., rounded, triangular, etc.) can also or instead be unitarily formed with a tank wall or bottom.

Each chamber 134, 146, 148 includes end walls 206, 208, 210, respectively, that are separately attached to the tank 102 and the longitudinal chamber walls 200, 202, 204. In one particular embodiment, the chamber end walls 206, 208, 210 are welded to the tank 102 and to the longitudinal chamber walls 200, 202, 204. Alternatively, other suitable methods can be used for attaching the chamber end walls.

In one particular manufacturing process, the tank 102 is formed as follows. A first sheet of stainless steel is cut and bent to form the front wall 128, bottom 120, back wall 130, and longitudinal chamber wall 200. A second sheet of stainless steel is cut and bent to form the sidewall 124 and longitudinal chamber wall 202. A third sheet of stainless steel is cut and bent to form the sidewall 126 and longitudinal chamber wall 204. The edges of the sidewalls 124 and 126 are welded to the edges of the front wall 128, back wall 130 and bottom 120. Rather than using three separate sheets of stainless steel material to form the tank 102, alternative embodiments can include using a single sheet of stainless steel material which is cut to form the three sheets of stainless steel.

The chamber end walls 206, 208, 210 are welded to the tank 102 and the corresponding chamber wall 200, 202, 204. As shown in FIG. 14A through 14E, the stainless steel portions that ultimately form the chamber end walls 206, 208, 210 also form a portion of the corresponding tank wall 130, 124 and 126. The chamber end walls 206, 208, 210 can be formed (e.g., laser cut, etc.) from the same sheet of stainless steel that is used to form the respective longitudinal chamber wall 200, 202, 206. Alternatively, the chamber end walls can each be formed from one or more separate sheets of stainless steel.

In alternative embodiments, the tank's sidewalls, front wall, and back wall are all formed unitary with one another and with the tank's bottom. These alternative embodiments can also include an intake chamber and/or an outlet chamber formed unitary with one or more of the tank walls, e.g., front, back, or sidewalls. A particular one of these alternative embodiments includes an intake having at least one wall formed unitary with the back wall, and two outlet chambers each having at least one wall formed unitary with one of the sidewalls. In this alternative embodiment, each chamber includes end walls that are separately attached (e.g., welded, etc.) to the tank and to the unitarily formed chamber walls. This tank can thus be formed as follows according to this alternative embodiment. A sheet of stainless steel is cut and bent to form the front wall, back wall, two sidewalls, bottom, and longitudinal chamber walls. The junctions between adjoining tank walls are welded to form the enclosure wall. The chamber end walls are welded to the tank and the corresponding unitarily formed chamber wall. The portions forming the chamber end walls can also form a portion of the corresponding tank wall to which it is attached. The chamber end walls can be formed (e.g., laser cut, etc.) from the same sheet of stainless steel that is used to monolithically form the tank bottom and tank walls. Alternatively, the chamber end walls can be formed from one or more separate sheets of stainless steel.

In yet another embodiment, the tank sidewalls can be unitarily formed with one another and with the tank bottom. The tank's front and back walls can be separate components that are attached (e.g., welded, etc.) to the sidewalls and the bottom. In this alternative embodiment, an intake chamber and/or an outlet chamber can be formed unitary with one of the tank walls, e.g., front, back, or sidewalls.

In each of the embodiments mentioned above, any of the chamber end walls could be formed unitary with their respective tank wall. Additionally, or alternatively, any of the chamber end walls can be formed unitary with their respective longitudinal chamber wall.

A further aspect of the present disclosure includes a control system having a consolidated removable control module. The consolidated removable control module includes a plurality of electronic components (e.g., a circuit breaker or fuse, a motor starter, a relay, a printed circuit board electronic circuitry, etc.) for substantially controlling one or more operations of a kitchenware washing assembly. In various embodiments, the removable control module is a pluggable module that can be removed as a unit such that, in the event of a failure of one or more of the electronic components, the removable control module can simply be removed and replaced in its entirety by a layperson. Advantageously, this can allow for the elimination of costly service calls by a technician, for example, to perform diagnostics in the field to determine which individual component failed, and downtime of the machine while waiting for that service to be performed.

The control system includes electronics or similar control components for controlling one or more operations of the washing assembly. The control system can include a controller having a microprocessor, a real-time clock, a memory or other form of computer readable medium, and computer executable instructions including one or more wash cycle schemes. The computer executable instructions can be predefined or programmable by an operator. For example, the control system can include a programmable EPROM chip that provides for custom computer executable instructions to be applied to control the various components of the washing assembly, including a pump, and/or heater. Such a control system can provide for controlling a washing assembly operation such as providing power to one or more fluid pumps for extracting and injecting washing fluid from the tank. This can include controlling a variable speed motor associated with a pump for providing various cleaning fluid flow rates into and out of the tank.

The control system can also include a user interface device such as a keypad, buttons, or dial. A display can also be included for displaying programmed cycle information and other information pertinent to the use and operation of the control system and/or the washing assembly. Additionally, a data communication interface can provide for data connectivity to other systems, a remote control, and/or administration system. The user interface device or data communication interface can be utilized to provide or change a computer executable instruction of the control system.

The control system can also provide power and/or control to one or more heaters, an automatic cleaner dispenser system, and/or a water supply or drain solenoid, by way of additional examples. The control system can also receive one or more signals from sensors or other components located about the kitchenware washing assembly or from an external source. For example, a temperature signal that is indicative of a temperature of the washing fluid can be provided from a temperature sensor (e.g., thermocouple, etc.). Additionally, a fluid level sensor can provide a signal to the control system that is indicative of a fluid level within the tank. Or, for example, the control system can receive a signal from a sensor indicative of the concentration of cleaning solution in the fluid within the tank. In response, the control system may control an automatic cleaner dispenser system (e.g., solenoid, etc.) to dispense the cleaning solution, such as soap in definable and measurable amounts into the tank as a function of the detected concentration of cleaning solution in the tank and/or as a function of time, temperature, and/or cycle.

The control system can control an operation of the washing assembly as a function of the temperature signal or other received signals, the computer executable instructions, user input, and/or data input. In addition, the control system can generate outputs including an alarm output associated with the operation of the washing assembly and/or the status of a component thereof. The above control system components are set forth by way of example and are not intended to be limiting.

In operation, the control system can control the dispensing of washing fluid into the tank and the heater to heat the washing fluid in the tank to a specified temperature. For example, the control system can control the operation of the heater to activate the heater to heat the washing fluid and to deactivate the heater to allow the washing fluid to cool. The control system can also control operation of the pump(s), such as by altering the frequency of the pump(s), speeding up or slowing down the pump(s), causing the pump(s) to pulsate, etc.

The microprocessor can be programmed to provide a wash cycle program that provides cycles for predetermined time periods and the pump speed (e.g., washing fluid flow rate and/or resulting tank turbulence) and/or heat can be varied to provide predetermined cleaning cycles. The control system can provide for the removal of the washing fluid at the end of a cycle and for generating an alarm, an indicator, and/or an operational report.

The control system can monitor and store operational data, profiles, and administrative features for the kitchenware washing assembly. The control system can generate operational reports. Various data can be monitored, stored, and/or reported, such as how many wash cycles and of what type, water temperature, soap and chemical levels and time (e.g., soap injection time, soap ounces per minute, total soap used, etc.), number of water changes, how many times the water has been drained and refilled, how many gallons of water were used for all water changes, heater core temperature, pump operational data, and/or when was last water change, etc. Advantageously, this data acquisition, storage and reporting can allow the operation of the kitchenware washing assembly to be tailored for specific cleaning needs of a particular user's application and/or particular industry. For example, the operation of the kitchenware washing assembly can be controlled in accordance with definable cycles which specify operational events including timing, duration, temperatures, pump speeds, soap or chemical concentration levels, cleaning solution changes, etc. By way of example, a user interface may be provided that allows the user to specify the control or operational parameters for one or more wash cycles or schemes to thereby customize or tailor the operation of the kitchenware washing assembly for specific cleaning needs. For example, the user interface may allow the user to specify the timing, duration, water temperature, temperature ranges, maximum water temperature, cleaning solution or soap concentration levels, pump operational parameters (e.g., speeds, frequencies, pulsations, etc.), cleaning solution changes, fills and drains, event logging, data reporting, maintenance reporting, alarming, etc.

In addition, data and operational parameters can be stored along with a serial number or other identifying data for a kitchenware washing assembly. This data can then be reported, for example, like a snapshot of performance to a technician to thereby allow for improved service calls and improved servicing of the kitchenware washing assembly. This stored data may also be used by the controller, for example, to conduct self-diagnostics. As another example, this data reporting and report generation can include generating reports for health departments, or others. In various embodiments, controller or microprocessor is configured to store events monitored and controlled by the microprocessor and to communicate to provide stored operating data over a communication interface at a predetermined period of time, on a demand basis, and/or in response to a request from a remote unit. Exemplary operating data that can be stored and/or communicated include includes system sensors, system cycles, system usage time, timing of events such as beginning and ending of cycles, water additions, cleaning solution drainage, cleaning solution changes, water changes, water usage, temperatures, pump speeds, cleaning solution measurements, release of cleaning solutions or detergents, cleaning solution concentration levels, alarm conditions, maintenance requirements, sanitizing times, dry fire periods, etc.

Various embodiments can also include enhanced data acquisition and reporting, such as determination of operating costs including calculating amount of water and soap used and cost for the soap used and/or determination of maintenance requirements as a function of an operating characteristic (e.g., operating time or usage, etc.). For example, it may be determined that maintenance on a pump is required or recommended after five hundred hours of pump operation, refill cleaning solution, etc.

The control system can be enclosed within a housing and have one or more control modules that are removable from the housing for replacement and maintenance. The housing and each control component can be configured to enable the control component to be plugged into and unplugged from the housing without requiring wiring or other similar technical and/or skilled operations on the part of the user or operator. For example, the housing can be configured to have one or more slots configured to receive one or more control components (e.g., plugs and receptacles, etc.). Each slot can include a connector for electrically coupling the control component to other components of the washing assembly such as a pump, heater, sensor, solenoid, user interface, or data communication port or interface. By being pluggable, the individual control component can be removed from the housing slot for maintenance or replacement by an operator without requiring wire management or other technical skills.

In various embodiments, the control system can be consolidated with each control module having two or more electronic components configured to substantially control one or more washing assembly operations. For example, each control module can include, but is not limited to, electronic components such as a circuit breaker or fuse, a motor starter, a relay, a transformer, a printed circuit board electronic circuitry, a processor, or a memory. In addition, the consolidated control system can be a pluggable module that can be removed as a unit. In such embodiments, if a component of the control system fails, the entire control module can be readily and quickly removed from the housing and replaced with another complete control module. This eliminates costly downtime and the need for diagnosis in the field to determine which individual component failed. The original control module can be diagnosed and repaired when convenient and returned to service when needed. In addition, this control module replacement can be performed by an unskilled operator without requiring the assistance of a skilled or semi-skilled service or repair technician.

A housing can be provided for containing the consolidated and removable control module. The housing can be located above a back portion of the tank. But the housing can be located in any position about the kitchenware washing assembly. In this manner, an operator can have easy access to the control system for operation and maintenance. Also, the control system can be positioned such that it is less susceptible to washing fluid spills. In some embodiments, the housing is positioned to be at a level between the operator's waist and eye to provide convenient operator access. In one embodiment, the lower portion or bottom of the housing can be positioned greater than about forty inches above the floor on which the washing assembly and/or the operator are standing.

The housing can include a cover for enclosing and protecting the electronic components. In some embodiments, the cover can be attached to the housing by one or more fasteners, such as a screw, and/or the cover can be attached with one or more hinges or hinge-type devices. Additionally, in some embodiments, a seal can be placed between the cover and the housing to provide a substantially water tight seal and access for the enclosed electronic components. The cover and/or the seal can be of any design, type, arrangement, or combination for enclosing and protecting the control system electronic components.

Figure 34:
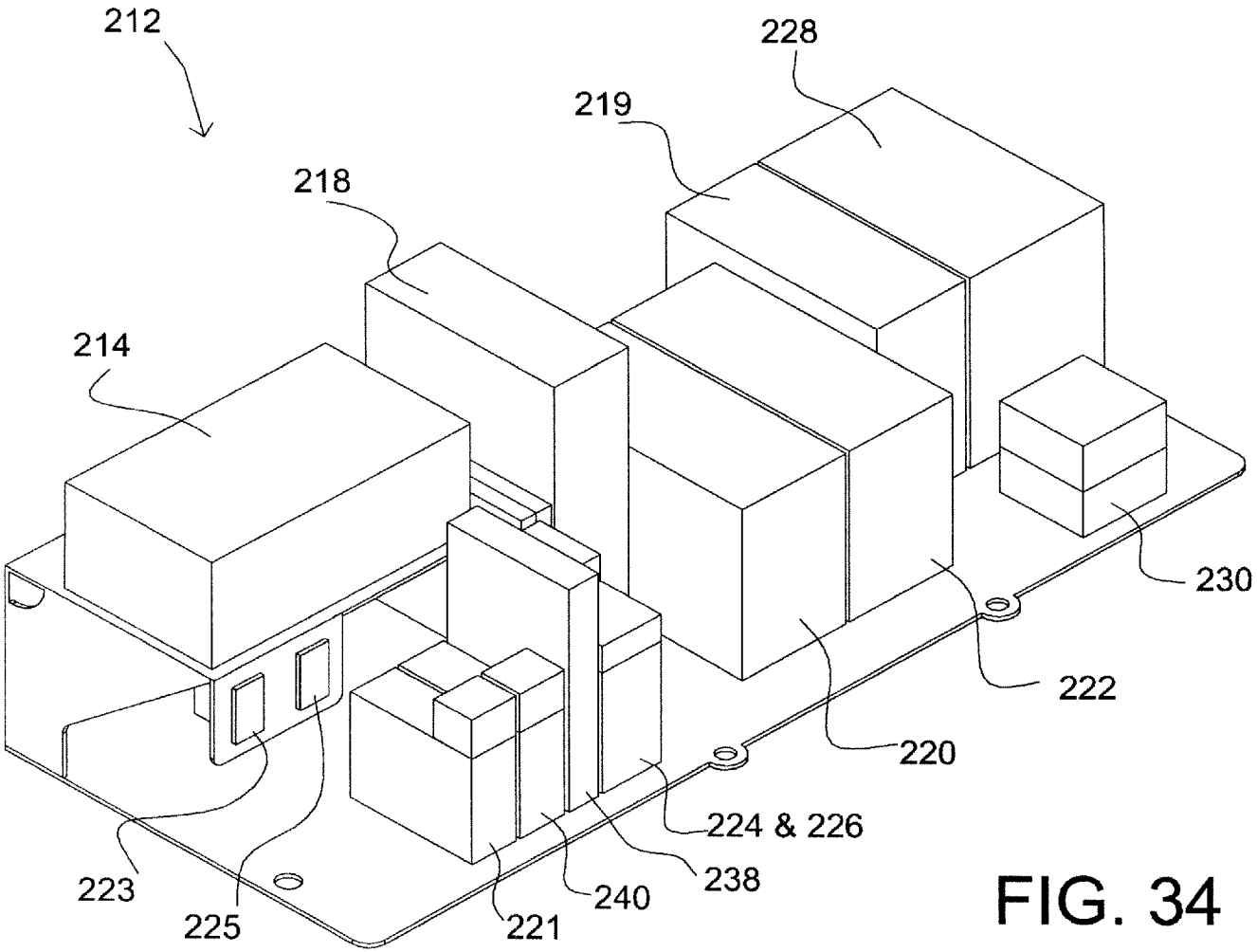
FIG. 34 is a perspective schematic view of a control system that can be used for controlling one or more operations of a kitchenware washing assembly according to one embodiment of the present disclosure.
Figure 35:
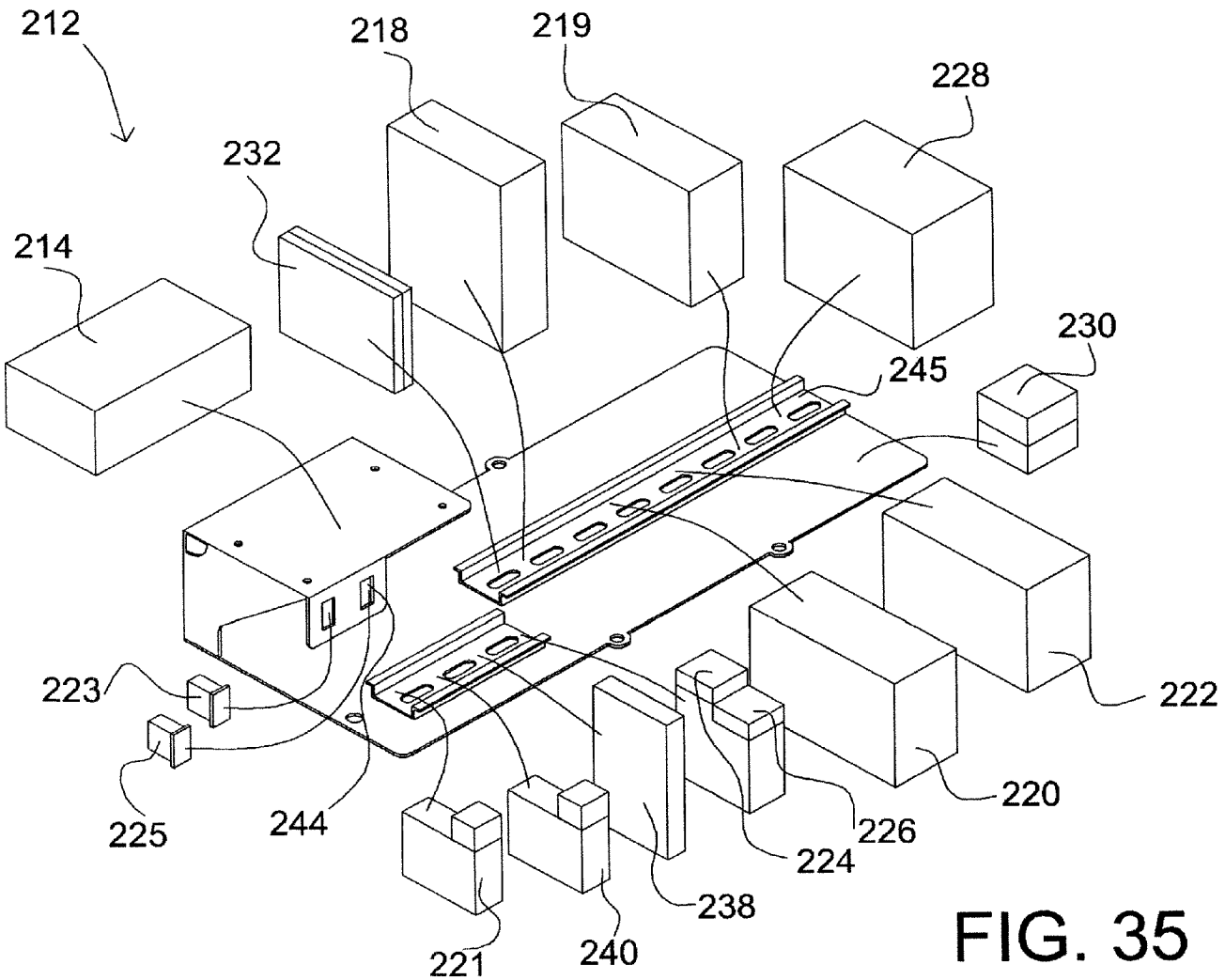
FIG. 35 is an exploded perspective schematic view of the control system in FIG. 34.
Figure 36:
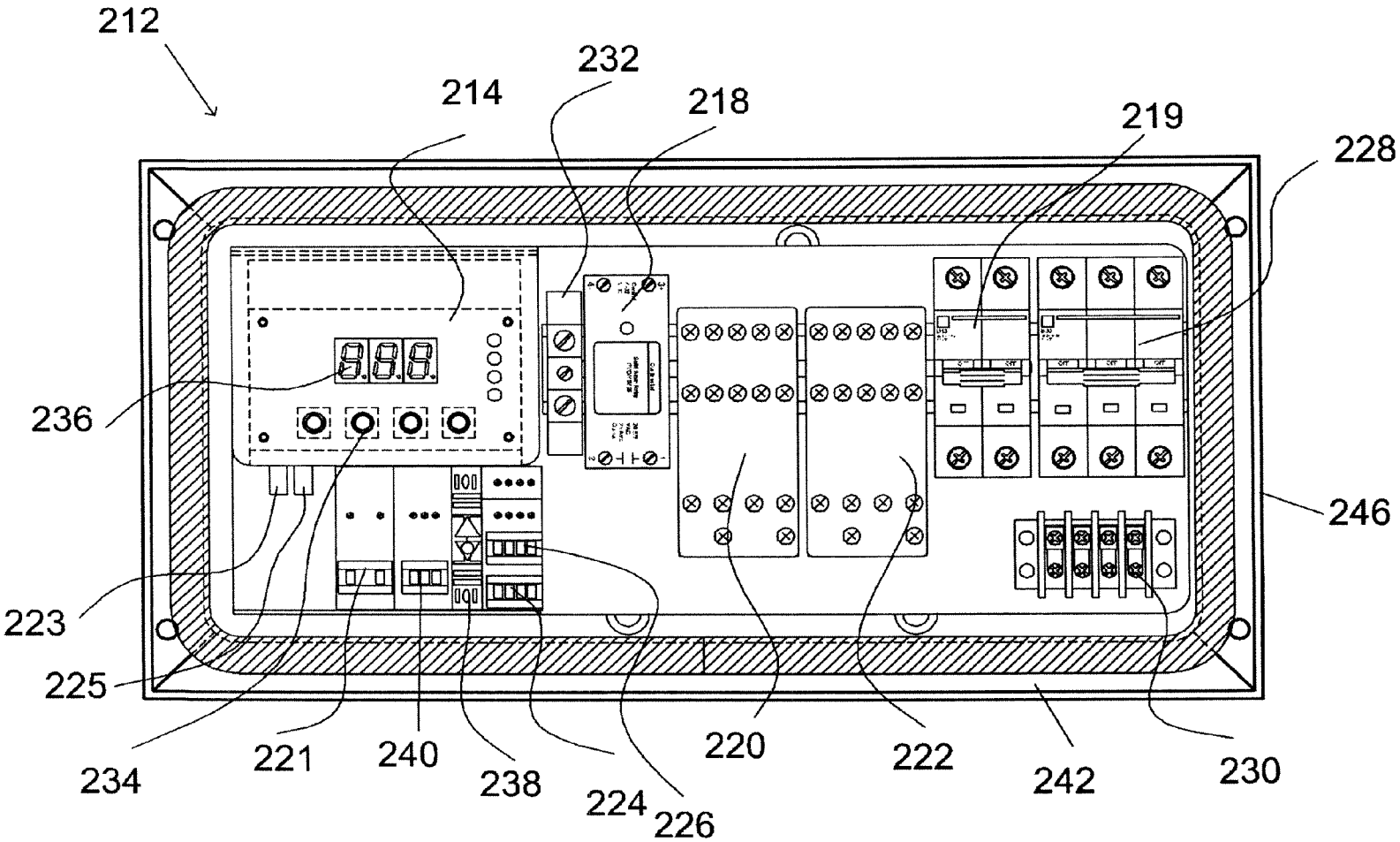
FIG. 36 is a front elevation view of the control system shown in FIG. 34.
Figure 37:
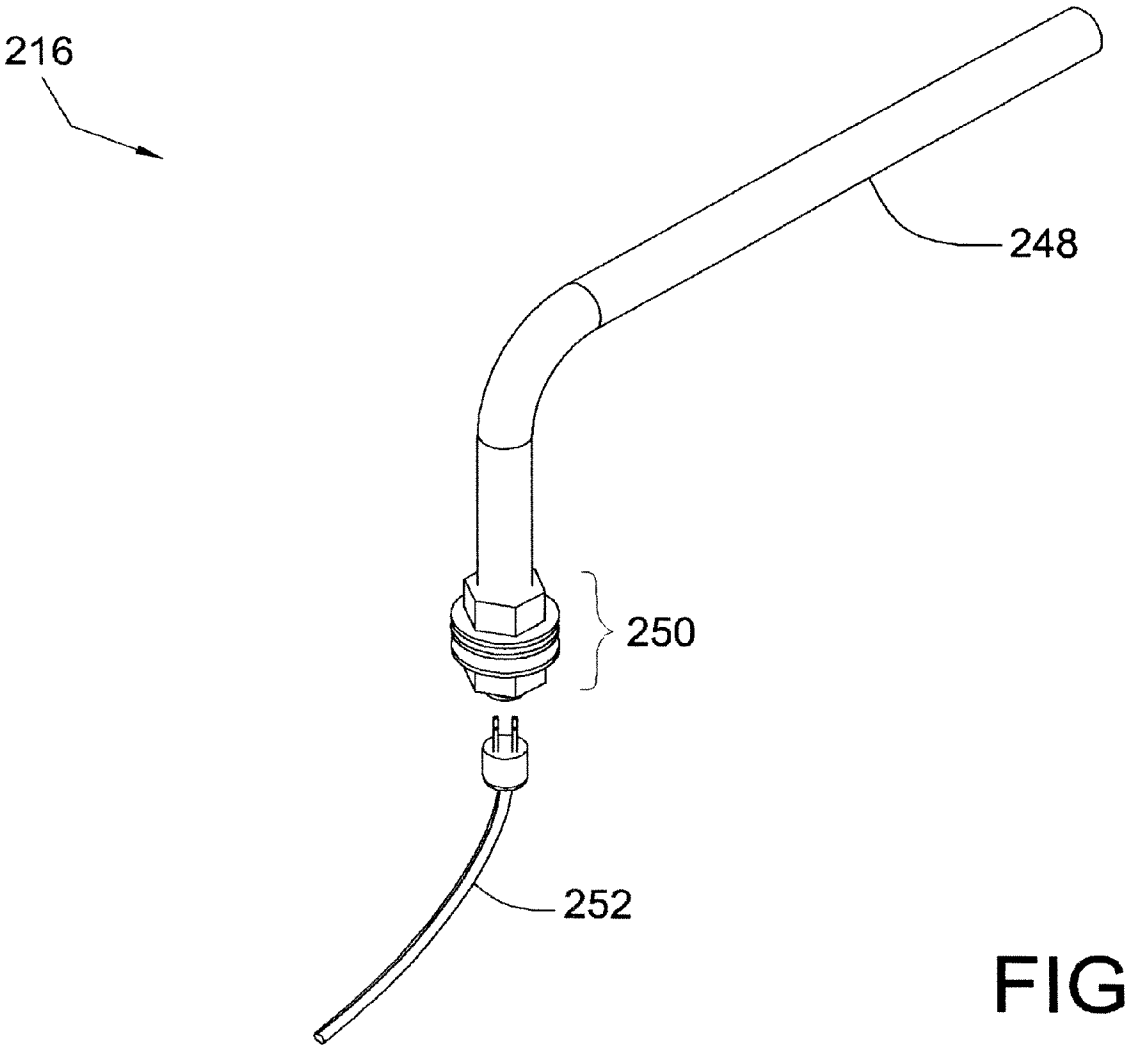
FIG. 37 is a perspective view of a heater that can be used with a kitchenware washing assembly according to one embodiment of the present disclosure.
Figure 38:
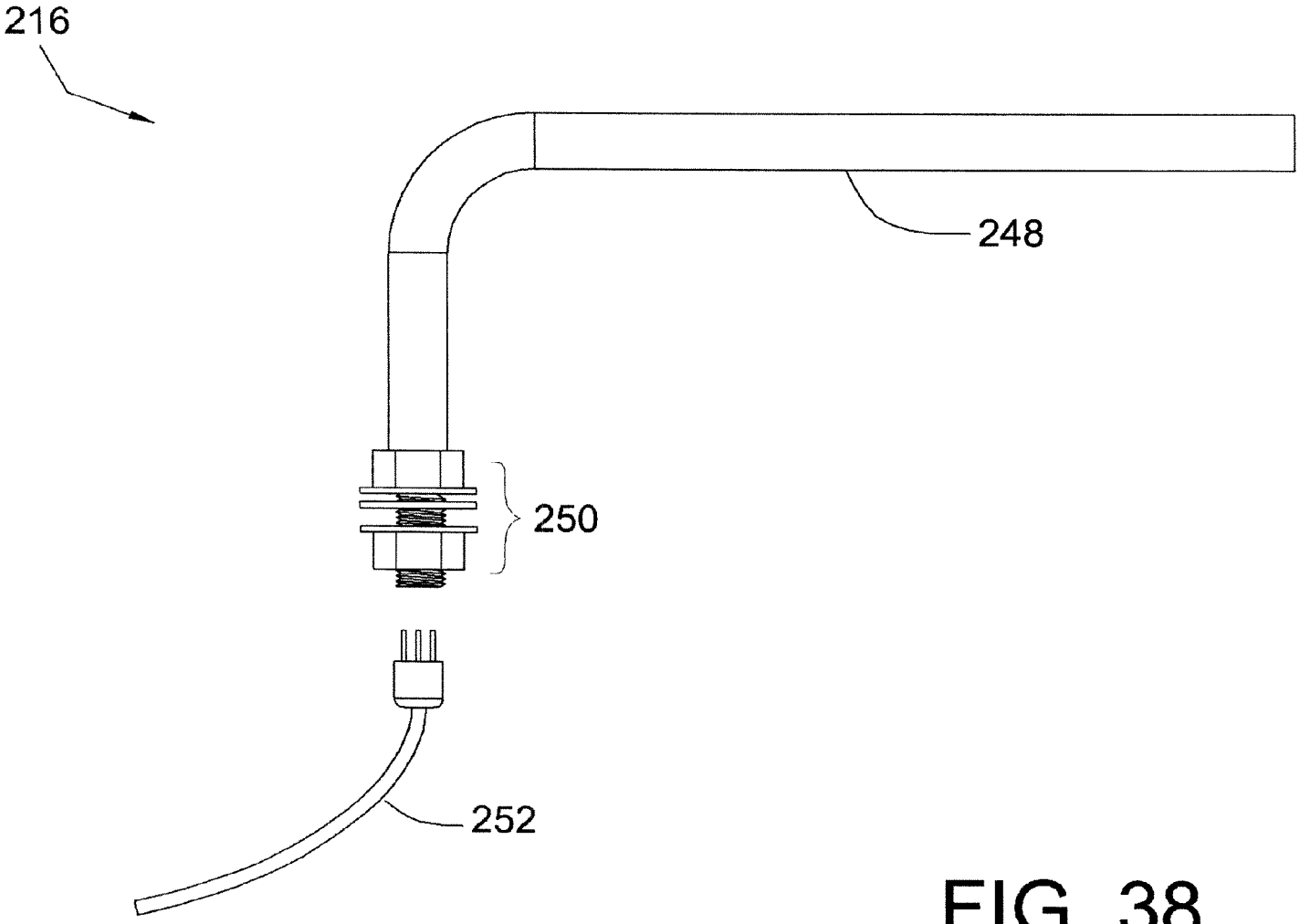
FIG. 38 is a side elevation view of the heater shown in FIG. 37.
Figure 39:
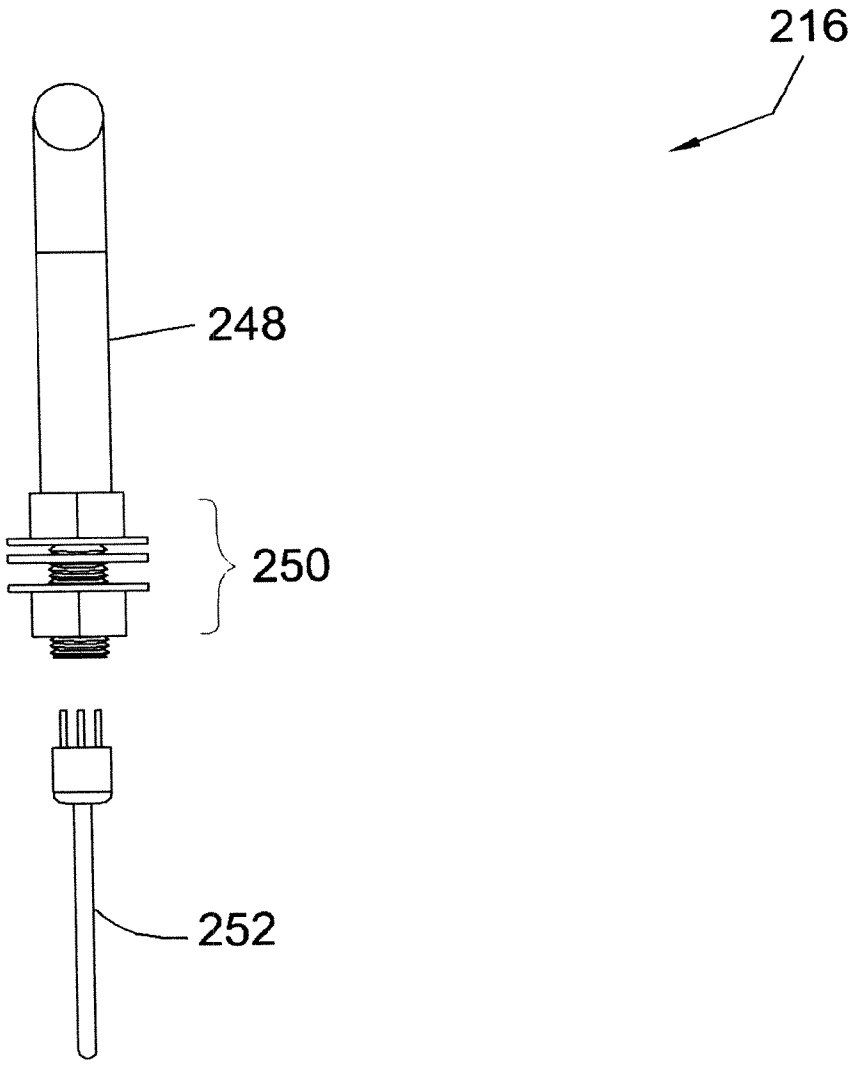
FIG. 39 is a front elevation view of the heater shown in FIG. 37.

Referring now to FIGS. 34 through 36, there is shown an exemplary implementation of a control system 212 that can be used for controlling one or more operations of the kitchenware washing assembly 100. As shown, the control system 212 includes a solid state controller 214 (e.g., microprocessor). The controller 214 is coupled to a heater 216 (FIGS. 37 through 40) through a solid-state relay 218. In addition to the heater solid-state relay 218, the control system 212 also includes a breaker 219 and a receptacle and plug 221 for the heater 216.

The control system 212 also includes one or more receptacles and plugs for one or more thermocouples. As shown, the control system 212 includes a receptacle and plug 223 for a thermocouple (or other suitable sensor) in the tank for determining the temperature of the water. The control system 212 also includes a receptacle and plug 225 for a heater thermocouple or other type of temperature sensor. By way of example only, a thermocouple may be built into or embedded within the heater 216 (FIGS. 37 through 40) for determining the temperature of the heater. Or, for example, a thermocouple may be spaced apart from and external to the heating element. In yet another embodiment shown, a thermocouple may be relatively flexible such that the thermocouple may be flexed or bent to allow its end portion to be positioned relatively close to the heating element.

The controller 214 is coupled to the pumps 104 and 106, for example, for providing power to the pumps 104 and 106 and/or controlling variable speed motors associated with the pumps 104 and 106 for providing various cleaning fluid flow rates into and out of the tank 102. Regarding the motors, the control system 212 includes motor contractor and overloads 220 and 222, and motor receptacles and plugs 224 and 226.

The control system 212 also includes a main breaker 228 and a plug and receptacle 230 for the main power. The control system 212 further includes a ground block 232.

The control system 212, or more specifically, the controller 214 in the illustrated embodiment includes a control panel 234 (FIG. 36) that includes controls, such as a keypad, buttons, and/or dials, for activating the pump speeds, wash cycles, heater(s), and cleaner dispenser(s). The controller 214 also includes a display 236 (e.g., digital readout screen) for displaying programmed information and other information pertinent to the use and operation of the control system 212 and controller 214. For example, the digital readout screen may display the type of washing scheme, cycle, operating parameters, and/or titles customized by the user via a user interface.

The control system 212 can also provide power and/or control to an automatic cleaner dispenser system. In this regard, the illustrated control system 212 includes a fuse block 238 and receptacle and plug 240 for a soap pump.

In the illustrated embodiment, the control system 212 is enclosed within a housing 242. In various embodiments, the entire control system 212 is a pluggable module that can be removed as a unit. In such embodiments, if a component of the control system fails, the entire control module can be readily and quickly removed from the housing 242 and replaced with another complete control module. This eliminates costly downtime and the need for diagnosis in the field to determine which individual component failed. The original control module can be diagnosed and repaired when convenient and returned to service when needed. In addition, the control module replacement can be performed by an unskilled operator without requiring the assistance of a skilled or semi-skilled service or repair technician. Additionally, or alternatively, each control appendage (e.g. pump(s), motor(s), soap pump(s), thermocouple(s), heater(s), etc.) can be readily and quickly unplugged from the control system for individual replacement when required.

In various embodiments, the individual electronic components of the control system 212 can also be individually removed from the housing 242, thus also allowing for relatively easy replacement and maintenance. For example, the housing 242, microprocessor 214, solid-state heater relay 218, heater breaker 219, heater receptacle and plug 221, thermocouple receptacles and plugs 223 and 225, motor contractor and overloads 220 and 222, motor receptacles and plugs 224 and 226, main breaker 228, main power plug and receptacle 230, ground block 232, soap pump fuse block 238, and soap pump receptacle and plug 240 can be configured such that each of these various components can be individually plugged into and unplugged from the control module without requiring wiring or other similar technical and/or skilled operations on the part of the user or operator.

As shown in FIG. 35, the housing 242 includes slots 244 configured to receive components, such as the receptacles and plugs 223 and 225. Each slot 244 can include a connector for electrically coupling the component to other components of the washing assembly 100 such as one or more thermocouples, pumps 104 and 106, heater 216, soap pumps, sensors, solenoids, user interfaces, data communication ports or interfaces, etc. The housing 242 also includes DIN rails 245 formed on or mounted to the housing 242 using screws, other suitable mechanical fasteners, among other methods. The solid-state heater relay 218, heater breaker 219, heater receptacle and plug 221, motor contractor and overloads 220 and 222, motor receptacles and plugs 224 and 226, main breaker 228, main power plug and receptacle 230, ground block 232, soap pump fuse block 238, and soap pump receptacle and plug 240 are configured to be detachably mounted to the DIN rails 245. Accordingly, each individual component can be relatively easily removed from its corresponding slot 244 or from the corresponding DIN rail 245 for maintenance or replacement by an operator without requiring wire management or other technical skills.

In the exemplary embodiment shown in FIG. 36, the housing 242 includes a removable cover 246 for enclosing and protecting the components within the housing 242. In some embodiments, the removable cover 246 is a laminated covered or transparent membrane that help protects the control system 212 from fluid spills from the tank 102.

Various embodiments include a heater (e.g., electric heater element, heater 216, etc.) coupled to or at least partially housed within the intake chamber 134. For example, the heating element can be attached to the bottom 184 of the intake chamber 134, or may be mounted in any other suitable location. A thermocouple (or other suitable sensor) located a suitable distance away from the heater can be used for determining the temperature of the water. This thermocouple can be interfaced to a microprocessor that controls operation of the heater such that the heater maintains a specified fluid temperature in the tank. For example, in one particular embodiment, Proportional-Integral-Derivative (PID) control methodology is used during normal operation to control the temperature of the fluid in the tank. With this exemplary PID control, fluid temperature is monitored as the process variable for deviation from a desired value or set point in a continuous feedback loop. Corrective action (e.g., shutting down the heater, increasing the amount of heat produced by the heater, etc.) is taken whenever the monitored temperature sufficiently deviates from the set point. In this exemplary manner, PID control can be efficiently used to monitor the fluid temperature in the tank based on the current values and rates of change of the monitored variables.

Another thermocouple (or other suitable sensor) can be associated with (e.g., embedded, located in, or otherwise coupled to) the heater element. This second thermocouple can be used for fluid low level detection, and thus help determine whether a desired fluid level is in the tank. If this second thermocouple senses that the heater has an abrupt temperature increase (e.g., more than a predetermined temperature increase over a predetermined time interval), that detected condition is indicative of a low fluid level in which the fluid level has dropped too low to cover the heater element and absorb the heat produced thereby. To help prevent damage to the heater by operating during low fluid level conditions, the second thermocouple is interfaced to a microprocessor that deactivates the heater and the pumps to ensure that the heating element and pumps do not overheat.

In the illustrated embodiment, the microprocessor 214 (FIGS. 34 through 36) is coupled to the heater 216 (FIGS. 37 through 40). The control system 212 includes controls that control the microprocessor 214 to cause the heater 216 to heat the fluid in the tank 102 to a specified temperature. The microprocessor 214 is coupled to the heater through the solid-state relay 218. The microprocessor 214 can be programmed to provide a wash cycle program that provides wash cycles for predetermined time periods and the pump speed (e.g., tank turbulence, etc.) and/or heat can be varied to provide predetermined cleaning cycles. Thus, the tank 102 may operate at a mild presoak turbulence level at a higher (uncomfortable to the touch) heat to loosen caked-on food from the dishware, followed by a more turbulent flow in the tank to break away loosened food debris, followed by a final cycle at reduced temperature during which employees can finish the cleaning process.

As one example program, the following operations can be performed by the controller 214 and sensors (e.g., thermocouples, etc.) upon activation of the program: determine whether the fluid temperature is at one hundred ten degrees Fahrenheit; if it is not, cause the heater to heat the fluid to one hundred ten degrees Fahrenheit; when the fluid temperature is at one hundred ten degrees, initiate a three minute presoak cycle during which time the pumps operate at between about thirty to thirty-five hertz; proceed to a three minute intermediate cycle during which time cycle the pumps are increased to forty to forty-five hertz, thus increasing tank turbulence and cleaner agitation; proceed to a heavy duty clean cycle during which time cycle the pumps are increased to fifty to sixty hertz for eight minutes; proceed to an idle mode at about thirty hertz which prevents grease suspended in the cleaning fluid from settling back onto the kitchenware and allows removal of the kitchenware from the tank 102. It is also contemplated that overnight cycles can also be provided that allow the tank temperature to be increased to much higher temperatures of around one hundred fifty degrees Fahrenheit or higher to further facilitate cleaning. Because such temperatures are too hot for the human touch, the most difficult-to-clean kitchenware could be cleaned overnight for extended periods of time while personnel are not around and thus are not exposed to the tank of hot water. The next morning, the control system can deactivate the heater to allow the tank temperature to cool down to about one hundred fifteen degrees Fahrenheit and let the heat dissipate, thus allowing the personnel to retrieve the cleaned kitchenware from the cooled tank fluid with their bare hands.

It is also contemplated that a cover could be provided to prevent personnel from putting their hands in the water and/or alarms can be activated to warn of the hot water temperature. In one particular embodiment, the cover may be configured for rolling across the work surface of the kitchenware washing assembly. There may also be a switch associated with this cover indicating position of the cover and one or more operations may be controlled as a function of the switch cover position.

In various embodiments, the microprocessor 214 provides preprogrammed wash cycle programs, but is also adapted to allow the user to create programs to cater to specific cleaning needs.

As noted herein, various embodiments include the control system 212 controlling operation of the kitchenware washing assembly in a manner such that kitchenware washing assembly includes a plurality of distinct wash cycles or schemes. In one particular embodiment, the control system has the capability of operating the kitchenware washing assembly in five different wash cycle types (e.g., light, medium, normal, heavy, overnight, etc.) of varying degrees of aggressiveness based on water temperature, chemical solution concentration and/or pump speed. In such embodiments, the control system may include automatic time compensation in which the control system automatically adjusts timing and aggressiveness of one or more operations within a cycle as a function of the previously defined cycle and/or user-defined cycle as will now be described. One exemplary operational sequence may be a light type of wash cycle in which the pump(s) operate at about thirty hertz for about ten minutes with about four ounces of soap in the tank. Another wash cycle may be a medium type of wash scheme. In this case, the control system 212 can inject or dispense the delta difference of soap of cleaning solution in order to transition from the light wash cycle to the medium cycle to make the wash cycle more aggressive. The control system 212 can also change the operation of the pump(s) for the medium type washing cycle, such as by increasing the pumps to about thirty-five or forty hertz thus making the pumps more aggressive. There may be further higher level or more aggressive cleaning cycles for which the control system may dispense the delta difference of soap or chemical solution, increases the pump(s) operating frequency, and/or control the heater(s) in order to transition to these more aggressive cleaning cycles.

Another exemplary wash cycle may include a wash cycle in which the washing fluid temperature is definable by a user to temperatures up to and including two hundred twelve degrees Fahrenheit and/or the boiling point of the cleaning fluid. Other exemplary wash cycles include heating the fluid in the tank to a range of about one hundred sixty to about one hundred seventy degrees Fahrenheit for a first type of washing cycle, heating the fluid in the tank to greater than about one hundred seventy degrees Fahrenheit but less than about two hundred twelve degrees Fahrenheit for a second type of washing cycle, and heating the fluid in the tank to about two hundred twelve degrees Fahrenheit or higher for a third type of washing cycle.

FIGS. 37 through 40 illustrate an exemplary heater 216 according to one exemplary embodiment of the present disclosure. As shown, the heater 216 includes a housing 248 and a threaded coupling 250. The housing 248 is shown in a generally L-shaped configuration and is formed from stainless steel. Alternatively, other shapes and materials can be used for the housing 248.

Figure 40:
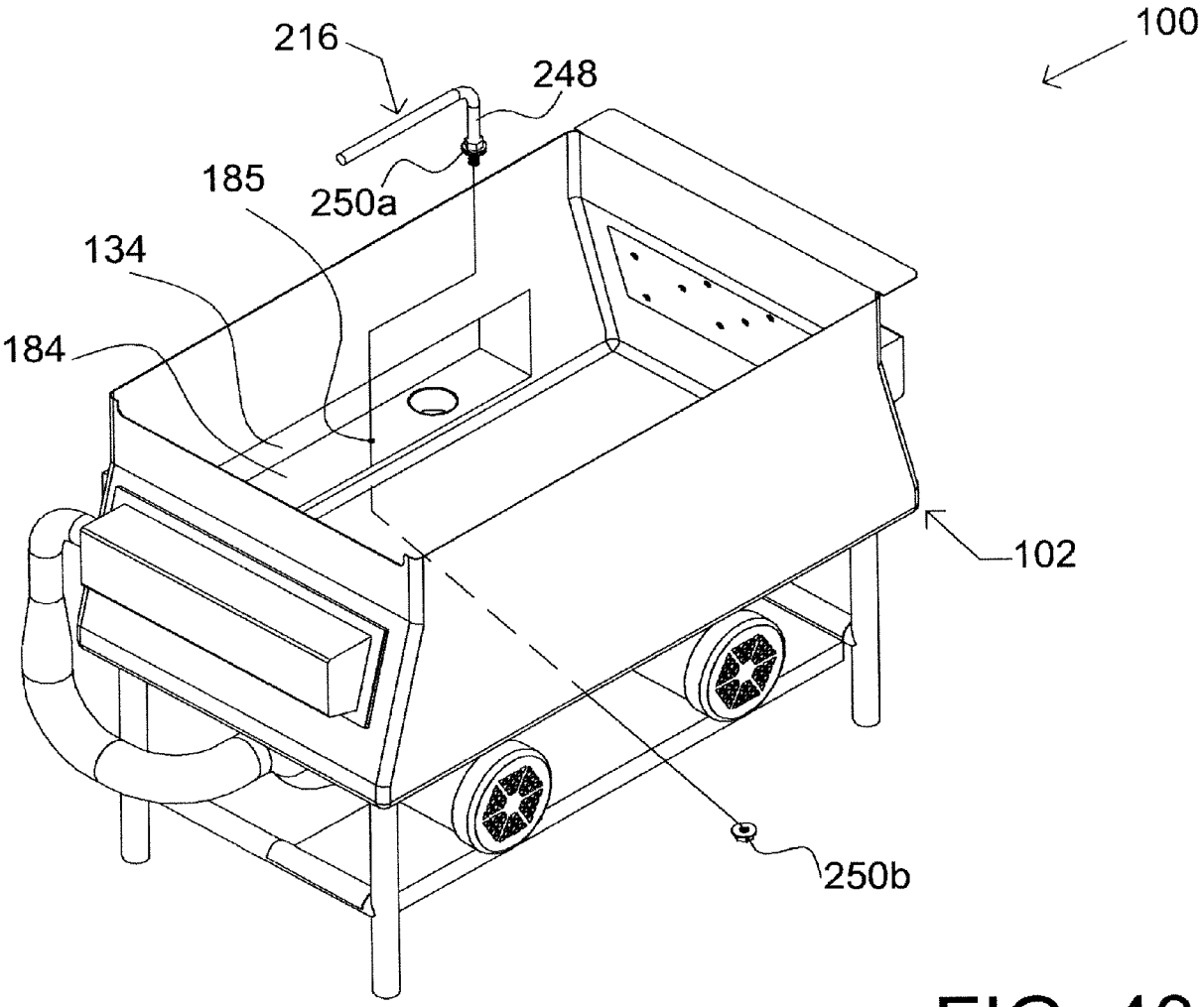
FIG. 40 is an exploded perspective view showing the heater of FIG. 37 being positioned within an intake chamber of a kitchenware washing assembly according to one embodiment of the present disclosure.

As shown in FIG. 40, the threaded coupling 250 can be used to couple the heater 216 to the bottom 184 of the intake chamber 134, with the housing 248 positioned within the intake chamber 134. In this particular illustrated embodiment, a threaded portion 250*a* of the coupling 250 is inserted at least partially through a hole 185 in the bottom 184 of the intake chamber 134. A nut 250*b* is then threaded onto the threaded portion 250*a* to thereby attach the heater 216 to the tank 102. Alternatively, the heater 216 can be coupled to the tank 102 using other suitable means and/or positioned at other suitable tank locations, such as through a wall of the tank 102 and/or through the opening at the top of the tank. In addition, the electrical power for the heater 216 is provided by way of an electrical cord 252. Accordingly, the heater 216 can be relatively easily removed from the tank 102 by unplugging the electrical cord 252, removing the intake cover 150, and unscrewing the nut 250B. Therefore, the heater 216 in this particular embodiment can be relatively easily removed and replaced by another heater 216, thereby eliminating the need to wait and pay for a costly service call by a technician.

In one particular embodiment, the heater 216 includes a cartridge heater having a heating element within the housing 248. A thermocouple is also within the housing 248, although other types of temperature sensors (e.g., transducers, thermistors, etc.) can also be used. The thermocouple (or other temperature sensor) can be built into or embedded within the heater 216, or the thermocouple can be spaced apart from the heater and/or external to the heater housing 248. The heater and/or temperature sensor may comprise a heater and/or temperature sensor, respectively, as disclosed in U.S. Pat. No. 7,578,305, the entire disclosure of which is incorporated herein by reference.

Various aspects of the present disclosure relate to tank fluid low level detection and heater temperature high limit protection. When there is no water in the tank or insufficient water within the tank to cover the heater (e.g., heater 216, etc.), the heater can damage itself by overheating if it remains in operation. In various embodiments of the present disclosure, control logic has been provided that enables tank fluid low level detection and heater temperature high limit protection using a thermocouple, such as a thermocoupled integrated with the heater 216, etc. For example, in one embodiment, the controller 214 automatically cuts power to the heater if the heater temperature (as determined by the thermocouple) reaches a predetermined high limit set point.

As an additional or alternative way of protecting the heater from overheating, the controller 214 can deactivate the heater when an abrupt temperature rise of the heater is detected by the thermocouple. An abrupt temperature rise can occur when there is insufficient water around that heater to absorb the heat produced by the heater. When the thermocouple detects that the heater's temperature has risen by a predetermined amount over a predetermined amount of time (e.g., over the last few time slices or seconds, etc.), that detected condition is indicative that there is insufficient water in the tank to cover the heater. Because continued operation of the heater could damage the heater by overheating, the controller 214 automatically shuts down the heater. By way of example, contacts within the controller 214 can open up such that the heater solid-state relay 218 loses power to its coil side and shuts down power to the heater. Additionally, or alternatively, the control system 212 could also emit a warning (e.g., visual display, emit sounds, etc.) to the operator to shut down the heater.

In these exemplary embodiments, the heater temperature high limit protection and tank fluid low level detection are determined via temperature sensing with the fluid within the tank acting as the conductor or medium through which the temperature sensing occurs. In other embodiments, however, capacitative sensing or floats can be employed to determine tank fluid low level detection and/or heater temperature high limit protection.

In other embodiments, the controller's hysteresis or deadband can be increased to accommodate for the spaced distance separating the thermocouple from the heating element. By way of background, the deadband or hysteresis is the amount of a measured variable (e.g., temperature, etc.) between the point where a switch closes and then re-opens. In various embodiments, the deadband or hysteresis is implemented within the control logic or by software of the controller. In some embodiment, the thermocouple may be relatively flexible, which allows the thermocouple to flex or bend. This, in turn, allows an end portion of the thermocouple to be positioned relatively close to the heating element. This close spacing can improve/reduce reaction time and also allows a lower deadband or hysteresis setting to be used for the heater than for other heater embodiments in which the thermocouple is spaced a greater distance away from the heating element. The end portion of the flexible thermocouple may be attached to the heating element with at least one securing device, such as a clamp, a band, or other suitable means.

Over time and repeated wash cycles, the water within the tank can get stagnate and dirty such that the tank water needs to be replaced. It can be very difficult, however, to determine when to change the tank water. Plus, changing the tank water too frequently can be costly. Conversely, waiting too long to change the tank water can lead to insufficient cleaning of the kitchenware such that kitchenware will need to be rewashed. Accordingly, it is desirable to automate the decision as to when the tank water should be changed. It is also desirable to provide some means for ensuring that the tank water is in fact changed when it should be. In various embodiments, control logic has been provided for accomplishing these tasks.

Figure 44:
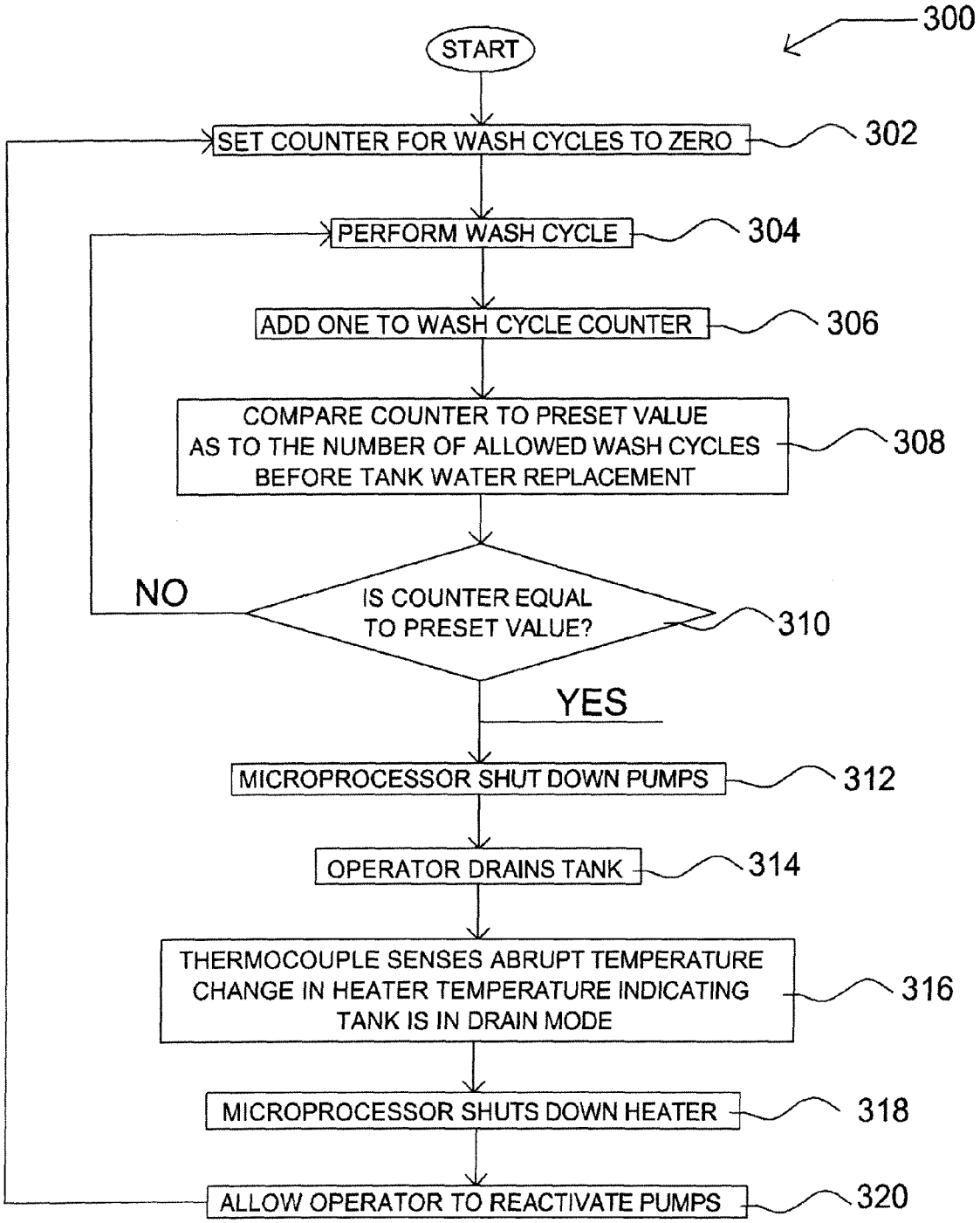
FIG. 44 is a flow diagram showing various operations of a method for monitoring tank water replacement according to one embodiment of the present disclosure.

FIG. 44 illustrates various operations of an exemplary process 300 for monitoring tank water replacement according to one particular embodiment. As shown, the controller 214 maintains a counter that tracks the number of wash cycles, amount of run time, and/or time that has elapsed since the water was last changed. At operation 302, the counter is set to zero. For each wash or washing cycle 304, the counter is increased by one (operation 306) and then the counter is compared (operation 308) to determine whether the counter is equal to a preset value. The preset value can be a value entered by the operator, and/or preprogrammed into the control system 212. The preset value is the allowable or acceptable number of wash cycles that can be performed before the tank water is replaced. The number of acceptable or allowable wash cycles may vary, however, depending, for example, on the particular type of items being washed and the size of the tank, among other factors.

The operator can continue performing wash cycles if the counter does not equal and is less than the preset value (operation 310). But when the counter equals (or exceeds) the preset value, that is an indicator that the tank water should be replaced.

To help ensure that the tank water is replaced once the number of wash cycles equals the preset value, the controller 214 shuts down the pumps (operation 312) and will not allow the pumps to be reactivated until the water is drained from the tank. Accordingly, the operator should then drain the tank (operation 314).

To automatically determine whether the water is being drained or has been drained from the tank, the tank fluid low level detection described above can be employed. That is, the thermocouple associated with the heater (e.g., the thermocouple within the heater 216, etc.) will detect (operation 316) a relatively abrupt temperature rise in the heating element when the water breaches or drains below the heater. This temperature rise indicates to the controller 214 that the tank water is being or has been drained. The controller 214 shuts down the heater at operation 318. Now that the controller 214 knows that the tank water should be replaced (via operations 308 and 310) and that the tank water is being or has been drained (via operation 316), the controller 214 allows the operator to reactivate (or the controller may automatically activate) the pumps 104 and 106 (operation 320). The controller 214 also resets the counter back to zero (operation 302). Additionally, or alternatively, the control system 212 could also notify the operator (e.g., by a visual display, emitting sounds, etc.) to manually reset the counter.

According to another aspect of the invention, a method relating to operation of a kitchenware washing assembly generally includes monitoring temperatures within the inside of a tank to detect a temperature differential indicative of two different fluid level conditions/states (e.g., at about full capacity and at less than full capacity, full and empty, that the fluid is being drained, full and partially empty, etc.). The temperature differential may indicate that one of the two different sensed temperatures was sensed while the inside of the tank held a different amount of fluid for washing kitchenware than when the other temperature was sensed. The monitoring may include monitoring the sensed temperatures to detect when the temperature sensed within the inside of the tank has increased by a predetermined amount over a predetermined time interval.

By way of example, various embodiments use a temperature sensor and control system to monitor temperatures within the tank to detect a particular temperature differential between a first temperature sensed within the fluid in the tank and a second temperature sensed outside the fluid. In these particular embodiments, the particular temperature differential between the first and second temperatures thus indicates that the fluid level within the tank was sufficient such that the first temperature was sensed by the temperature sensor when the location at which the temperature sensing occur was within the fluid, and such that the second temperature was sensed after the fluid has dropped and/or is below the location at which the temperature sensing occurs.

This method can also include using the detection of that particular temperature differential in connection with the operation of the kitchenware washing assembly. For example, one or more operations (e.g., pumps, heaters, etc.) can be controlled as a function of the temperature monitoring. As described above, the detection of the temperature differential can used for heater temperature high limit protection, tank fluid low level detection, and/or tank water replacement. In various embodiments, upon detection of the particular temperature differential, a controller may automatically shut down or deactivate one or more operations, such as the heater, pumps, soap dispenser, etc. Or, for example, an alarm may be generated after detecting the particular temperature differential, which, in turn, indicates to the operator to shut down or deactivate one or more operations of the kitchenware washing assembly.

This method may further include monitoring washing cycles to detect an indicator that the fluid for washing kitchenware should be replaced, and after detecting the indicator that the fluid for washing kitchenware should be replaced, inhibiting, limiting, or restricting a wash cycle at least until the temperature differential has been detected. In various embodiments, a control system of the kitchenware washing assembly may be preprogrammed with one or more preset programs and/or provided with control logic for monitoring washing cycles and for accomplishing other operations of these methods.

According to another aspect of the invention, a method relating to operation of a kitchenware washing assembly generally includes counting a number of washing cycles since a replacement of the fluid within tank, comparing the counted number of washing cycles to a preset value, and using the comparison in connection with the operation of the kitchenware washing assembly. In some embodiments, the preset value may be input by the operator (e.g., by a user interface of a control system, etc.), and/or the preset value may be preprogrammed into the controller. As described above, FIG. 44 illustrates one exemplary implementation of this method, although other implementations are possible. In addition, various embodiments can include a control system of the kitchenware washing assembly being preprogrammed with one or more preset programs and/or provided with control logic for accomplishing the operations of these methods.

The comparison of the counted number of washing cycles to a preset value can be used in various ways. By way of example, various embodiments generate an alarm when the counted number of cycles equals or exceeds the preset value, thus indicating to the operator that the tank water should be changed. Other embodiments control one or more operations as a function of counted wash cycles and/or as a function of fluid replacement intervals.

Further embodiments inhibit, limit, or restrict further wash cycles (e.g., automatically deactivating one or more operations, such as the pumps, heaters, soap dispensers, etc.) if the counted number of cycles equals or exceeds the preset value. The method may also include monitoring for an indicator (e.g., temperature differential as described above, a predetermined temperature, a predetermined temperature rise over a predetermined amount of time, etc.) of fluid drainage from the tank. In these embodiments, inhibiting the wash cycles may continue at least until after the indicator of fluid drainage has been detected.

In embodiments in which one or more operations are deactivated if the counted number of cycles equals or exceeds the preset value, the method can also include monitoring for an indicator (e.g., temperature differential as described above, etc.) of fluid drainage from the tank, and allowing reactivation of the deactivated one or more operations if the indicator is detected. Assuming reactivation is allowed, various embodiments include the deactivated one or more operations being automatically reactivated by a controller and/or manually reactivated by an operator.

In various embodiments, a kitchenware washing assembly may include different types of washing cycles, such as the washing cycles described above and/or light cleaning, medium cleaning, normal cleaning, heavy cleaning and overnight cleaning. In such embodiments, counting washing cycles may include counting washing cycles of a first type differently than washing cycles of a second type. For example, this counting operation may attribute a greater value to heavy duty wash cycles used for heavy pots and pans with caked-on food residues or remnants than to lighter duty wash cycles used for delicate and fragile dishware. In one particular embodiment, a greater value is attributed during the counting to wash cycles having a higher soap concentration than for those wash cycles with lower soap concentrations.

Accordingly, aspects of the present disclosure include using heaters and thermocouples for tank fluid low level detection, for heater temperature high limit protection, and for monitoring tank water replacement. These particular aspects of the present disclosure (as can all other aspects of the present disclosure) can be used individually or in combination with any one or more of the other aspects of the present disclosure.

Various embodiments can also include remote cycle programmability in which the user can program and specify operational parameters for one or more wash cycles or schemes over a communication interface. In such embodiments, network communications capability may be provided via a communication interface, such as an infrared, wireless, and/or wired interface to interface with an external system (e.g., personal digital assistant, cellular phone, laptop computer, etc.). In such embodiments, a user may use the user interface to remotely specify one or more control or operational parameters for one or more wash cycles or schemes to thereby customize or tailor the operation of the kitchenware washing assembly for specific cleaning needs. For example, the user interface may allow the user to remotely specify the timing, duration, water temperature, temperature ranges, maximum water temperature, cleaning solution or soap concentration levels, pump operational parameters (e.g., speeds, frequencies, pulsations, etc.), cleaning solution changes, fills and drains, event logging, data reporting, maintenance reporting, alarming, etc.

According to another aspect of the invention, various embodiments include automatic drain and fill cycles. In one particular embodiment, this auto drain/auto fill feature can be actuated by a control input. This feature automatically opens a drain solenoid valve connected to the drain of the tank, which, in turn, may be connected to a sewer line. After the lapse of a predetermined period of time, the drain solenoid valve is automatically closed. A display can produce an indicator of the auto drain when in this mode or cycle. After completion of the auto drain cycle and the drain solenoid valve has closed, the auto fill cycle is automatically initiated by the opening of an incoming water supply solenoid valve and pressure regulator on the input waterline. After the lapse of a second predetermined period of time, the incoming water supply solenoid valve closes to turn off the flow of water into tank. This feature can be performed by a controller of a control system, and may be implemented in software, firmware, and/or hardware.

The teachings of the present disclosure can be applied to a wide range of washing systems including existing washer systems for commercial or large-scale kitchens. Accordingly, aspects of the present disclosure should not be limited to implementation into any specific form/type of washing system.

In addition, aspects of the present disclosure should also not be limited to washing any particular type of items as various embodiments of the present disclosure provide washers that are capable of washing a variety of kitchenware, dishware, food service ware and equipment, pots, pans, food trays, grease filters, gratings, tableware, among other items. Indeed, embodiments of the present disclosure can also be used for meat thawing and for washing produce, fruits, vegetables, seafood, oysters, clamshells, crustaceans, non-kitchen items, non-food items, metal parts, plastic parts, etc. For example, a washing assembly of the present disclosure can be used for washing large quantities of potatoes that will be served at a restaurant. As another example, a washing assembly of the present disclosure can be used for washing plastic or metal parts in a manufacturing or industrial application.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). Similarly, it is envisioned that disclosure of two or more ranges of values for a parameter (whether such ranges are nested, overlapping or distinct) subsume all possible combination of ranges for the value that might be claimed using endpoints of the disclosed ranges.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items. The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method for monitoring tank water replacement of a kitchenware washing assembly to thereby automate the decision as to when tank water should be changed, the method comprising:

automatically determining whether a counted number of wash cycles, involving water maintained within a tank used to hold kitchenware for washing in the kitchenware washing assembly, is equal to or exceeds a preset value; and automatically controlling one or more operations of the kitchenware washing assembly when the counted number of wash cycles is equal to or exceeds the preset value;

wherein automatically controlling one or more operations of the kitchenware washing assembly comprises automatically inhibiting any additional wash cycles until after tank water replacement.

2. The method of claim 1, wherein automatically controlling one or more operations of the kitchenware washing assembly comprises automatically deactivating one or more operations of the kitchenware washing assembly.

3. The method of claim 2, further comprising:

monitoring temperature inside the tank of the kitchenware washing assembly for at least one of a temperature differential, a predetermined temperature, and/or a temperature increase by a predetermined amount over a predetermined time interval; and allowing reactivation of the deactivated one or more operations only after detection of the temperature differential, the predetermined temperature, and/or the temperature increase by the predetermined amount over the predetermined time interval.

4. The method of claim 2, further comprising requiring draining of fluid from the tank of the kitchenware washing assembly before allowing reactivation of the deactivated one or more operations.

5. The method of claim 2, further comprising:

automatically monitoring for an indicator of drainage of fluid from the tank of the kitchenware washing assembly; and allowing reactivation of the deactivated one or more operations only after detection of said indicator of drainage of fluid.

6. The method of claim of claim 5, wherein allowing reactivation of the deactivated one or more operations comprises:

allowing an operator to manually reactivate the deactivated one or more operations; and/or allowing a control system of the kitchenware washing assembly to automatically reactivate the deactivated one or more operations.

7. The method of claim 1, wherein automatically controlling one or more operations of the kitchenware washing assembly comprises:

automatically deactivating at least one pump of the kitchenware washing assembly; and/or automatically opening at least one drain of the kitchenware washing assembly to thereby allow fluid to drain from the tank of the kitchenware washing assembly; and/or automatically deactivating at least one heater of the kitchenware washing assembly; and/or automatically generating an alarm that indicates that tank water should be replaced.

8. The method of claim 1, wherein the method includes allowing an additional wash cycle where the counted number of wash cycles is less than the preset value.

9. The method of claim 1, further comprising monitoring for an indicator of drainage of fluid from the tank of the kitchenware washing assembly.

10. The method of claim 9, wherein monitoring for the indicator of drainage includes monitoring an inside of the tank of the kitchenware washing assembly for a temperature differential, a predetermined temperature, and/or a temperature increase by a predetermined amount over a predetermined time interval.

11. The method of claim 1, wherein the kitchenware washing assembly includes at least a first and a second wash cycle, and wherein counting includes counting the first wash cycle differently than the second washing cycle.

12. The method of claim 1, wherein:

the preset value represents a maximum allowable number of wash cycles that can be performed before tank water should be replaced; and/or the preset value is manually entered by an operator; and/or the preset value is preprogrammed into a control system of the kitchenware washing assembly.

13. The method of claim 1, wherein the method includes setting the counted number of wash cycles to zero after tank water replacement, and adding one to the counted number for each wash cycle performed thereafter.

14. The method of claim 1, wherein the method includes setting the counted number of wash cycles to zero when a sensed temperature within the tank of the kitchenware washing assembly has increased by a predetermined amount over a predetermined time interval.

15. The method of claim 1, further comprising causing drainage of the tank water from the tank, when the counted number of wash cycles is equal to or exceeds the preset value.

16. The method of claim 15, wherein causing drainage of the tank water from the tank includes automatically controlling a drain of the kitchenware washing assembly to cause drainage of the tank water from the tank.

17. An automated method for monitoring tank water replacement of a kitchenware washing assembly, the method comprising:

maintaining a count of the number of wash cycles performed since the most recent tank water replacement;

comparing the count with a preset value representing the acceptable number of wash cycles that can be performed before the tank water should be replaced;

shutting down one or more operations of the kitchenware washing assembly if the count is equal to or exceeds the preset value;

determining whether the tank water is being drained or has been drained from a tank used to hold kitchenware for washing in the kitchenware washing assembly, including monitoring temperature inside the tank of the kitchenware washing assembly for at least one of a temperature differential, a predetermined temperature, and/or a temperature increase by a predetermined amount over a predetermined time interval;

disallowing reactivation of the one or more operations at least until the determination that the tank water is being drained or has been drained from the tank; and allowing reactivation of the deactivated one or more operations after detection of the temperature differential, the predetermined temperature, and/or the temperature increase by the predetermined amount over the predetermined time interval.

18. A method for monitoring washing fluid replacement for a kitchenware washing assembly to thereby automate a decision as to when the washing fluid in the kitchenware washing assembly should be changed, the method comprising:

automatically determining whether a counted number of wash cycles and/or an elapsed time since a replacement of a washing fluid is equal to or exceeds a preset value;

automatically deactivating one or more operations of the kitchenware washing assembly, when the counted number of wash cycles and/or the elapsed time is equal to or exceeds the preset value;

monitoring temperature of the washing fluid in the kitchenware washing assembly for at least one of a temperature differential, a predetermined temperature, and/or a temperature increase by a predetermined amount over a predetermined time interval; and allowing reactivation of the deactivated one or more operations only after detection of the temperature differential, the predetermined temperature, and/or the temperature increase by the predetermined amount over the predetermined time interval.

19. A method for monitoring washing fluid replacement for a kitchenware washing assembly to thereby automate a decision as to when the washing fluid in the kitchenware washing assembly should be changed, the method comprising:

automatically determining whether an elapsed time since a replacement of a washing fluid in the kitchenware washing assembly is equal to or exceeds a preset value;

automatically inhibiting any additional wash cycles until after replacement of the washing fluid, when the elapsed time is equal to or exceeds the preset value; and causing drainage of the washing fluid from a tank of the kitchenware washing assembly used to hold kitchenware for washing, when the elapsed time is equal to or exceeds the preset value, so that the washing fluid can be replaced.

20. An automated method for monitoring washing fluid replacement for a kitchenware washing assembly to thereby automate a decision as to when the washing fluid in the kitchenware washing assembly should be changed, the method comprising:

tracking a counted number of wash cycles and/or a time that has elapsed since a replacement of a washing fluid in the kitchenware washing assembly;

comparing the counted number of wash cycles and/or the elapsed time to a preset value;

controlling one or more operations of the kitchenware washing assembly, when the counted number of wash cycles and/or the elapsed time is equal to or exceeds the preset value; and setting the counted number of wash cycles and/or the time to zero when a sensed temperature of the washing fluid in the kitchenware washing assembly has increased by a predetermined amount over a predetermined time interval.

21. An automated method relating to operation of a kitchenware washing assembly including a tank having an inside for holding fluid for washing kitchenware, the method comprising:

tracking a time that has elapsed since a replacement of the fluid in the tank used for washing the kitchenware;

comparing the elapsed time to a preset value;

monitoring for an indicator of drainage of the fluid from the tank used for washing the kitchenware; and if the elapsed time is equal to or exceeds the preset value, inhibiting a further washing cycle of the assembly at least until after the indicator of drainage has been detected.

22. A kitchenware washing assembly comprising a tank having an inside for holding kitchenware and fluid for washing the kitchenware, and a control system, the control system configured to:

track a time that has elapsed since the most recent tank water replacement, to determine whether the elapsed time is equal to or exceeds a preset value;

monitor for an indicator of drainage from the tank of the fluid used for washing the kitchenware; and if the elapsed time is equal to or exceeds the preset value, inhibit a further washing cycle of the assembly at least until after the indicator of drainage has been detected.

23. The kitchenware washing assembly of claim 22, wherein the control system is configured to automatically deactivate at least one pump of the kitchenware washing assembly when the elapsed time is equal to the preset value.

* * * * *